US010293211B2

(12) United States Patent
Watterson et al.

(10) Patent No.: US 10,293,211 B2
(45) Date of Patent: May 21, 2019

(54) COORDINATED WEIGHT SELECTION

(71) Applicant: ICON Health & Fitness, Inc., Logan, UT (US)

(72) Inventors: Scott R. Watterson, Providence, UT (US); William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 98 days.

(21) Appl. No.: 15/461,040

(22) Filed: Mar. 16, 2017

(65) Prior Publication Data

US 2017/0266503 A1 Sep. 21, 2017

Related U.S. Application Data

(60) Provisional application No. 62/310,503, filed on Mar. 18, 2016.

(51) Int. Cl.

| | |
|---|---|
| ***A63B 24/00*** | (2006.01) |
| ***A63B 21/072*** | (2006.01) |
| ***A63B 21/075*** | (2006.01) |
| ***A63B 22/02*** | (2006.01) |
| ***A63B 71/06*** | (2006.01) |

(52) U.S. Cl.

CPC ..... *A63B 24/0087* (2013.01); *A63B 21/075* (2013.01); *A63B 21/0726* (2013.01); *A63B 22/02* (2013.01); *A63B 24/0062* (2013.01); *A63B 24/0075* (2013.01); *A63B 71/0622* (2013.01); *A63B 71/0686* (2013.01); *A63B 2071/0625* (2013.01)

(58) Field of Classification Search

CPC ..... A63B 24/0087; A63B 24/0075; A63B 21/075; A63B 22/02; A63B 24/0062; A63B 21/0726; A63B 71/0622; A63B 71/0686; A63B 2071/0625

See application file for complete search history.

(56) References Cited

U.S. PATENT DOCUMENTS

| | | | |
|---|---|---|---|
| 9,595 | A | 2/1853 | Moreland |
| 9,695 | A | 5/1853 | Hinsdale |
| 34,577 | A | 3/1862 | Jabden |
| 104,973 | A | 7/1870 | Man |
| 115,826 | A | 6/1871 | Creed |
| 192,338 | A | 6/1877 | Marshall |

(Continued)

FOREIGN PATENT DOCUMENTS

| | | |
|---|---|---|
| KR | 100829744 | 5/2018 |
| TW | M504568 | 3/2015 |

(Continued)

OTHER PUBLICATIONS

International Search Report issued in PCT/US2017/022989 dated May 23, 2017.

(Continued)

*Primary Examiner* — Sundhara M Ganesan
(74) *Attorney, Agent, or Firm* — Maschoff Brennan

(57) ABSTRACT

A free weight assembly includes a cradle, an aerobic exercise element that is movable with respect to the cradle during the performance of an exercise, at least one free weight removable from the cradle, an input in communication with a processor that determines a time to instruct a user to remove the free weight, and an indicator that activates when the time to remove the free weight arrives.

20 Claims, 7 Drawing Sheets

(56) References Cited

U.S. PATENT DOCUMENTS 232,022 A 9/1880 Gifford et al.
232,579 A 9/1880 Weeks
248,121 A 10/1881 Tuttle
284,294 A 9/1883 Graves
321,388 A 6/1885 Ruebsam
325,435 A 9/1885 North
337,942 A 3/1886 Parley
339,638 A 4/1886 Goldie
353,089 A 11/1886 Smith
356,219 A 1/1887 Yeoman
359,778 A 3/1887 Pauber
372,272 A 10/1887 Murphy
374,496 A 12/1887 Reach
421,779 A 2/1890 Wvilliam
428,912 A 5/1890 Holmes
447,780 A 3/1891 Luge
450,792 A 4/1891 Dodd
457,400 A 8/1891 Dowd
480,271 A 8/1892 Newton
484,352 A 10/1892 Ayton
588,350 A 8/1897 Perkins
603,350 A 5/1898 Towers
610,716 A 9/1898 Marshal
624,995 A 5/1899 Tellefsen
659,216 A 10/1900 Dowling
663,486 A 12/1900 Boren
674,391 A 5/1901 Baker
679,784 A 8/1901 Ryan
680,556 A 8/1901 Wray
682,988 A 9/1901 Carroll
683,284 A 9/1901 Honey
685,788 A 11/1901 Mcfadden
689,418 A 12/1901 Ryan
722,462 A 3/1903 Smith
723,625 A 3/1903 Thornley
754,992 A 3/1904 Grabner
760,374 A 5/1904 Belvoir
761,504 A 5/1904 Kleinbach
766,930 A 8/1904 Clemons
772,906 A 10/1904 Reach
776,824 A 12/1904 Bryon, Jr.
807,670 A 12/1905 Grabner
846,389 A 3/1907 Blackburn
852,193 A 4/1907 Mcmillan
881,521 A 3/1908 Wilson
897,722 A 9/1908 Day
931,394 A 8/1909 Day
937,795 A 10/1909 Hackney
943,127 A 12/1909 Van Boven
964,745 A 7/1910 Blakoe
979,609 A 12/1910 Vaughn
1,016,729 A 2/1912 Barrett
1,019,861 A 3/1912 Titus
1,020,777 A 3/1912 Peterson
1,064,968 A 6/1913 Hagen
1,082,940 A 12/1913 Flora
1,115,826 A 11/1914 Johnson
1,123,272 A 1/1915 Goodman
1,144,085 A 6/1915 Abplanalp
1,211,765 A 1/1917 Schmidt
1,316,683 A 9/1919 Calvert
1,422,888 A 7/1922 Reeves
1,495,278 A 5/1924 Titus
1,539,214 A 5/1925 Shockey
1,570,482 A 1/1926 Hale
1,576,474 A 3/1926 Walker
1,580,530 A 4/1926 Rambo
1,585,748 A 5/1926 Wendelken
1,672,944 A 6/1928 Jowett
1,698,831 A 1/1929 Titus
1,715,870 A 6/1929 Spain
1,766,089 A 6/1930 Wood
1,778,635 A 10/1930 Heisler
1,824,406 A 9/1931 Petersime
1,850,530 A 3/1932 Brown
1,851,843 A 3/1932 Inman
1,893,728 A 1/1933 Bullis
1,902,694 A 3/1933 Edwards
1,917,566 A 7/1933 Wood
1,919,627 A 7/1933 Gerald
1,928,089 A 9/1933 Blickman
1,973,945 A 9/1934 Chavin
1,978,579 A 10/1934 Hooks
1,982,843 A 12/1934 Traver
1,982,872 A 12/1934 Newton
1,991,520 A 2/1935 Postl
2,067,136 A 1/1937 Bridenbaugh
2,117,957 A 5/1938 Ritter
2,129,262 A 9/1938 Cole
2,145,940 A 2/1939 Marlowe
2,153,077 A 4/1939 Clarke
2,165,700 A 7/1939 Glynn
2,177,957 A 10/1939 Stewart
2,183,345 A 12/1939 Brandon
2,209,034 A 7/1940 Rene
2,219,219 A 10/1940 Boger
2,247,946 A 7/1941 Hein et al.
2,255,864 A 9/1941 Stephens
2,274,574 A 2/1942 Zerne
2,315,485 A 4/1943 Jones
2,346,105 A 4/1944 Haehnel
2,379,984 A 7/1945 Nereaux
2,399,915 A 5/1946 Drake
2,436,987 A 3/1948 Bailleaux
2,438,548 A 3/1948 Ehmann
2,440,644 A 4/1948 Powell
2,456,017 A 12/1948 Park
2,470,544 A 5/1949 Bell
2,472,391 A 6/1949 Albizu
2,500,299 A 3/1950 Spitzkeit
2,512,417 A 6/1950 Polite
2,569,007 A 9/1951 Klyce
2,573,351 A 10/1951 Motis
2,632,645 A 3/1953 Barkschat
2,637,319 A 5/1953 Bruene
2,640,696 A 6/1953 Lemieux
2,641,250 A 6/1953 Brockman
2,642,288 A 6/1953 Bell
2,645,539 A 7/1953 Thompson
2,646,282 A 7/1953 Ringman
2,648,540 A 8/1953 Hunter
2,654,135 A 10/1953 Grizzard et al.
2,674,453 A 4/1954 Hummert
2,695,797 A 11/1954 Mccarthy et al.
2,714,507 A 8/1955 Goodrich
2,740,178 A 4/1956 Kellems
2,743,623 A 5/1956 Wells
2,746,822 A 5/1956 Copenhaver
2,763,156 A 9/1956 Garigal
2,842,365 A 7/1958 Kelley
2,843,858 A 7/1958 Bjorklund
2,855,200 A 10/1958 Blickman
2,874,971 A 2/1959 Devery
2,924,456 A 2/1960 Miller
2,927,006 A 3/1960 Brooks
2,938,695 A 5/1960 Ciampa
2,968,337 A 1/1961 Bartlett
2,969,060 A 1/1961 Swanda
2,977,120 A 3/1961 Morris
2,978,830 A 4/1961 Killian
2,984,594 A 5/1961 Runton
2,985,933 A 5/1961 Peterson et al.
3,000,628 A 9/1961 Kellogg
3,035,671 A 5/1962 Sicherman
3,057,201 A 10/1962 Jaeger
3,059,312 A 10/1962 Jamieson
3,068,002 A 12/1962 Balne
3,068,950 A 12/1962 Davidson
3,072,426 A 1/1963 Gilbert
3,090,092 A 5/1963 Szemplak
3,099,509 A 7/1963 Duenke
3,112,108 A 11/1963 Hanke
3,115,332 A 12/1963 Singleton
3,118,441 A 1/1964 Prosser

(56) References Cited

U.S. PATENT DOCUMENTS 3,127,171 A 3/1964 Noland et al.
3,161,395 A 12/1964 Carter
3,179,071 A 4/1965 Johnston
3,193,287 A 7/1965 Robinson
3,194,598 A 7/1965 Goldfuss
3,205,888 A 9/1965 Stroop
3,246,894 A 4/1966 Salisbury
3,256,630 A 6/1966 Spector
3,270,494 A 9/1966 Holmes
3,312,466 A 4/1967 Melchiona
3,316,898 A 5/1967 Brown
3,319,273 A 5/1967 Solin
3,323,367 A 6/1967 Searle
3,342,485 A 9/1967 Gaul
3,345,067 A 10/1967 Smith
3,349,621 A 10/1967 Mullen
3,358,813 A 12/1967 Kohlhagen
3,370,584 A 2/1968 Girten
3,373,993 A 3/1968 Oja et al.
3,378,259 A 4/1968 Kupchinski
3,380,737 A 4/1968 Petros
3,381,958 A 5/1968 Gulland
3,384,370 A 5/1968 Bailey et al.
3,390,460 A 7/1968 Brown
3,408,067 A 10/1968 Armstrong
3,408,069 A 10/1968 Lewis
3,411,497 A 11/1968 Rickey et al.
3,411,776 A 11/1968 Holkesvick et al.
3,416,174 A 12/1968 Novitske
3,428,311 A 2/1969 Mitchell
3,428,312 A 2/1969 Machen
3,430,507 A 3/1969 Hurst et al.
3,432,164 A 3/1969 Deeks
3,438,627 A 4/1969 La Lanne
3,444,830 A 5/1969 Doetsch
3,446,503 A 5/1969 Lawton
3,456,592 A 7/1969 Nelsen
3,465,592 A 9/1969 Perrine
3,482,835 A 12/1969 Dean
3,488,051 A 1/1970 Scherer
3,495,824 A 2/1970 Cuinier
3,501,140 A 3/1970 Eichorn
3,511,500 A 5/1970 Dunn
3,514,110 A 5/1970 Thomander
3,518,985 A 7/1970 Quinton
3,540,724 A 11/1970 Hunter
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,588,101 A 6/1971 Jungreis
3,589,193 A 6/1971 Thornton
3,589,715 A 6/1971 Mark
3,589,720 A 6/1971 Agamian
3,592,466 A 7/1971 Parsons
3,598,404 A 8/1971 Bowman
3,601,398 A 8/1971 Brochman
3,602,502 A 8/1971 Jaegar
3,606,320 A 9/1971 Erwin, Jr.
3,606,406 A 9/1971 Walters
3,608,898 A 9/1971 Berlin
3,614,097 A 10/1971 Blickman
3,614,108 A 10/1971 Garten
3,617,056 A 11/1971 Herbold
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,640,530 A 2/1972 Henson et al.
3,641,601 A 2/1972 Sieg
3,642,279 A 2/1972 Cutter
3,643,943 A 2/1972 Erwin, Jr. et al.
3,647,209 A 3/1972 La Lanne
3,650,529 A 3/1972 Salm
3,652,085 A 3/1972 Civalier
3,658,327 A 4/1972 Thiede
3,659,845 A 5/1972 Quinton
3,664,666 A 5/1972 Lloyd
3,664,910 A 5/1972 Hollie
3,664,916 A 5/1972 Grellier et al.
3,672,124 A 6/1972 Pirotta
3,679,244 A 7/1972 Reddy
3,686,776 A 8/1972 Dahl
3,689,066 A 9/1972 Hagen
3,690,655 A 9/1972 Chapman
3,703,284 A 11/1972 Hesen
3,708,166 A 1/1973 Annas
3,708,167 A 1/1973 Potgieter
3,709,197 A 1/1973 Moseley
3,731,917 A 5/1973 Townsend
3,738,649 A 6/1973 Miller
3,741,538 A 6/1973 Useldinger
3,751,033 A 8/1973 Rosenthal
3,756,595 A 9/1973 Hague
3,758,109 A 9/1973 Bender
3,759,511 A 9/1973 Zinkin
3,761,083 A 9/1973 Buchner
3,767,195 A 10/1973 Dimick
3,771,785 A 11/1973 Speyer
3,784,193 A 1/1974 Simjian
3,788,412 A 1/1974 Vincent
3,789,467 A 2/1974 Aratani et al.
3,792,860 A 2/1974 Selnes
3,797,624 A 3/1974 Powell et al.
3,802,701 A 4/1974 Good
3,807,728 A 4/1974 Chillier
3,809,393 A 5/1974 Jones
3,814,420 A 6/1974 Encke
3,815,903 A 6/1974 Blomqvist
3,822,488 A 7/1974 Johnson
3,822,599 A 7/1974 Brentham
3,825,253 A 7/1974 Speyer
3,826,491 A 7/1974 Elder
3,831,942 A 8/1974 Del
3,833,216 A 9/1974 Philbin
3,834,696 A 9/1974 Spector
3,840,227 A 10/1974 Chesemore
3,848,467 A 11/1974 Flavell
3,851,874 A 12/1974 Wilkin
3,858,873 A 1/1975 Jones
3,858,874 A 1/1975 Weider
3,858,938 A 1/1975 Kristensson et al.
3,861,215 A 1/1975 Bradley
3,869,121 A 3/1975 Flavell
3,870,297 A 3/1975 Elder
3,874,375 A 4/1975 Penner
3,874,657 A 4/1975 Niebojewski
3,880,274 A 4/1975 Bechtloff
3,883,922 A 5/1975 Fleischhauer
3,884,464 A 5/1975 Evangelos
3,891,207 A 6/1975 Helliwell
3,892,404 A 7/1975 Martucci
3,901,379 A 8/1975 Bruhm
3,902,480 A 9/1975 Wilson
3,902,717 A 9/1975 Kulkens
3,903,613 A 9/1975 Bisberg
3,904,196 A 9/1975 Berlin
3,909,857 A 10/1975 Herrera
3,912,263 A 10/1975 Yatso
3,913,908 A 10/1975 Speyer
3,918,710 A 11/1975 Niebojewski
3,920,240 A 11/1975 Ross
3,926,430 A 12/1975 Good
3,929,026 A 12/1975 Hofmann
3,938,400 A 2/1976 Konyha
3,938,803 A 2/1976 Wilmoth
3,941,377 A 3/1976 Lie

(56) References Cited

U.S. PATENT DOCUMENTS 3,948,513 A 4/1976 Pfotenhauer
3,953,025 A 4/1976 Mazman
3,957,266 A 5/1976 Rice
3,958,803 A 5/1976 Geisselbrecht
3,963,101 A 6/1976 Stadelmann et al.
3,971,555 A 7/1976 Mahnke
3,976,058 A 8/1976 Tidwell
3,977,451 A 8/1976 Duba
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,012,015 A 3/1977 Nelson et al.
4,024,949 A 5/1977 Kleysteuber et al.
4,026,545 A 5/1977 Schonenberger
4,026,548 A 5/1977 Birdwell
4,029,312 A 6/1977 Wright
4,033,567 A 7/1977 Lipfert
4,042,305 A 8/1977 Vincent
4,043,552 A 8/1977 Kerkonian
4,056,265 A 11/1977 Ide
4,059,265 A 11/1977 Wieder et al.
4,060,240 A 11/1977 Dunston
4,061,257 A 12/1977 St. Clair
4,063,726 A 12/1977 Wilson
4,063,727 A 12/1977 Hall
4,066,257 A 1/1978 Moller
4,066,259 A 1/1978 Brentham
4,066,868 A 1/1978 Witkin et al.
4,067,372 A 1/1978 Masson
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,076,236 A 2/1978 Ionel
4,076,237 A 2/1978 Dussia
4,077,626 A 3/1978 Newman
4,082,267 A 4/1978 Flavell
4,093,196 A 6/1978 Bauer
4,093,211 A 6/1978 Hughes et al.
4,094,330 A 6/1978 Jong
4,098,100 A 7/1978 Wah
4,101,124 A 7/1978 Mahnke
4,111,417 A 9/1978 Gardner
4,113,071 A 9/1978 Muller et al.
4,120,294 A 10/1978 Wolfe
4,122,585 A 10/1978 Sharp et al.
4,131,701 A 12/1978 VanAuken
4,140,312 A 2/1979 Buchmann
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,154,441 A 5/1979 Gajda
4,157,181 A 6/1979 Cecka
4,157,594 A 6/1979 Raabe
4,167,938 A 9/1979 Remih
4,168,061 A 9/1979 Gordon
4,170,351 A 10/1979 Ozbey
4,171,805 A 10/1979 Abbott
4,176,836 A 12/1979 Coyle
4,179,134 A 12/1979 Atkinson
4,183,156 A 1/1980 Rudy
4,183,494 A 1/1980 Cleveland
4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,215,516 A 8/1980 Huschle et al.
4,216,856 A 8/1980 Moring et al.
4,227,689 A 10/1980 Keiser
4,231,568 A 11/1980 Riley
4,231,569 A 11/1980 Rae
4,235,437 A 11/1980 Ruis et al.
4,239,092 A 12/1980 Janson
4,240,627 A 12/1980 Brentham
4,241,915 A 12/1980 Noble
4,248,476 A 2/1981 Phelps
4,249,725 A 2/1981 Mattox
4,249,773 A 2/1981 Giambalvo
4,251,932 A 2/1981 Love
4,252,314 A 2/1981 Ceppo
4,253,661 A 3/1981 Russell
4,253,662 A 3/1981 Podolak
4,256,302 A 3/1981 Keiser et al.
4,257,590 A 3/1981 Sullivan et al.
4,258,821 A 3/1981 Wendt
4,258,913 A 3/1981 Brentham
4,263,897 A 4/1981 Terayama
4,274,625 A 6/1981 Gaetano
4,275,882 A 6/1981 Grosser et al.
4,278,095 A 7/1981 Lapeyre
4,278,249 A 7/1981 Forrest
4,286,782 A 9/1981 Fuhrhop
4,290,601 A 9/1981 Mittelstadt
4,296,924 A 10/1981 Anzaldua et al.
4,300,760 A 11/1981 Bobroff
4,300,761 A 11/1981 Howard
4,307,880 A 12/1981 Abram
4,313,602 A 2/1982 Sullivan
4,313,603 A 2/1982 Simjian
4,316,609 A 2/1982 Silberman
4,316,610 A 2/1982 Hinds
4,324,501 A 4/1982 Herbenar
4,325,548 A 4/1982 Piccini
4,327,713 A 5/1982 Okazaki et al.
4,328,964 A 5/1982 Walls
4,328,965 A 5/1982 Hatfield
4,328,968 A 5/1982 Hacker
4,333,978 A 6/1982 Kocher
4,334,676 A 6/1982 Schonenberger
4,334,678 A 6/1982 Doyel
4,334,695 A 6/1982 Ashby
4,337,283 A 6/1982 Haas, Jr.
4,342,452 A 8/1982 Summa
4,344,616 A 8/1982 Ogden
4,345,756 A 8/1982 Hoagland
4,346,888 A 8/1982 Szabo
4,349,192 A 9/1982 Lambert, Jr. et al.
4,349,597 A 9/1982 Fine et al.
4,350,336 A 9/1982 Hanford
4,354,675 A 10/1982 Barclay et al.
4,355,061 A 10/1982 Zeigler
4,357,010 A 11/1982 Telle
4,357,011 A 11/1982 Voris
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,368,735 A 1/1983 Filmer
4,369,081 A 1/1983 Curry et al.
4,369,966 A 1/1983 Silberman et al.
4,370,766 A 2/1983 Teague, Jr.
4,371,162 A 2/1983 Hartzell
4,372,553 A 2/1983 Hatfield
4,373,716 A 2/1983 Pagani
4,374,587 A 2/1983 Ogden
4,374,588 A 2/1983 Ruggles
4,376,533 A 3/1983 Kolbel
4,377,045 A 3/1983 Aurensan
4,382,596 A 5/1983 Silberman
4,383,684 A 5/1983 Schliep
4,383,714 A 5/1983 Ishida
4,384,715 A 5/1983 Barrett, Jr.
4,387,893 A 6/1983 Baldwin
4,389,047 A 6/1983 Hall

(56) References Cited

U.S. PATENT DOCUMENTS 4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell
4,431,184 A 2/1984 Lew et al.
4,434,981 A 3/1984 Norton
4,441,708 A 4/1984 Brentham
4,445,684 A 5/1984 Ruff
4,448,434 A 5/1984 Anderson
4,452,448 A 6/1984 Ausherman
4,453,766 A 6/1984 DiVito
4,456,245 A 6/1984 Baldwin
4,456,246 A 6/1984 Szabo
4,461,472 A 7/1984 Martinez
4,461,473 A 7/1984 Cole
4,463,948 A 8/1984 Mohr
4,465,274 A 8/1984 Davenport
4,465,276 A 8/1984 Cox
4,465,277 A 8/1984 Dittrich
4,474,370 A 10/1984 Oman
4,476,582 A 10/1984 Strauss et al.
4,477,071 A 10/1984 Brown et al.
4,478,413 A 10/1984 Siwula
4,482,152 A 11/1984 Wolff
4,489,933 A 12/1984 Fisher
4,489,936 A 12/1984 Dal Monte
4,491,318 A 1/1985 Francke
4,492,375 A 1/1985 Connelly
4,494,662 A 1/1985 Clymer
4,496,147 A 1/1985 DeCloux et al.
4,499,784 A 2/1985 Shum
4,502,679 A 3/1985 De Lorenzo
4,502,682 A 3/1985 Miller
4,505,474 A 3/1985 Mattox
4,505,475 A 3/1985 Olschansky et al.
4,505,495 A 3/1985 Foss et al.
4,509,510 A 4/1985 Hook
4,511,137 A 4/1985 Jones
4,512,567 A 4/1985 Phillips
4,512,571 A 4/1985 Hermelin
4,515,363 A 5/1985 Schleffendorf
4,521,013 A 6/1985 Dofel
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,536,244 A 8/1985 Greci et al.
4,537,396 A 8/1985 Hooper
4,538,805 A 9/1985 Parviainen
4,540,171 A 9/1985 Clark
4,540,173 A 9/1985 Hopkins, Jr.
4,542,899 A 9/1985 Hendricks
4,544,152 A 10/1985 Taitel
4,544,153 A 10/1985 Babcock
4,546,967 A 10/1985 Kecala
4,546,970 A 10/1985 Mahnke
4,546,971 A 10/1985 Raasoch
4,548,405 A 10/1985 Lee
4,549,433 A 10/1985 Gneiss et al.
4,549,733 A 10/1985 Salyer
4,549,734 A 10/1985 Hibler, Jr.
4,555,109 A 11/1985 Hartmann
4,556,216 A 12/1985 Pitkanen
4,563,001 A 1/1986 Terauds
4,563,003 A 1/1986 Bugallo et al.
4,564,193 A 1/1986 Stewart
4,565,369 A 1/1986 Bedgood
4,566,689 A 1/1986 Ogden
4,566,690 A 1/1986 Schook
4,566,732 A 1/1986 Ostergaard, Sr.
4,569,518 A 2/1986 Fulks
4,569,519 A 2/1986 Mattox et al.
4,571,682 A 2/1986 Silverman et al.
4,572,500 A 2/1986 Weiss
4,572,504 A 2/1986 DiBartolo
4,575,074 A 3/1986 Damratoski
4,576,352 A 3/1986 Ogden
4,576,376 A 3/1986 Miller
4,576,377 A 3/1986 Wolff
4,577,860 A 3/1986 Matias et al.
4,577,861 A 3/1986 Bangerter et al.
4,579,360 A 4/1986 Nishimura et al.
4,580,983 A 4/1986 Cassini et al.
4,581,269 A 4/1986 Tilman
4,582,320 A 4/1986 Shaw
4,587,695 A 5/1986 Jensen
4,589,656 A 5/1986 Baldwin
4,591,147 A 5/1986 Smith et al.
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Jones
4,601,142 A 7/1986 Frommelt
4,602,779 A 7/1986 Ogden
4,603,855 A 8/1986 Sebelle
4,603,856 A 8/1986 Fiore
4,606,540 A 8/1986 Chin Sen
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,620,701 A 11/1986 Mojden
4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,625,962 A 12/1986 Street
4,627,614 A 12/1986 de Angeli
4,627,615 A 12/1986 Nurkowski
4,627,616 A 12/1986 Kauffman
4,627,618 A 12/1986 Schwartz
4,630,817 A 12/1986 Buckley
4,632,385 A 12/1986 Geraci
4,632,386 A 12/1986 Beech
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,635,927 A 1/1987 Shu
4,635,928 A 1/1987 Ogden et al.
4,637,605 A 1/1987 Ritchie
4,638,523 A 1/1987 Todd

(56) References Cited

U.S. PATENT DOCUMENTS

| | | | |
|---|---|---|---|
| 4,638,969 | A | 1/1987 | Brown |
| 4,638,994 | A | 1/1987 | Gogarty |
| 4,641,833 | A | 2/1987 | Trethewey |
| 4,642,080 | A | 2/1987 | Takano et al. |
| 4,643,418 | A | 2/1987 | Bart |
| 4,643,420 | A | 2/1987 | Riley |
| 4,645,197 | A | 2/1987 | Mcfee |
| 4,645,198 | A | 2/1987 | Levenston |
| 4,645,200 | A | 2/1987 | Hix |
| 4,645,201 | A | 2/1987 | Evans |
| 4,645,917 | A | 2/1987 | Penney et al. |
| 4,647,037 | A | 3/1987 | Donohue |
| 4,647,040 | A | 3/1987 | Ehrenfried |
| 4,647,041 | A | 3/1987 | Whiteley |
| 4,648,481 | A | 3/1987 | Lee |
| 4,648,594 | A | 3/1987 | Schleffendorf |
| 4,650,067 | A | 3/1987 | Brule |
| 4,650,183 | A | 3/1987 | McIntyre |
| 4,650,184 | A | 3/1987 | Brebner |
| 4,650,185 | A | 3/1987 | Cartwright |
| 4,651,581 | A | 3/1987 | Svensson |
| 4,651,988 | A | 3/1987 | Sobel |
| 4,655,448 | A | 4/1987 | Harder |
| 4,657,246 | A | 4/1987 | Salyer |
| 4,659,074 | A | 4/1987 | Taitel et al. |
| 4,659,077 | A | 4/1987 | Stropkay |
| 4,659,078 | A | 4/1987 | Blome |
| 4,660,550 | A | 4/1987 | Bodine |
| 4,662,629 | A | 5/1987 | Plovie |
| 4,662,630 | A | 5/1987 | Dignard et al. |
| 4,664,371 | A | 5/1987 | Viander |
| 4,664,373 | A | 5/1987 | Hait |
| 4,664,646 | A | 5/1987 | Rorabaugh |
| 4,666,149 | A | 5/1987 | Olschansky et al. |
| 4,666,151 | A | 5/1987 | Chillier |
| 4,673,177 | A | 6/1987 | Szymski |
| 4,673,180 | A | 6/1987 | Rice |
| 4,674,740 | A | 6/1987 | Iams et al. |
| 4,674,743 | A | 6/1987 | Hirano |
| 4,678,185 | A | 7/1987 | Mahnke |
| 4,679,786 | A | 7/1987 | Rodgers |
| 4,679,787 | A | 7/1987 | Guilbault |
| 4,684,121 | A | 8/1987 | Nestegard |
| 4,684,126 | A | 8/1987 | Dalebout et al. |
| 4,685,670 | A | 8/1987 | Zinkin |
| 4,685,671 | A | 8/1987 | Hagerman et al. |
| 4,687,195 | A | 8/1987 | Potts |
| 4,697,809 | A | 10/1987 | Rockwell |
| 4,700,946 | A | 10/1987 | Breunig |
| 4,702,475 | A | 10/1987 | Elstein et al. |
| 4,705,267 | A | 11/1987 | Jackson |
| 4,706,953 | A | 11/1987 | Graham |
| 4,708,337 | A | 11/1987 | Shyu |
| 4,709,917 | A | 12/1987 | Yang |
| 4,709,918 | A | 12/1987 | Grinblat |
| 4,709,920 | A | 12/1987 | Schnell |
| 4,711,447 | A | 12/1987 | Mansfield |
| 4,714,248 | A | 12/1987 | Koss |
| 4,717,146 | A | 1/1988 | Nohara |
| 4,718,207 | A | 1/1988 | Frommelt |
| 4,720,093 | A | 1/1988 | Del Mar |
| 4,720,099 | A | 1/1988 | Rockwell |
| 4,720,789 | A | 1/1988 | Hector et al. |
| 4,721,301 | A | 1/1988 | Drake |
| 4,721,303 | A | 1/1988 | Fitzpatrick |
| 4,722,522 | A | 2/1988 | Lundgren |
| 4,725,057 | A | 2/1988 | Shifferaw |
| 4,726,581 | A | 2/1988 | Chang |
| 4,726,582 | A | 2/1988 | Fulks |
| 4,728,099 | A | 3/1988 | Pitre |
| 4,729,558 | A | 3/1988 | Kuo |
| 4,729,562 | A | 3/1988 | Pipasik |
| 4,730,828 | A | 3/1988 | Lane |
| 4,730,829 | A | 3/1988 | Carlson |
| 4,733,858 | A | 3/1988 | Lan |
| 4,733,860 | A | 3/1988 | Steffee |
| 4,733,905 | A | 3/1988 | Buickerood |
| 4,741,530 | A | 5/1988 | Wolf |
| 4,743,009 | A | 5/1988 | Beale |
| 4,743,010 | A | 5/1988 | Geraci |
| 4,743,015 | A | 5/1988 | Marshall |
| 4,743,017 | A | 5/1988 | Jaeger |
| 4,744,559 | A | 5/1988 | Mahnke et al. |
| 4,746,115 | A | 5/1988 | Lahman |
| 4,749,184 | A | 6/1988 | Tobin |
| 4,750,736 | A | 6/1988 | Watterson |
| 4,750,738 | A | 6/1988 | Dang |
| 4,751,755 | A | 6/1988 | Carey, Jr. et al. |
| 4,753,437 | A | 6/1988 | Lapcevic |
| 4,756,098 | A | 7/1988 | Boggia |
| 4,756,527 | A | 7/1988 | Ledbetter |
| 4,757,987 | A | 7/1988 | Allemand |
| 4,759,540 | A | 7/1988 | Yu et al. |
| 4,763,897 | A | 8/1988 | Yakata |
| 4,765,610 | A | 8/1988 | Sidwell |
| 4,765,613 | A | 8/1988 | Voris |
| 4,765,616 | A | 8/1988 | Wolff |
| 4,768,780 | A | 9/1988 | Hayes |
| 4,771,148 | A | 9/1988 | Bersonnet |
| 4,772,015 | A | 9/1988 | Carlson et al. |
| 4,773,170 | A | 9/1988 | Moore et al. |
| 4,773,640 | A | 9/1988 | Kolbel et al. |
| 4,775,149 | A | 10/1988 | Wilson |
| 4,776,581 | A | 10/1988 | Shepherdson |
| 4,776,582 | A | 10/1988 | Ramhorst |
| 4,776,587 | A | 10/1988 | Carlson et al. |
| 4,778,173 | A | 10/1988 | Joutras |
| 4,779,867 | A | 10/1988 | Hinds |
| 4,779,884 | A | 10/1988 | Minati |
| 4,784,384 | A | 11/1988 | Deola |
| 4,786,049 | A | 11/1988 | Lautenschlager |
| 4,786,050 | A | 11/1988 | Geschwender |
| 4,789,153 | A | 12/1988 | Brown |
| 4,790,522 | A | 12/1988 | Drutchas |
| 4,790,528 | A | 12/1988 | Nakao et al. |
| 4,790,596 | A | 12/1988 | Shifferaw |
| 4,792,134 | A | 12/1988 | Chen |
| 4,793,608 | A | 12/1988 | Mahnke et al. |
| 4,797,968 | A | 1/1989 | Wenzlick |
| 4,798,377 | A | 1/1989 | White |
| 4,798,760 | A | 1/1989 | Diaz-Kotti |
| 4,799,475 | A | 1/1989 | Iams et al. |
| 4,799,671 | A | 1/1989 | Hoggan et al. |
| 4,801,079 | A | 1/1989 | Gonella |
| 4,801,139 | A | 1/1989 | Vanhoutte |
| 4,801,140 | A | 1/1989 | Bergeron |
| 4,804,178 | A | 2/1989 | Friedebach |
| 4,805,901 | A | 2/1989 | Kulick |
| 4,807,874 | A | 2/1989 | Little |
| 4,807,893 | A | 2/1989 | Huang |
| 4,809,804 | A | 3/1989 | Houston et al. |
| 4,809,972 | A | 3/1989 | Rasmussen et al. |
| 4,809,973 | A | 3/1989 | Johns |
| 4,809,976 | A | 3/1989 | Berger |
| 4,813,667 | A | 3/1989 | Watterson |
| 4,813,668 | A | 3/1989 | Solloway |
| 4,813,743 | A | 3/1989 | Mizelle |
| 4,817,939 | A | 4/1989 | Augspurger et al. |
| 4,818,175 | A | 4/1989 | Toshiba |
| 4,819,583 | A | 4/1989 | Guerra |
| 4,822,029 | A | 4/1989 | Sarno |
| 4,822,034 | A | 4/1989 | Shields |
| 4,822,035 | A | 4/1989 | Jennings et al. |
| 4,822,038 | A | 4/1989 | Maag |
| 4,824,104 | A | 4/1989 | Bloch |
| 4,826,153 | A | 5/1989 | Schalip |
| 4,826,157 | A | 5/1989 | Fitzpatrick |
| 4,826,158 | A | 5/1989 | Fields, Jr. |
| 4,826,159 | A | 5/1989 | Hersey |
| 4,828,255 | A | 5/1989 | Lahman |
| 4,828,257 | A | 5/1989 | Dyer et al. |
| 4,830,362 | A | 5/1989 | Bull |
| 4,830,363 | A | 5/1989 | Kennedy |
| 4,830,365 | A | 5/1989 | March |

(56) References Cited

U.S. PATENT DOCUMENTS

| | | | |
|---|---|---|---|
| 4,832,332 | A | 5/1989 | Dumbser |
| 4,834,365 | A | 5/1989 | Jones |
| 4,834,396 | A | 5/1989 | Schnell |
| 4,836,530 | A | 6/1989 | Stanley, Jr. |
| 4,836,535 | A | 6/1989 | Pearson |
| 4,838,180 | A | 6/1989 | Gutgsell |
| 4,838,543 | A | 6/1989 | Armstrong et al. |
| 4,838,544 | A | 6/1989 | Sasakawa et al. |
| 4,840,373 | A | 6/1989 | Maag |
| 4,842,266 | A | 6/1989 | Sweeney, Sr. |
| 4,842,268 | A | 6/1989 | Jenkins |
| 4,842,274 | A | 6/1989 | Oosthuizen |
| 4,844,448 | A | 7/1989 | Niznik |
| 4,844,449 | A | 7/1989 | Truslaske |
| 4,844,450 | A | 7/1989 | Rodgers, Jr. |
| 4,844,453 | A | 7/1989 | Hestilow |
| 4,844,456 | A | 7/1989 | Habing et al. |
| 4,846,458 | A | 7/1989 | Potts |
| 4,848,737 | A | 7/1989 | Ehrenfield |
| 4,850,585 | A | 7/1989 | Dalebout |
| 4,852,874 | A | 8/1989 | Sleichter, III et al. |
| 4,854,578 | A | 8/1989 | Fulks |
| 4,856,773 | A | 8/1989 | Deola |
| 4,856,775 | A | 8/1989 | Colledge |
| 4,858,912 | A | 8/1989 | Boyd |
| 4,858,915 | A | 8/1989 | Szabo |
| 4,858,918 | A | 8/1989 | Iams et al. |
| 4,861,020 | A | 8/1989 | Soligny, Sr. |
| 4,861,023 | A | 8/1989 | Wedman |
| 4,861,025 | A | 8/1989 | Rockwell |
| 4,863,161 | A | 9/1989 | Telle |
| 4,863,163 | A | 9/1989 | Wehrell |
| 4,865,344 | A | 9/1989 | Romero, Sr. et al. |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,872,670 | A | 10/1989 | Nichols |
| 4,875,676 | A | 10/1989 | Zimmer |
| 4,877,239 | A | 10/1989 | Dela Rosa |
| 4,878,662 | A | 11/1989 | Chern |
| 4,878,663 | A | 11/1989 | Luquette |
| 4,880,227 | A | 11/1989 | Sowell |
| 4,880,229 | A | 11/1989 | Broussard |
| 4,880,230 | A | 11/1989 | Cook |
| 4,883,272 | A | 11/1989 | Lay |
| 4,886,266 | A | 12/1989 | Trulaske |
| 4,887,929 | A | 12/1989 | Hale |
| 4,889,458 | A | 12/1989 | Taylor |
| 4,891,764 | A | 1/1990 | McIntosh |
| 4,893,409 | A | 1/1990 | Poehlmann |
| 4,893,810 | A | 1/1990 | Lee |
| 4,894,933 | A | 1/1990 | Tonkel et al. |
| 4,898,379 | A | 2/1990 | Shiba |
| 4,898,381 | A | 2/1990 | Gordon |
| 4,900,012 | A | 2/1990 | Fu |
| 4,900,013 | A | 2/1990 | Rodgers, Jr. |
| 4,900,016 | A | 2/1990 | Caruthers |
| 4,900,017 | A | 2/1990 | Bold, Jr. |
| 4,900,018 | A | 2/1990 | Ish, III |
| 4,902,006 | A | 2/1990 | Stallings, Jr. |
| 4,902,007 | A | 2/1990 | Ferrari |
| 4,904,829 | A | 2/1990 | Berthaud et al. |
| 4,905,330 | A | 3/1990 | Jacobs |
| 4,907,795 | A | 3/1990 | Shaw et al. |
| 4,907,798 | A | 3/1990 | Burchatz |
| 4,909,504 | A | 3/1990 | Yang |
| 4,909,505 | A | 3/1990 | Tee |
| 4,911,436 | A | 3/1990 | Lighter |
| 4,911,438 | A | 3/1990 | Van Straaten |
| 4,913,396 | A | 4/1990 | Dalebout et al. |
| 4,913,419 | A | 4/1990 | McAuliffe |
| 4,913,422 | A | 4/1990 | Elmore |
| 4,913,423 | A | 4/1990 | Farran |
| 4,915,377 | A | 4/1990 | Malnke et al. |
| 4,915,379 | A | 4/1990 | Sapp |
| 4,917,376 | A | 4/1990 | Lo |
| 4,919,418 | A | 4/1990 | Miller |
| 4,919,419 | A | 4/1990 | Houston |
| 4,921,242 | A | 5/1990 | Watterson |
| 4,921,245 | A | 5/1990 | Roberts |
| 4,921,247 | A | 5/1990 | Sterling |
| 4,923,193 | A | 5/1990 | Pitzen et al. |
| 4,925,183 | A | 5/1990 | Kim |
| 4,925,200 | A | 5/1990 | Jones |
| 4,925,724 | A | 5/1990 | Ogden |
| 4,927,136 | A | 5/1990 | Leask |
| 4,927,138 | A | 5/1990 | Ferrari |
| 4,928,546 | A | 5/1990 | Walters |
| 4,928,957 | A | 5/1990 | Lanier et al. |
| 4,928,961 | A | 5/1990 | Madden |
| 4,930,768 | A | 6/1990 | Lapcevic |
| 4,930,769 | A | 6/1990 | Nenoff |
| 4,930,770 | A | 6/1990 | Baker |
| 4,934,690 | A | 6/1990 | Bull |
| 4,934,692 | A | 6/1990 | Owens |
| 4,938,473 | A | 7/1990 | Lee |
| 4,940,233 | A | 7/1990 | Bull |
| 4,941,652 | A | 7/1990 | Nagano et al. |
| 4,941,673 | A | 7/1990 | Bennett |
| 4,944,511 | A | 7/1990 | Francis |
| 4,944,518 | A | 7/1990 | Flynn |
| 4,948,121 | A | 8/1990 | Haaheim et al. |
| 4,948,123 | A | 8/1990 | Schook |
| 4,949,951 | A | 8/1990 | Deola |
| 4,949,954 | A | 8/1990 | Hix |
| 4,949,958 | A | 8/1990 | Richey |
| 4,949,959 | A | 8/1990 | Stevens |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Almes et al. |
| 4,958,832 | A | 9/1990 | Kim |
| 4,960,276 | A | 10/1990 | Feuer et al. |
| 4,964,632 | A | 10/1990 | Rockwell |
| 4,968,028 | A | 11/1990 | Wehrell |
| 4,971,305 | A | 11/1990 | Rennex |
| 4,971,316 | A | 11/1990 | Dalebout et al. |
| 4,973,050 | A | 11/1990 | Santoro |
| 4,974,831 | A | 12/1990 | Dunham |
| 4,974,832 | A | 12/1990 | Dalebout |
| 4,974,836 | A | 12/1990 | Hirsch |
| 4,974,838 | A | 12/1990 | Sollenberger |
| 4,976,424 | A | 12/1990 | Sargeant et al. |
| 4,976,428 | A | 12/1990 | Ghazi |
| 4,976,435 | A | 12/1990 | Shatford |
| 4,978,122 | A | 12/1990 | Dibowski |
| 4,982,955 | A | 1/1991 | Heasley |
| 4,984,810 | A | 1/1991 | Stearns et al. |
| 4,986,261 | A | 1/1991 | Iams et al. |
| 4,986,689 | A | 1/1991 | Drutchas |
| 4,989,860 | A | 2/1991 | Iams et al. |
| 4,990,838 | A | 2/1991 | Kawato et al. |
| 4,992,190 | A | 2/1991 | Shtarkman |
| 4,995,777 | A | 2/1991 | Warmington |
| 4,998,723 | A | 3/1991 | Santoro |
| 4,998,725 | A | 3/1991 | Watterson et al. |
| 5,000,440 | A | 3/1991 | Lynch |
| 5,000,442 | A | 3/1991 | Dalebout et al. |
| 5,000,446 | A | 3/1991 | Sarno |
| 5,001,632 | A | 3/1991 | Hall-Tipping |
| 5,002,271 | A | 3/1991 | Gonzales |
| 5,004,224 | A | 4/1991 | Wang |
| 5,005,832 | A | 4/1991 | Van Der Hoeven |
| 5,007,630 | A | 4/1991 | Real et al. |
| 5,007,631 | A | 4/1991 | Wang |
| 5,011,139 | A | 4/1991 | Towley, III |
| 5,011,142 | A | 4/1991 | Eckler |
| 5,013,031 | A | 5/1991 | Bull |
| 5,015,926 | A | 5/1991 | Casler |
| 5,016,870 | A | 5/1991 | Bulloch et al. |
| 5,018,725 | A | 5/1991 | Cook |
| 5,020,793 | A | 6/1991 | Loane |
| 5,022,377 | A | 6/1991 | Stevens |

(56) References Cited

U.S. PATENT DOCUMENTS 5,024,441 A 6/1991 Rousseau
5,026,049 A 6/1991 Goodman
5,027,303 A 6/1991 Witte
5,029,801 A 7/1991 Dalebout et al.
5,029,848 A 7/1991 Sleamaker
5,029,849 A 7/1991 Nurkowski
5,029,850 A 7/1991 Van Straaten
5,031,455 A 7/1991 Cline
5,031,901 A 7/1991 Saarinen
5,031,905 A 7/1991 Walsh
5,032,048 A 7/1991 Walton et al.
5,033,740 A 7/1991 Schwartz
5,034,576 A 7/1991 Dalebout et al.
RE33,662 E 8/1991 Blair et al.
5,037,084 A 8/1991 Flor
5,037,089 A 8/1991 Spagnuolo
5,037,090 A 8/1991 Fitzpatrick
5,039,088 A 8/1991 Shifferaw
5,039,089 A 8/1991 Lapcevic
5,039,091 A 8/1991 Johnson
5,040,785 A 8/1991 Charnitski
5,040,787 A 8/1991 Brotman
5,040,788 A 8/1991 Randall
5,042,704 A 8/1991 Izzo
5,042,799 A 8/1991 Stanley
5,044,629 A 9/1991 Ryan
5,044,631 A 9/1991 Jones
5,044,632 A 9/1991 Jones
5,046,382 A 9/1991 Steinberg
5,046,722 A 9/1991 Antoon
5,048,823 A 9/1991 Bean
5,048,825 A 9/1991 Kelly
5,048,826 A 9/1991 Ryan
5,050,872 A 9/1991 Farenholtz
5,050,873 A 9/1991 Jones
5,051,638 A 9/1991 Pyles
5,052,684 A 10/1991 Kosuge et al.
5,054,770 A 10/1991 Bull
5,056,777 A 10/1991 Capjon et al.
5,058,881 A 10/1991 Measom
5,058,882 A 10/1991 Dalebout et al.
5,058,884 A 10/1991 Fuller, Sr.
5,058,888 A 10/1991 Walker et al.
5,062,626 A 11/1991 Dalebout et al.
5,062,627 A 11/1991 Bingham
5,062,629 A 11/1991 Vaughan
5,062,630 A 11/1991 Nelson
5,062,631 A 11/1991 Dau et al.
5,062,632 A 11/1991 Dalebout et al.
5,062,633 A 11/1991 Engel et al.
5,064,191 A 11/1991 Johnson
5,066,000 A 11/1991 Dolan
5,067,710 A 11/1991 Watterson et al.
5,071,115 A 12/1991 Welch
5,071,119 A 12/1991 Johnson
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,085,430 A 2/1992 Habing
5,087,047 A 2/1992 McConnell
5,088,729 A 2/1992 Dalebout
5,090,694 A 2/1992 Pauls et al.
5,094,249 A 3/1992 Marras et al.
5,094,447 A 3/1992 Wang
5,094,449 A 3/1992 Stearns
5,096,225 A 3/1992 Osawa
5,100,129 A 3/1992 Porter
5,102,121 A 4/1992 Solow et al.
5,102,122 A 4/1992 Piane, Jr.
5,102,124 A 4/1992 Diodati
5,102,380 A 4/1992 Jacobson et al.
5,104,119 A 4/1992 Lynch
5,104,120 A 4/1992 Watterson et al.
5,106,079 A 4/1992 Escobedo
5,108,090 A 4/1992 Reed
5,108,093 A 4/1992 Watterson
5,109,778 A 5/1992 Berkowitz et al.
5,110,117 A 5/1992 Fisher et al.
5,110,121 A 5/1992 Foster
5,112,045 A 5/1992 Mason et al.
5,112,287 A 5/1992 Brewer
5,114,388 A 5/1992 Trulaske
5,114,391 A 5/1992 Pitzen et al.
5,116,297 A 5/1992 Stonecipher
5,120,289 A 6/1992 Yu
5,123,629 A 6/1992 Takeuchi
5,123,885 A 6/1992 Shields
5,123,886 A 6/1992 Cook
5,125,647 A 6/1992 Smith
5,125,884 A 6/1992 Weber et al.
5,129,872 A 7/1992 Dalton et al.
5,131,895 A 7/1992 Rogers, Jr.
5,131,898 A 7/1992 Panagos
5,135,216 A 8/1992 Bingham et al.
5,135,445 A 8/1992 Christensen
5,135,449 A 8/1992 Jones
5,135,453 A 8/1992 Sollenberger
5,135,458 A 8/1992 Huang
5,135,459 A 8/1992 Perry, Jr.
5,137,272 A 8/1992 Wilkinson
5,137,501 A 8/1992 Mertesdorf
5,138,730 A 8/1992 Masuda
5,141,478 A 8/1992 Upper
5,141,480 A 8/1992 Lennox et al.
5,141,483 A 8/1992 Smith
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,151,071 A 9/1992 Jain et al.
5,156,650 A 10/1992 Bals
5,158,518 A 10/1992 Pizzuto
5,158,520 A 10/1992 Lemke et al.
5,160,305 A 11/1992 Lin
5,162,029 A 11/1992 Schine
5,163,885 A 11/1992 Wanzer et al.
5,167,159 A 12/1992 Lucking
5,167,597 A 12/1992 David
5,167,850 A 12/1992 Shtarkman
5,169,362 A 12/1992 Schwartz
5,169,363 A 12/1992 Campanaro
5,171,196 A 12/1992 Lynch
5,176,601 A 1/1993 Reynolds
5,176,602 A 1/1993 Roberts
5,178,590 A 1/1993 Stephens
5,178,593 A 1/1993 Roberts
5,178,599 A 1/1993 Scott
5,180,352 A 1/1993 Sreter
5,181,894 A 1/1993 Shieng
5,184,295 A 2/1993 Mann
5,184,988 A 2/1993 Dunham
5,184,991 A 2/1993 Brangi
5,184,994 A 2/1993 Morris
5,186,697 A 2/1993 Rennex
5,190,509 A 3/1993 Davison, Jr.
5,190,513 A 3/1993 Habing et al.
5,192,255 A 3/1993 Dalebout et al.
5,192,257 A 3/1993 Panasewicz
5,192,258 A 3/1993 Keller
5,194,059 A 3/1993 Wu
5,195,781 A 3/1993 Osawa
5,195,935 A 3/1993 Fencel
5,195,937 A 3/1993 Engel et al.
5,199,931 A 4/1993 Easley et al.
5,199,934 A 4/1993 Lin
5,199,935 A 4/1993 Gibson et al.
5,201,694 A 4/1993 Zappel

(56) References Cited

U.S. PATENT DOCUMENTS

| | | | |
|---|---|---|---|
| 5,201,772 | A | 4/1993 | Maxwell |
| 5,203,126 | A | 4/1993 | Sorenson et al. |
| 5,203,229 | A | 4/1993 | Chen |
| 5,203,800 | A | 4/1993 | Meredith |
| 5,203,826 | A | 4/1993 | Dalebout |
| 5,205,798 | A | 4/1993 | Lekhtman |
| 5,205,800 | A | 4/1993 | Grant |
| 5,205,802 | A | 4/1993 | Swisher |
| 5,207,489 | A | 5/1993 | Miller |
| 5,207,621 | A | 5/1993 | Koch et al. |
| 5,207,622 | A | 5/1993 | Wilkinson et al. |
| 5,207,625 | A | 5/1993 | White |
| 5,207,628 | A | 5/1993 | Graham |
| 5,209,223 | A | 5/1993 | McGorry et al. |
| 5,209,482 | A | 5/1993 | Hopfer |
| 5,209,715 | A | 5/1993 | Walker et al. |
| 5,211,614 | A | 5/1993 | Henes |
| 5,211,617 | A | 5/1993 | Millen |
| 5,215,510 | A | 6/1993 | Baran |
| 5,217,422 | A | 6/1993 | Domzalski |
| 5,221,240 | A | 6/1993 | Mann |
| 5,221,245 | A | 6/1993 | Yeh |
| 5,222,928 | A | 6/1993 | Yacullo |
| 5,224,909 | A | 7/1993 | Hamilton |
| 5,226,866 | A | 7/1993 | Engel et al. |
| 5,226,868 | A | 7/1993 | Montgomery |
| 5,230,680 | A | 7/1993 | Wu |
| 5,231,752 | A | 8/1993 | Hereford |
| 5,232,422 | A | 8/1993 | Bishop, Jr. |
| 5,234,392 | A | 8/1993 | Clark |
| 5,234,395 | A | 8/1993 | Miller et al. |
| 5,236,406 | A | 8/1993 | Webber |
| 5,240,417 | A | 8/1993 | Smithson et al. |
| 5,242,339 | A | 9/1993 | Thornton |
| 5,242,340 | A | 9/1993 | Jerome |
| 5,242,342 | A | 9/1993 | Silverman |
| 5,242,343 | A | 9/1993 | Miller |
| 5,242,344 | A | 9/1993 | Hundley |
| 5,242,345 | A | 9/1993 | Mitchell |
| 5,242,347 | A | 9/1993 | Keeton |
| 5,242,348 | A | 9/1993 | Bates |
| 5,242,353 | A | 9/1993 | Cole et al. |
| 5,244,444 | A | 9/1993 | Wostry |
| 5,247,853 | A | 9/1993 | Dalebout |
| 5,250,012 | A | 10/1993 | Whitcomb, Jr. |
| 5,250,013 | A | 10/1993 | Brangi |
| 5,254,065 | A | 10/1993 | Pollock |
| 5,254,066 | A | 10/1993 | Brown et al. |
| 5,254,067 | A | 10/1993 | Habing et al. |
| 5,256,117 | A | 10/1993 | Potts et al. |
| 5,256,118 | A | 10/1993 | Chen |
| 5,256,121 | A | 10/1993 | Brotman |
| 5,256,126 | A | 10/1993 | Grotstein |
| 5,257,701 | A | 11/1993 | Edelson |
| 5,257,964 | A | 11/1993 | Petters |
| 5,261,864 | A | 11/1993 | Fitzpatrick |
| 5,261,865 | A | 11/1993 | Trainor |
| 5,263,913 | A | 11/1993 | Boren |
| 5,263,915 | A | 11/1993 | Habing |
| 5,263,916 | A | 11/1993 | Bobich |
| 5,267,929 | A | 12/1993 | Chen |
| 5,267,930 | A | 12/1993 | Henes |
| 5,269,736 | A | 12/1993 | Roberts |
| 5,269,737 | A | 12/1993 | Sobotka |
| 5,269,738 | A | 12/1993 | Boren |
| 5,273,285 | A | 12/1993 | Long |
| 5,273,505 | A | 12/1993 | Jones |
| 5,277,678 | A | 1/1994 | Friedebach et al. |
| 5,277,683 | A | 1/1994 | Wilkins |
| 5,277,684 | A | 1/1994 | Harris |
| 5,279,528 | A | 1/1994 | Dalebout et al. |
| 5,279,529 | A | 1/1994 | Eschenbach |
| 5,279,531 | A | 1/1994 | Jen Huey |
| 5,280,936 | A | 1/1994 | Schmidlin |
| 5,281,193 | A | 1/1994 | Colbo, Jr. |
| 5,282,776 | A | 2/1994 | Dalebout |
| 5,284,461 | A | 2/1994 | Wilkinson et al. |
| 5,284,463 | A | 2/1994 | Shields |
| 5,284,464 | A | 2/1994 | Lee, III et al. |
| 5,286,243 | A | 2/1994 | Lapcevic |
| 5,290,205 | A | 3/1994 | Densmore et al. |
| 5,290,211 | A | 3/1994 | Stearns |
| 5,290,214 | A | 3/1994 | Chen |
| 5,292,293 | A | 3/1994 | Schumacher |
| 5,292,297 | A | 3/1994 | Hsu |
| 5,295,928 | A | 3/1994 | Rennex |
| 5,295,935 | A | 3/1994 | Wang |
| 5,298,002 | A | 3/1994 | Lin |
| 5,299,992 | A | 4/1994 | Wilkinson |
| 5,299,993 | A | 4/1994 | Habing |
| 5,299,997 | A | 4/1994 | Chen |
| 5,302,161 | A | 4/1994 | Loubert et al. |
| 5,302,162 | A | 4/1994 | Pasero |
| 5,303,885 | A | 4/1994 | Wade |
| 5,306,218 | A | 4/1994 | Huang Chen |
| 5,306,221 | A | 4/1994 | Itaru |
| 5,308,075 | A | 5/1994 | Theriault |
| 5,308,234 | A | 5/1994 | Nicke et al. |
| 5,308,304 | A | 5/1994 | Habing |
| 5,310,392 | A | 5/1994 | Lo |
| 5,310,394 | A | 5/1994 | Kallios |
| 5,313,852 | A | 5/1994 | Arena |
| 5,314,391 | A | 5/1994 | Potash et al. |
| 5,314,392 | A | 5/1994 | Hawkins et al. |
| 5,314,394 | A | 5/1994 | Ronan |
| 5,316,534 | A | 5/1994 | Dalebout et al. |
| 5,318,487 | A | 6/1994 | Golen et al. |
| 5,318,490 | A | 6/1994 | Henderson et al. |
| 5,318,495 | A | 6/1994 | Malynowsky |
| 5,320,343 | A | 6/1994 | McKinney |
| 5,320,588 | A | 6/1994 | Wanzer et al. |
| 5,320,591 | A | 6/1994 | Harmon et al. |
| 5,322,489 | A | 6/1994 | Webb et al. |
| 5,324,242 | A | 6/1994 | Lo |
| 5,328,410 | A | 7/1994 | Amburgey et al. |
| 5,328,420 | A | 7/1994 | Allen |
| 5,328,422 | A | 7/1994 | Nichols |
| 5,328,428 | A | 7/1994 | Huang |
| 5,328,429 | A | 7/1994 | Potash et al. |
| 5,328,430 | A | 7/1994 | Vittone |
| 5,330,401 | A | 7/1994 | Walstead |
| 5,330,402 | A | 7/1994 | Johnson |
| 5,330,404 | A | 7/1994 | Lopeteguy et al. |
| 5,330,405 | A | 7/1994 | Habing et al. |
| 5,330,408 | A | 7/1994 | Westmoreland, Jr. |
| 5,334,120 | A | 8/1994 | Rasmussen |
| 5,336,142 | A | 8/1994 | Dalebout et al. |
| 5,336,143 | A | 8/1994 | Wu |
| 5,336,144 | A | 8/1994 | Rodden |
| 5,336,145 | A | 8/1994 | Keiser |
| 5,336,146 | A | 8/1994 | Piaget et al. |
| 5,336,148 | A | 8/1994 | Ish, III |
| 5,336,151 | A | 8/1994 | Van Ballegooie |
| 5,338,274 | A | 8/1994 | Jones |
| 5,338,277 | A | 8/1994 | Yang |
| 5,342,261 | A | 8/1994 | Johnston |
| 5,342,264 | A | 8/1994 | Gordon |
| 5,342,269 | A | 8/1994 | Huang |
| 5,342,271 | A | 8/1994 | Long |
| RE34,728 | E | 9/1994 | Hall-Tipping |
| 5,344,372 | A | 9/1994 | Hung |
| 5,344,374 | A | 9/1994 | Telle |
| 5,346,447 | A | 9/1994 | Stearns |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |

(56) References Cited

U.S. PATENT DOCUMENTS

| | | | |
|---|---|---|---|
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,358,461 | A | 10/1994 | Bailey, Jr. |
| 5,358,462 | A | 10/1994 | Calderone |
| 5,359,986 | A | 11/1994 | Magrath, III et al. |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,364,060 | A | 11/1994 | Donovan et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,374,230 | A | 12/1994 | Bonnaime |
| 5,376,053 | A | 12/1994 | Ponder |
| 5,378,212 | A | 1/1995 | Pin-Kuo |
| 5,378,216 | A | 1/1995 | Ish, III et al. |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,387,169 | A | 2/1995 | Wang |
| 5,387,170 | A | 2/1995 | Rawls et al. |
| 5,387,171 | A | 2/1995 | Casey et al. |
| 5,391,132 | A | 2/1995 | Greenwald |
| 5,392,476 | A | 2/1995 | Williams |
| 5,394,922 | A | 3/1995 | Colson et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,403 | A | 4/1995 | Coleman |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,409,435 | A | 4/1995 | Daniels |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,634 | A | 5/1995 | Habing |
| 5,417,643 | A | 5/1995 | Taylor |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,798 | A | 6/1995 | Bond et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,589 | A | 8/1995 | Habing |
| 5,439,225 | A | 8/1995 | Gvoich et al. |
| 5,441,467 | A | 8/1995 | Stevens |
| 5,441,468 | A | 8/1995 | Deckers et al. |
| 5,443,435 | A | 8/1995 | Wilkinson |
| 5,447,480 | A | 9/1995 | Fulks |
| 5,449,332 | A | 9/1995 | Hervig |
| 5,449,334 | A | 9/1995 | Kingsbury |
| 5,451,191 | A | 9/1995 | Beenken |
| 5,453,066 | A | 9/1995 | Richter, Jr. |
| 5,454,772 | A | 10/1995 | Rodden |
| 5,454,773 | A | 10/1995 | Blanchard et al. |
| 5,456,644 | A | 10/1995 | Hecox et al. |
| 5,456,648 | A | 10/1995 | Edinburg |
| 5,458,553 | A | 10/1995 | Wu |
| 5,460,586 | A | 10/1995 | Wilkinson |
| 5,462,503 | A | 10/1995 | Benjamin et al. |
| 5,462,504 | A | 10/1995 | Trulaske et al. |
| 5,464,378 | A | 11/1995 | Lee |
| 5,466,200 | A | 11/1995 | Ulrich et al. |
| 5,466,203 | A | 11/1995 | Chen |
| 5,467,874 | A | 11/1995 | Whitaker |
| 5,468,205 | A | 11/1995 | McFall et al. |
| 5,470,298 | A | 11/1995 | Curtis |
| 5,471,405 | A | 11/1995 | Marsh |
| 5,472,397 | A | 12/1995 | Ammoscato et al. |
| 5,472,399 | A | 12/1995 | Szekely |
| 5,474,087 | A | 12/1995 | Nashner |
| 5,474,510 | A | 12/1995 | Chen |
| 5,476,428 | A | 12/1995 | Potash et al. |
| 5,476,430 | A | 12/1995 | Lee et al. |
| 5,478,298 | A | 12/1995 | Chen |
| 5,480,212 | A | 1/1996 | Marconet |
| 5,484,358 | A | 1/1996 | Wang et al. |
| 5,484,362 | A | 1/1996 | Skowronski et al. |
| 5,484,365 | A | 1/1996 | Jones et al. |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,518 | A | 2/1996 | Measom |
| 5,492,520 | A | 2/1996 | Brown |
| 5,493,127 | A | 2/1996 | Lloyd et al. |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,496,244 | A | 3/1996 | Caruthers |
| 5,498,222 | A | 3/1996 | Hur |
| 5,498,223 | A | 3/1996 | Iams et al. |
| 5,499,956 | A | 3/1996 | Habing et al. |
| 5,499,959 | A | 3/1996 | Holmes et al. |
| 5,499,961 | A | 3/1996 | Mattox |
| 5,501,647 | A | 3/1996 | Snyder |
| 5,501,656 | A | 3/1996 | Homma et al. |
| 5,503,608 | A | 4/1996 | Chang |
| 5,505,011 | A | 4/1996 | Bleimhofer |

(56) References Cited

U.S. PATENT DOCUMENTS

| | | | |
|---|---|---|---|
| 5,505,677 | A | 4/1996 | Hinds |
| 5,507,271 | A | 4/1996 | Actor |
| 5,507,710 | A | 4/1996 | Chen |
| 5,509,870 | A | 4/1996 | Lloyd |
| 5,512,025 | A | 4/1996 | Dalebout et al. |
| 5,512,029 | A | 4/1996 | Barnard |
| 5,514,053 | A | 5/1996 | Hawkins et al. |
| 5,514,059 | A | 5/1996 | Romney |
| 5,518,471 | A | 5/1996 | Hettinger et al. |
| 5,518,473 | A | 5/1996 | Miller |
| 5,518,476 | A | 5/1996 | Mcleon |
| 5,518,477 | A | 5/1996 | Simonson |
| 5,518,483 | A | 5/1996 | Oswald |
| 5,518,486 | A | 5/1996 | Sheeler |
| 5,520,599 | A | 5/1996 | Chen |
| 5,522,783 | A | 6/1996 | Gordon |
| 5,527,245 | A | 6/1996 | Dalebout et al. |
| 5,527,249 | A | 6/1996 | Harris |
| 5,527,250 | A | 6/1996 | Chen |
| 5,527,253 | A | 6/1996 | Wilkinson |
| 5,529,554 | A | 6/1996 | Eschenbach |
| 5,529,560 | A | 6/1996 | Dise |
| 5,531,658 | A | 7/1996 | L. S. C. |
| 5,533,899 | A | 7/1996 | Young |
| 5,533,948 | A | 7/1996 | Wilkinson |
| 5,533,951 | A | 7/1996 | Chang |
| 5,533,952 | A | 7/1996 | Schaber |
| 5,538,489 | A | 7/1996 | Magid |
| 5,540,642 | A | 7/1996 | Sprague |
| 5,542,892 | A | 8/1996 | Buhler |
| 5,545,112 | A | 8/1996 | Densmore et al. |
| 5,545,114 | A | 8/1996 | Gvoich |
| 5,549,052 | A | 8/1996 | Hoffman |
| 5,549,530 | A | 8/1996 | Fulks |
| 5,549,532 | A | 8/1996 | Kropp |
| 5,549,533 | A | 8/1996 | Olson et al. |
| 5,549,536 | A | 8/1996 | Clark |
| 5,551,934 | A | 9/1996 | Binette |
| 5,551,937 | A | 9/1996 | Kwo |
| 5,554,033 | A | 9/1996 | Bizzi et al. |
| 5,554,083 | A | 9/1996 | Chen |
| 5,554,085 | A | 9/1996 | Dalebout |
| 5,554,086 | A | 9/1996 | Habing et al. |
| 5,556,362 | A | 9/1996 | Whipps |
| 5,556,369 | A | 9/1996 | Roberts |
| 5,558,608 | A | 9/1996 | Hall |
| 5,562,572 | A | 10/1996 | Carmein |
| 5,562,574 | A | 10/1996 | Miller |
| 5,562,577 | A | 10/1996 | Nichols, Sr. et al. |
| 5,563,487 | A | 10/1996 | Davis |
| 5,568,993 | A | 10/1996 | Potzick |
| 5,569,128 | A | 10/1996 | Dalebout |
| 5,569,133 | A | 10/1996 | Vittone |
| 5,569,138 | A | 10/1996 | Wang et al. |
| 5,571,064 | A | 11/1996 | Holm |
| 5,573,485 | A | 11/1996 | Geschwender |
| 5,575,740 | A | 11/1996 | Piaget |
| 5,577,985 | A | 11/1996 | Miller |
| 5,577,987 | A | 11/1996 | Brown |
| 5,580,249 | A | 12/1996 | Jacobsen et al. |
| 5,580,340 | A | 12/1996 | Yu |
| 5,580,341 | A | 12/1996 | Simonson |
| 5,582,563 | A | 12/1996 | Fan |
| 5,582,565 | A | 12/1996 | Soria |
| 5,584,700 | A | 12/1996 | Feldman et al. |
| 5,584,779 | A | 12/1996 | Knecht |
| 5,586,736 | A | 12/1996 | Mollet |
| 5,586,811 | A | 12/1996 | Tornero |
| 5,586,962 | A | 12/1996 | Hallmark |
| 5,588,938 | A | 12/1996 | Schneider et al. |
| 5,588,942 | A | 12/1996 | Dillard |
| 5,590,893 | A | 1/1997 | Robinson et al. |
| 5,591,104 | A | 1/1997 | Andrus et al. |
| 5,591,106 | A | 1/1997 | Dalebout et al. |
| 5,591,107 | A | 1/1997 | Rodgers, Jr. |
| 5,591,908 | A | 1/1997 | Reid |
| 5,593,372 | A | 1/1997 | Rodgers, Jr. |
| 5,593,380 | A | 1/1997 | Bittikofer |
| 5,595,545 | A | 1/1997 | O'Brien |
| 5,595,556 | A | 1/1997 | Dalebout et al. |
| 5,595,559 | A | 1/1997 | Viel |
| 5,597,362 | A | 1/1997 | Lee |
| 5,597,375 | A | 1/1997 | Simonson |
| 5,599,261 | A | 2/1997 | Easley et al. |
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |
| 5,618,250 | A | 4/1997 | Butz |
| 5,620,402 | A | 4/1997 | Simonson |
| 5,620,403 | A | 4/1997 | Lundin |
| 5,622,527 | A | 4/1997 | Watterson et al. |
| 5,624,353 | A | 4/1997 | Naidus |
| 5,624,360 | A | 4/1997 | Wilkins |
| 5,624,361 | A | 4/1997 | Lai |
| 5,625,577 | A | 4/1997 | Kunii et al. |
| 5,626,539 | A | 5/1997 | Piaget |
| 5,626,546 | A | 5/1997 | Little |
| 5,626,548 | A | 5/1997 | Coyle |
| 5,628,715 | A | 5/1997 | Simonson |
| 5,628,716 | A | 5/1997 | Brice |
| 5,630,566 | A | 5/1997 | Case |
| 5,632,209 | A | 5/1997 | Sakakibara |
| 5,632,711 | A | 5/1997 | Hwang |
| 5,634,870 | A | 6/1997 | Wilkinson |
| 5,637,064 | A | 6/1997 | Olson et al. |
| 5,643,142 | A | 7/1997 | Salerno et al. |
| 5,643,144 | A | 7/1997 | Trulaske |
| 5,643,147 | A | 7/1997 | Huang |
| 5,643,152 | A | 7/1997 | Simonson |
| 5,643,153 | A | 7/1997 | Nylen et al. |
| 5,643,157 | A | 7/1997 | Seliber |
| 5,643,162 | A | 7/1997 | Landers et al. |
| 5,645,509 | A | 7/1997 | Brewer et al. |
| 5,645,510 | A | 7/1997 | Wilkinson |
| 5,645,914 | A | 7/1997 | Horowitz |
| 5,649,882 | A | 7/1997 | Parikh et al. |
| 5,650,709 | A | 7/1997 | Rotunda et al. |
| 5,653,662 | A | 8/1997 | Rodgers, Jr. |
| 5,653,669 | A | 8/1997 | Cheng |
| 5,655,997 | A | 8/1997 | Greenberg et al. |
| 5,656,003 | A | 8/1997 | Robinson et al. |
| 5,658,227 | A | 8/1997 | Stearns |
| 5,662,557 | A | 9/1997 | Watterson et al. |
| 5,665,031 | A | 9/1997 | Hsieh |
| 5,665,033 | A | 9/1997 | Palmer |
| 5,665,041 | A | 9/1997 | Hsieh |
| 5,667,459 | A | 9/1997 | Su |
| 5,667,465 | A | 9/1997 | McCollum et al. |
| 5,669,455 | A | 9/1997 | Dietrich |
| 5,669,833 | A | 9/1997 | Stone |
| 5,669,857 | A | 9/1997 | Watterson et al. |
| 5,669,862 | A | 9/1997 | Sayman |
| 5,669,865 | A | 9/1997 | Gordon |
| 5,672,140 | A | 9/1997 | Watterson et al. |
| 5,674,156 | A | 10/1997 | Watterson et al. |
| 5,674,167 | A | 10/1997 | Piaget et al. |
| 5,674,453 | A | 10/1997 | Watterson et al. |
| 5,676,624 | A | 10/1997 | Watterson et al. |
| 5,679,047 | A | 10/1997 | Engel |
| 5,679,100 | A | 10/1997 | Charnitski |
| 5,679,101 | A | 10/1997 | Magid |

(56) References Cited

U.S. PATENT DOCUMENTS

| | | | |
|---|---|---|---|
| 5,681,247 | A | 10/1997 | Webber |
| 5,681,249 | A | 10/1997 | Endelman |
| 5,683,332 | A | 11/1997 | Watterson et al. |
| 5,683,334 | A | 11/1997 | Webber |
| 5,685,804 | A | 11/1997 | Whan-Tong et al. |
| 5,685,810 | A | 11/1997 | Chung |
| 5,688,196 | A | 11/1997 | O'neil |
| 5,688,209 | A | 11/1997 | Trulaske et al. |
| 5,688,210 | A | 11/1997 | Chou |
| 5,688,212 | A | 11/1997 | Walker |
| 5,688,216 | A | 11/1997 | Mauriello |
| 5,690,582 | A | 11/1997 | Ulrich et al. |
| 5,690,587 | A | 11/1997 | Gruenangerl |
| 5,690,589 | A | 11/1997 | Rodgers, Jr. |
| 5,692,994 | A | 12/1997 | Eschenbach |
| 5,692,996 | A | 12/1997 | Widerman |
| 5,692,997 | A | 12/1997 | Stearns |
| 5,693,004 | A | 12/1997 | Carlson et al. |
| 5,695,434 | A | 12/1997 | Dalebout et al. |
| 5,695,436 | A | 12/1997 | Huang |
| 5,702,325 | A | 12/1997 | Watterson et al. |
| 5,704,879 | A | 1/1998 | Watterson et al. |
| 5,707,168 | A | 1/1998 | Sharon |
| 5,707,319 | A | 1/1998 | Riley |
| 5,708,355 | A | 1/1998 | Schrey |
| 5,709,428 | A | 1/1998 | Hugghins |
| 5,709,632 | A | 1/1998 | Socwell |
| 5,709,633 | A | 1/1998 | Sokol |
| 5,709,634 | A | 1/1998 | Pointer |
| 5,709,636 | A | 1/1998 | Vallone |
| 5,709,638 | A | 1/1998 | Mackert et al. |
| 5,711,745 | A | 1/1998 | Yang |
| 5,711,746 | A | 1/1998 | Carlson |
| 5,711,749 | A | 1/1998 | Miller |
| 5,713,549 | A | 2/1998 | Shieh |
| 5,713,821 | A | 2/1998 | Nissen |
| 5,716,308 | A | 2/1998 | Lee |
| 5,718,657 | A | 2/1998 | Dalebout et al. |
| 5,718,660 | A | 2/1998 | Chen |
| 5,720,200 | A | 2/1998 | Anderson et al. |
| 5,720,474 | A | 2/1998 | Sugiyama |
| 5,720,702 | A | 2/1998 | Lee |
| 5,722,917 | A | 3/1998 | Olschansky et al. |
| 5,722,920 | A | 3/1998 | Bauer |
| 5,722,921 | A | 3/1998 | Simonson |
| 5,722,922 | A | 3/1998 | Watterson et al. |
| 5,725,459 | A | 3/1998 | Rexach |
| 5,725,463 | A | 3/1998 | Colonello et al. |
| 5,730,236 | A | 3/1998 | Miller et al. |
| 5,733,227 | A | 3/1998 | Lee |
| 5,733,228 | A | 3/1998 | Stevens |
| 5,733,229 | A | 3/1998 | Dalebout et al. |
| 5,733,232 | A | 3/1998 | Hsu |
| 5,735,586 | A | 4/1998 | Cheng |
| 5,735,773 | A | 4/1998 | Vittone |
| 5,735,776 | A | 4/1998 | Swezey |
| 5,738,612 | A | 4/1998 | Tsuda |
| 5,738,616 | A | 4/1998 | Robertson |
| 5,741,205 | A | 4/1998 | Doll et al. |
| 5,743,193 | A | 4/1998 | Kakuta et al. |
| 5,743,832 | A | 4/1998 | Sands et al. |
| 5,743,833 | A | 4/1998 | Watterson et al. |
| 5,743,835 | A | 4/1998 | Trotter |
| 5,746,682 | A | 5/1998 | Hung |
| 5,746,687 | A | 5/1998 | Vial et al. |
| 5,746,688 | A | 5/1998 | Prager |
| 5,749,372 | A | 5/1998 | Allen |
| 5,749,668 | A | 5/1998 | Mcilvain |
| 5,749,787 | A | 5/1998 | Jank |
| 5,749,807 | A | 5/1998 | Webb |
| 5,749,809 | A | 5/1998 | Lin |
| 5,749,813 | A | 5/1998 | Domzalski |
| 5,752,879 | A | 5/1998 | Berdut |
| 5,752,897 | A | 5/1998 | Skowronski et al. |
| 5,752,901 | A | 5/1998 | Lee |
| 5,755,642 | A | 5/1998 | Miller |
| 5,755,645 | A | 5/1998 | Miller et al. |
| 5,755,646 | A | 5/1998 | Chu |
| 5,755,651 | A | 5/1998 | Homyonfer |
| 5,755,823 | A | 5/1998 | Cleary |
| 5,759,136 | A | 6/1998 | Chen |
| 5,759,139 | A | 6/1998 | Wright |
| 5,760,353 | A | 6/1998 | Rapp |
| 5,761,831 | A | 6/1998 | Cho |
| 5,762,584 | A | 6/1998 | Daniels |
| 5,762,587 | A | 6/1998 | Dalebout et al. |
| 5,762,588 | A | 6/1998 | Chen |
| 5,766,118 | A | 6/1998 | Conner |
| 5,769,759 | A | 6/1998 | Alter |
| 5,769,762 | A | 6/1998 | Towley, III et al. |
| 5,771,152 | A | 6/1998 | Crompton et al. |
| 5,772,522 | A | 6/1998 | Nesbit |
| 5,772,558 | A | 6/1998 | Rodgers, Jr. |
| 5,772,560 | A | 6/1998 | Watterson et al. |
| 5,772,563 | A | 6/1998 | Lin |
| 5,776,040 | A | 7/1998 | Webb et al. |
| 5,776,582 | A | 7/1998 | Needham |
| 5,779,599 | A | 7/1998 | Chen |
| 5,779,604 | A | 7/1998 | Towley, III et al. |
| 5,779,607 | A | 7/1998 | Harris |
| 5,782,639 | A | 7/1998 | Beal |
| 5,782,723 | A | 7/1998 | Kuo |
| 5,785,630 | A | 7/1998 | Bobick et al. |
| 5,785,632 | A | 7/1998 | Greenberg et al. |
| 5,788,609 | A | 8/1998 | Miller |
| 5,788,610 | A | 8/1998 | Eschenbach |
| 5,788,611 | A | 8/1998 | Kuo |
| 5,788,616 | A | 8/1998 | Polidi |
| 5,788,618 | A | 8/1998 | Joutras |
| 5,792,027 | A | 8/1998 | Gvoich |
| 5,792,028 | A | 8/1998 | Jarvie |
| 5,792,029 | A | 8/1998 | Gordon |
| 5,792,031 | A | 8/1998 | Alton |
| 5,792,034 | A | 8/1998 | Kozlovsky |
| 5,795,270 | A | 8/1998 | Woods et al. |
| 5,795,274 | A | 8/1998 | Kasbohm |
| 5,797,578 | A | 8/1998 | Graffeo |
| 5,797,639 | A | 8/1998 | Zorzenon |
| 5,800,310 | A | 9/1998 | Jones |
| 5,800,321 | A | 9/1998 | Webber |
| 5,800,323 | A | 9/1998 | Ansel |
| 5,803,874 | A | 9/1998 | Wilkinson |
| 5,803,877 | A | 9/1998 | Franey |
| 5,803,882 | A | 9/1998 | Habing et al. |
| 5,807,210 | A | 9/1998 | Devlin |
| 5,807,214 | A | 9/1998 | Riazi |
| 5,810,696 | A | 9/1998 | Webb |
| 5,810,697 | A | 9/1998 | Joiner |
| 5,810,698 | A | 9/1998 | Hullett et al. |
| 5,810,702 | A | 9/1998 | Wilkinson |
| 5,813,142 | A | 9/1998 | Demon |
| 5,813,947 | A | 9/1998 | Densmore |
| 5,813,953 | A | 9/1998 | Whipple |
| 5,816,372 | A | 10/1998 | Carlson et al. |
| 5,816,981 | A | 10/1998 | Hung |
| 5,816,983 | A | 10/1998 | Dawes et al. |
| 5,820,478 | A | 10/1998 | Wood et al. |
| 5,820,529 | A | 10/1998 | Weintraub |
| 5,820,532 | A | 10/1998 | Oliver |
| 5,823,618 | A | 10/1998 | Fox et al. |
| 5,825,983 | A | 10/1998 | Park et al. |
| 5,827,155 | A | 10/1998 | Jensen et al. |
| 5,827,158 | A | 10/1998 | Drecksel |
| 5,829,771 | A | 11/1998 | Hsu |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,582 | A | 11/1998 | Chen |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,836,854 | A | 11/1998 | Kuo |

(56) References Cited

U.S. PATENT DOCUMENTS

| | | | |
|---|---|---|---|
| 5,836,858 | A | 11/1998 | Sharff |
| 5,839,990 | A | 11/1998 | Virkkala |
| 5,839,993 | A | 11/1998 | Fox |
| 5,839,997 | A | 11/1998 | Roth et al. |
| 5,842,956 | A | 12/1998 | Strachan |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,942 | A | 1/1999 | Moon et al. |
| 5,857,943 | A | 1/1999 | Murray |
| 5,860,190 | A | 1/1999 | Cano |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,865,714 | A | 2/1999 | Marlowe |
| 5,868,108 | A | 2/1999 | Schmitz et al. |
| 5,868,648 | A | 2/1999 | Coody et al. |
| 5,868,653 | A | 2/1999 | Klasen |
| 5,871,421 | A | 2/1999 | Trulaske et al. |
| 5,871,424 | A | 2/1999 | Conner |
| 5,876,095 | A | 3/1999 | Johnston |
| 5,876,310 | A | 3/1999 | Mackey et al. |
| 5,876,313 | A | 3/1999 | Krull |
| 5,879,247 | A | 3/1999 | Winter et al. |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,196 | A | 3/1999 | Gvoich |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,891,004 | A | 4/1999 | Berry |
| 5,891,042 | A | 4/1999 | Sham et al. |
| 5,895,339 | A | 4/1999 | Maresh |
| 5,895,340 | A | 4/1999 | Keller |
| 5,895,342 | A | 4/1999 | Solland |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,897,467 | A | 4/1999 | Habing et al. |
| 5,897,469 | A | 4/1999 | Yalch |
| 5,897,472 | A | 4/1999 | Thulasingam |
| 5,897,474 | A | 4/1999 | Romero |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,904,638 | A | 5/1999 | Habing et al. |
| 5,906,269 | A | 5/1999 | Zabron et al. |
| 5,906,564 | A | 5/1999 | Jacobsen |
| 5,906,566 | A | 5/1999 | Whitcomb |
| 5,908,373 | A | 6/1999 | Pitre |
| 5,910,070 | A | 6/1999 | Henry et al. |
| 5,910,072 | A | 6/1999 | Rawls et al. |
| 5,910,073 | A | 6/1999 | Conner |
| 5,911,132 | A | 6/1999 | Sloane |
| 5,911,649 | A | 6/1999 | Miller |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,921,901 | A | 7/1999 | Palacios |
| 5,924,966 | A | 7/1999 | Havlovic |
| 5,925,001 | A | 7/1999 | Hoyt et al. |
| 5,927,780 | A | 7/1999 | Chandler |
| 5,928,116 | A | 7/1999 | Chiang |
| 5,931,767 | A | 8/1999 | Morales |
| 5,935,048 | A | 8/1999 | Krull |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,574 | A | 8/1999 | Webber |
| 5,938,575 | A | 8/1999 | Stearns |
| 5,940,502 | A | 8/1999 | Hirai et al. |
| 5,940,911 | A | 8/1999 | Wang |
| 5,941,800 | A | 8/1999 | Laconis |
| 5,941,803 | A | 8/1999 | Chamberlain |
| 5,941,807 | A | 8/1999 | Cassidy |
| 5,943,794 | A | 8/1999 | Gelsomini |
| 5,944,641 | A | 8/1999 | Habing |
| 5,944,642 | A | 8/1999 | Krull |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,954,106 | A | 9/1999 | Huang |
| 5,954,621 | A | 9/1999 | Joutras et al. |
| 5,957,814 | A | 9/1999 | Eschenbach |
| 5,957,819 | A | 9/1999 | Cortesi |
| 5,961,423 | A | 10/1999 | Sellers |
| 5,961,428 | A | 10/1999 | Webber |
| 5,961,430 | A | 10/1999 | Zuckerman et al. |
| 5,964,684 | A | 10/1999 | Sokol |
| 5,967,944 | A | 10/1999 | Vittone et al. |
| 5,967,948 | A | 10/1999 | Carr |
| 5,967,950 | A | 10/1999 | Hsu |
| 5,967,954 | A | 10/1999 | Habing |
| 5,967,955 | A | 10/1999 | Westfall et al. |
| 5,971,892 | A | 10/1999 | Lee |
| 5,971,895 | A | 10/1999 | Habing |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,836 | A | 11/1999 | Casali |
| 5,984,839 | A | 11/1999 | Corkum |
| 5,989,161 | A | 11/1999 | Wang et al. |
| 5,989,163 | A | 11/1999 | Rodgers, Jr. |
| 5,989,164 | A | 11/1999 | Kullman et al. |
| 5,989,165 | A | 11/1999 | Giannelli et al. |
| 5,989,166 | A | 11/1999 | Capizzo et al. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 5,998,897 | A | 12/1999 | Bosten et al. |
| 6,003,294 | A | 12/1999 | Fitzgerald et al. |
| 6,003,481 | A | 12/1999 | Pischinger et al. |
| 6,004,244 | A | 12/1999 | Simonson |
| 6,004,246 | A | 12/1999 | Sencil |
| 6,004,247 | A | 12/1999 | Webber |
| 6,006,379 | A | 12/1999 | Hensley |
| 6,007,268 | A | 12/1999 | Whittington et al. |
| 6,010,432 | A | 1/2000 | Vawter |
| 6,011,134 | A | 1/2000 | Marks et al. |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |

(56) References Cited

U.S. PATENT DOCUMENTS

| | | | |
|---|---|---|---|
| 6,015,371 | A | 1/2000 | Davitt |
| 6,017,293 | A | 1/2000 | Pfefferle |
| 6,019,403 | A | 2/2000 | Corbett |
| 6,022,300 | A | 2/2000 | Hightower |
| 6,022,302 | A | 2/2000 | McBride |
| 6,024,677 | A | 2/2000 | Siwertz |
| 6,027,429 | A | 2/2000 | Daniels |
| 6,027,430 | A | 2/2000 | Stearns et al. |
| 6,027,432 | A | 2/2000 | Cheng |
| 6,027,433 | A | 2/2000 | Flynn |
| 6,029,858 | A | 2/2000 | Srokose |
| 6,030,320 | A | 2/2000 | Stearns |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,036,625 | A | 3/2000 | Woodruff |
| 6,039,677 | A | 3/2000 | Spletzer |
| 6,039,678 | A | 3/2000 | Dawson |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,816 | A | 4/2000 | Immel |
| 6,053,844 | A | 4/2000 | Clem |
| 6,053,847 | A | 4/2000 | Stearns et al. |
| 6,053,848 | A | 4/2000 | Eschenbach |
| 6,053,853 | A | 4/2000 | Hinds |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,059,698 | A | 5/2000 | Mazor |
| 6,059,701 | A | 5/2000 | George et al. |
| 6,063,009 | A | 5/2000 | Stearns |
| 6,065,572 | A | 5/2000 | Schober et al. |
| 6,066,075 | A | 5/2000 | Poulton |
| 6,066,077 | A | 5/2000 | Horst |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,071,217 | A | 6/2000 | Barnett |
| 6,074,328 | A | 6/2000 | Johnson |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,079,915 | A | 6/2000 | Bosten et al. |
| 6,080,091 | A | 6/2000 | Habing et al. |
| 6,082,346 | A | 7/2000 | Andrews et al. |
| 6,083,144 | A | 7/2000 | Towley, III et al. |
| 6,086,520 | A | 7/2000 | Rodriquez |
| 6,086,521 | A | 7/2000 | Solland |
| 6,090,014 | A | 7/2000 | Eschenbach |
| 6,090,016 | A | 7/2000 | Kuo |
| 6,090,020 | A | 7/2000 | Webber |
| 6,095,951 | A | 8/2000 | Skowronski et al. |
| 6,095,954 | A | 8/2000 | Svanberg |
| 6,099,439 | A | 8/2000 | Ryan et al. |
| 6,099,442 | A | 8/2000 | Krull |
| 6,099,444 | A | 8/2000 | Domenge |
| 6,101,684 | A | 8/2000 | Ginocchio |
| 6,102,412 | A | 8/2000 | Staffaroni |
| 6,102,832 | A | 8/2000 | Tani |
| 6,102,836 | A | 8/2000 | Person |
| 6,102,837 | A | 8/2000 | Hubbard |
| 6,106,437 | A | 8/2000 | Brooks |
| 6,106,439 | A | 8/2000 | Boland |
| 6,110,075 | A | 8/2000 | Woodruff |
| 6,110,076 | A | 8/2000 | Hurt |
| 6,110,077 | A | 8/2000 | Yu |
| 6,110,081 | A | 8/2000 | Barrett |
| 6,112,624 | A | 9/2000 | Chen |
| 6,113,188 | A | 9/2000 | Stewart et al. |
| 6,113,323 | A | 9/2000 | Bosten et al. |
| 6,113,518 | A | 9/2000 | Maresh |
| 6,113,522 | A | 9/2000 | Montgomery |
| 6,113,564 | A | 9/2000 | McGuire |
| 6,117,049 | A | 9/2000 | Lowe |
| 6,120,421 | A | 9/2000 | Kuo |
| 6,120,424 | A | 9/2000 | Arline |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,126,577 | A | 10/2000 | Chang |
| 6,128,981 | A | 10/2000 | Bondhus et al. |
| 6,129,651 | A | 10/2000 | Denaro |
| 6,129,962 | A | 10/2000 | Quigley et al. |
| 6,132,340 | A | 10/2000 | Wang |
| 6,132,347 | A | 10/2000 | Alessandri |
| 6,135,924 | A | 10/2000 | Gibbs et al. |
| 6,135,925 | A | 10/2000 | Liu |
| 6,135,926 | A | 10/2000 | Lee |
| 6,135,927 | A | 10/2000 | Lo |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,149,556 | A | 11/2000 | Jordan |
| 6,149,558 | A | 11/2000 | Chen |
| 6,149,559 | A | 11/2000 | Mackey |
| 6,152,856 | A | 11/2000 | Studor et al. |
| 6,152,859 | A | 11/2000 | Stearns |
| 6,152,864 | A | 11/2000 | Giannelli et al. |
| 6,162,153 | A | 12/2000 | Perez, Jr. |
| 6,162,183 | A | 12/2000 | Hoover |
| 6,163,451 | A | 12/2000 | Chiu |
| 6,165,107 | A | 12/2000 | Birrell |
| 6,165,110 | A | 12/2000 | Gajda |
| 6,168,551 | B1 | 1/2001 | Mcguinness |
| 6,168,557 | B1 | 1/2001 | Liao |
| 6,171,216 | B1 | 1/2001 | Wang |
| 6,172,178 | B1 | 1/2001 | Koning et al. |
| 6,174,265 | B1 | 1/2001 | Alessandri |
| 6,174,267 | B1 | 1/2001 | Dalebout |
| 6,174,268 | B1 | 1/2001 | Novak |
| 6,175,994 | B1 | 1/2001 | Nicoletti |
| 6,176,814 | B1 | 1/2001 | Ryan et al. |
| 6,179,748 | B1 | 1/2001 | Barr |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,183,400 | B1 | 2/2001 | Pope |
| 6,183,401 | B1 | 2/2001 | Krull |
| 6,183,403 | B1 | 2/2001 | Dunn |
| 6,186,290 | B1 | 2/2001 | Carlson |
| 6,186,460 | B1 | 2/2001 | Lin |
| 6,186,926 | B1 | 2/2001 | Ellis |
| 6,186,927 | B1 | 2/2001 | Krull |
| 6,186,928 | B1 | 2/2001 | Chen |
| 6,186,929 | B1 | 2/2001 | Endelman et al. |

(56) References Cited

U.S. PATENT DOCUMENTS

| | | | |
|---|---|---|---|
| 6,189,846 | B1 | 2/2001 | Wang |
| 6,190,289 | B1 | 2/2001 | Pyles et al. |
| 6,193,635 | B1 | 2/2001 | Webber et al. |
| 6,196,952 | B1 | 3/2001 | Chen |
| 6,196,954 | B1 | 3/2001 | Chen |
| 6,199,732 | B1 | 3/2001 | Swetish |
| 6,203,473 | B1 | 3/2001 | Atwood |
| 6,203,474 | B1 | 3/2001 | Jones |
| 6,206,795 | B1 | 3/2001 | Ou |
| 6,206,804 | B1 | 3/2001 | Maresh |
| 6,210,305 | B1 | 4/2001 | Eschenbach |
| 6,213,919 | B1 | 4/2001 | Wang |
| 6,213,923 | B1 | 4/2001 | Cameron et al. |
| 6,215,870 | B1 | 4/2001 | Hirai et al. |
| 6,217,483 | B1 | 4/2001 | Kallassy |
| 6,217,487 | B1 | 4/2001 | Reinert |
| 6,217,493 | B1 | 4/2001 | Spletzer |
| 6,217,495 | B1 | 4/2001 | Yalch |
| 6,220,990 | B1 | 4/2001 | Crivello |
| 6,220,992 | B1 | 4/2001 | Shafik |
| 6,220,995 | B1 | 4/2001 | Chen |
| 6,224,516 | B1 | 5/2001 | Disch |
| 6,224,519 | B1 | 5/2001 | Doolittle |
| 6,228,003 | B1 | 5/2001 | Hald et al. |
| 6,230,047 | B1 | 5/2001 | McHugh |
| 6,230,460 | B1 | 5/2001 | Huyett |
| 6,231,482 | B1 | 5/2001 | Thompson |
| 6,231,489 | B1 | 5/2001 | McBride et al. |
| 6,231,946 | B1 | 5/2001 | Brown, Jr. et al. |
| 6,234,935 | B1 | 5/2001 | Chu |
| 6,234,936 | B1 | 5/2001 | Wang |
| 6,234,941 | B1 | 5/2001 | Chu |
| 6,237,583 | B1 | 5/2001 | Ripley et al. |
| 6,238,322 | B1 | 5/2001 | Hsu |
| 6,238,323 | B1 | 5/2001 | Simonson |
| 6,241,553 | B1 | 6/2001 | Hsia |
| 6,241,638 | B1 | 6/2001 | Hurt |
| 6,244,988 | B1 | 6/2001 | Delman |
| 6,244,992 | B1 | 6/2001 | James |
| 6,244,995 | B1 | 6/2001 | Prsala |
| 6,245,001 | B1 | 6/2001 | Siaperas |
| 6,251,047 | B1 | 6/2001 | Stearns et al. |
| 6,251,048 | B1 | 6/2001 | Kaufman |
| 6,251,052 | B1 | 6/2001 | Simonson |
| 6,254,514 | B1 | 7/2001 | Maresh et al. |
| 6,254,515 | B1 | 7/2001 | Carman et al. |
| 6,254,516 | B1 | 7/2001 | Giannelli et al. |
| 6,261,022 | B1 | 7/2001 | Dalebout et al. |
| 6,261,209 | B1 | 7/2001 | Coody |
| 6,264,272 | B1 | 7/2001 | Jones et al. |
| 6,264,586 | B1 | 7/2001 | Webber |
| 6,264,588 | B1 | 7/2001 | Ellis |
| 6,267,710 | B1 | 7/2001 | Liu |
| 6,267,711 | B1 | 7/2001 | Hinds |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,859 | B1 | 9/2001 | Carlson et al. |
| 6,283,896 | B1 | 9/2001 | Grunfeld |
| 6,287,240 | B1 | 9/2001 | Trabbic |
| 6,287,241 | B1 | 9/2001 | Ellis |
| 6,290,630 | B1 | 9/2001 | Boland |
| 6,293,375 | B1 | 9/2001 | Chen |
| 6,293,892 | B1 | 9/2001 | Slawinski et al. |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,309,331 | B1 | 10/2001 | Raymond |
| 6,312,363 | B1 | 11/2001 | Watterson et al. |
| 6,312,366 | B1 | 11/2001 | Prusick |
| 6,314,667 | B1 | 11/2001 | Rife et al. |
| 6,315,486 | B1 | 11/2001 | Lunz |
| 6,315,702 | B1 | 11/2001 | Ikonomopoulos |
| 6,319,176 | B1 | 11/2001 | Landfair |
| 6,319,178 | B1 | 11/2001 | Webber |
| 6,319,179 | B1 | 11/2001 | Hinds |
| 6,322,059 | B1 | 11/2001 | Kelm et al. |
| 6,322,481 | B1 | 11/2001 | Krull |
| 6,322,483 | B1 | 11/2001 | Rotella |
| 6,325,745 | B1 | 12/2001 | Yu |
| 6,325,746 | B1 | 12/2001 | Wang |
| 6,328,325 | B1 | 12/2001 | Greenwood |
| 6,328,676 | B1 | 12/2001 | Alessandri |
| 6,328,677 | B1 | 12/2001 | Drapeau |
| 6,334,624 | B1 | 1/2002 | Giglio |
| 6,335,100 | B1 | 1/2002 | Tominaga et al. |
| 6,338,701 | B1 | 1/2002 | Webber |
| 6,340,340 | B1 | 1/2002 | Stearns |
| 6,342,028 | B1 | 1/2002 | De Sane |
| 6,344,986 | B1 | 2/2002 | Jain et al. |
| 6,347,603 | B1 | 2/2002 | Felger |
| 6,347,731 | B1 | 2/2002 | Burger |
| 6,348,028 | B1 | 2/2002 | Cragg |
| 6,350,218 | B1 | 2/2002 | Dalebout et al. |
| 6,350,219 | B1 | 2/2002 | Hobson |
| 6,350,221 | B1 | 2/2002 | Krull |
| 6,352,494 | B2 | 3/2002 | McAlonan |
| 6,357,077 | B1 | 3/2002 | Jones, Jr. et al. |
| 6,358,187 | B1 | 3/2002 | Smith |
| 6,360,408 | B1 | 3/2002 | Dykstra et al. |
| 6,361,476 | B1 | 3/2002 | Eschenbach |
| 6,368,251 | B1 | 4/2002 | Casler |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,287 | B1 | 4/2002 | Slawinski et al. |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,387,018 | B1 | 5/2002 | Krull |
| 6,387,019 | B1 | 5/2002 | Krull |
| 6,387,022 | B1 | 5/2002 | Smith |
| 6,387,024 | B1 | 5/2002 | Monti et al. |
| 6,390,927 | B1 | 5/2002 | Cleveland, III |
| 6,390,953 | B1 | 5/2002 | Maresh |
| 6,390,955 | B1 | 5/2002 | Wang |
| 6,394,239 | B1 | 5/2002 | Carlson |
| 6,394,935 | B1 | 5/2002 | Lake |
| 6,394,936 | B1 | 5/2002 | Voris |
| 6,394,938 | B1 | 5/2002 | Tornabene |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,196 | B1 | 7/2002 | Crowson |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,416,446 | B1 | 7/2002 | Krull |
| 6,416,447 | B1 | 7/2002 | Harmon |
| 6,419,611 | B1 | 7/2002 | Levine et al. |
| 6,422,976 | B1 | 7/2002 | Eschenbach |
| 6,422,977 | B1 | 7/2002 | Eschenbach |
| 6,422,979 | B1 | 7/2002 | Krull |
| 6,422,980 | B1 | 7/2002 | Simonson |
| 6,422,981 | B1 | 7/2002 | Riser |
| 6,422,983 | B1 | 7/2002 | Weck |

(56) References Cited

U.S. PATENT DOCUMENTS

| | | | |
|---|---|---|---|
| 6,427,805 | B1 | 8/2002 | Gibson et al. |
| 6,428,449 | B1 | 8/2002 | Apseloff |
| 6,428,450 | B1 | 8/2002 | Ho |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,436,013 | B1 | 8/2002 | Krull |
| 6,440,013 | B1 | 8/2002 | Brown |
| 6,440,042 | B2 | 8/2002 | Eschenbach |
| 6,440,045 | B1 | 8/2002 | Gaston |
| 6,443,521 | B1 | 9/2002 | Nye et al. |
| 6,443,875 | B1 | 9/2002 | Golen, Jr. et al. |
| 6,443,877 | B1 | 9/2002 | Hoecht |
| 6,443,878 | B1 | 9/2002 | Webber |
| 6,447,424 | B1 | 9/2002 | Ashby et al. |
| 6,447,430 | B1 | 9/2002 | Webb et al. |
| 6,447,432 | B1 | 9/2002 | Krull |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,450,928 | B1 | 9/2002 | Larkins, Jr. |
| 6,454,050 | B2 | 9/2002 | Gibson et al. |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,458,061 | B2 | 10/2002 | Simonson |
| 6,461,275 | B1 | 10/2002 | Wang et al. |
| 6,461,279 | B1 | 10/2002 | Kuo |
| 6,461,284 | B1 | 10/2002 | Francavilla |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,471,624 | B1 | 10/2002 | Voris |
| 6,474,193 | B1 | 11/2002 | Farney |
| 6,475,121 | B2 | 11/2002 | Wang |
| 6,475,122 | B2 | 11/2002 | Wu |
| 6,478,721 | B1 | 11/2002 | Hunter |
| 6,482,128 | B1 | 11/2002 | Michalow |
| 6,482,130 | B1 | 11/2002 | Pasero et al. |
| 6,482,132 | B2 | 11/2002 | Eschenbach |
| 6,482,134 | B1 | 11/2002 | Rasmussen |
| 6,482,139 | B1 | 11/2002 | Haag |
| 6,485,397 | B1 | 11/2002 | Manderbacka |
| 6,488,020 | B1 | 12/2002 | Rosas-Magallan |
| 6,488,599 | B2 | 12/2002 | Nye |
| 6,488,612 | B2 | 12/2002 | Sechrest et al. |
| 6,491,268 | B1 | 12/2002 | Channer et al. |
| 6,491,609 | B2 | 12/2002 | Webber |
| 6,491,610 | B1 | 12/2002 | Henn |
| 6,494,814 | B1 | 12/2002 | Wang |
| 6,494,817 | B2 | 12/2002 | Lake |
| 6,500,097 | B1 | 12/2002 | Hall |
| 6,500,101 | B1 | 12/2002 | Chen |
| 6,500,102 | B1 | 12/2002 | Domenge |
| 6,503,173 | B2 | 1/2003 | Clem |
| 6,505,503 | B1 | 1/2003 | Teresi et al. |
| 6,506,142 | B2 | 1/2003 | Itoh et al. |
| 6,510,760 | B2 | 1/2003 | Matsuo |
| 6,513,669 | B2 | 2/2003 | Ozawa et al. |
| 6,514,180 | B1 | 2/2003 | Rawls |
| 6,515,182 | B2 | 2/2003 | Hosokawa et al. |
| 6,520,531 | B1 | 2/2003 | Gien |
| 6,520,891 | B1 | 2/2003 | Stephens, Jr. |
| 6,524,226 | B2 | 2/2003 | Kushner |
| 6,527,674 | B1 | 3/2003 | Clem |
| 6,527,683 | B2 | 3/2003 | Tolles |
| 6,527,685 | B2 | 3/2003 | Endelman et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,537,185 | B1 | 3/2003 | Hur |
| 6,539,931 | B2 | 4/2003 | Trajkovic et al. |
| 6,540,650 | B1 | 4/2003 | Krull |
| 6,540,651 | B1 | 4/2003 | Aberton et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,217 | B2 | 4/2003 | Kaganovsky |
| 6,551,218 | B2 | 4/2003 | Goh |
| 6,551,220 | B1 | 4/2003 | Schroeder |
| 6,551,223 | B2 | 4/2003 | Cheng |
| 6,551,226 | B1 | 4/2003 | Webber et al. |
| 6,554,749 | B2 | 4/2003 | Iund et al. |
| 6,558,300 | B2 | 5/2003 | Deola |
| 6,558,301 | B1 | 5/2003 | Jackson |
| 6,558,302 | B2 | 5/2003 | Cluff |
| 6,561,955 | B1 | 5/2003 | Dreissigacker et al. |
| 6,561,956 | B1 | 5/2003 | Allison |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,575,885 | B1 | 6/2003 | Weck et al. |
| 6,579,210 | B1 | 6/2003 | Stearns et al. |
| 6,579,213 | B1 | 6/2003 | Webber et al. |
| 6,579,214 | B2 | 6/2003 | Crump |
| 6,582,342 | B2 | 6/2003 | Kaufman |
| 6,582,344 | B2 | 6/2003 | Tang |
| 6,582,345 | B2 | 6/2003 | Roy |
| 6,585,624 | B1 | 7/2003 | Chen |
| 6,585,626 | B2 | 7/2003 | McBride |
| 6,589,138 | B2 | 7/2003 | Dyer et al. |
| 6,592,498 | B1 | 7/2003 | Trainor |
| 6,592,499 | B2 | 7/2003 | Parker |
| 6,592,502 | B1 | 7/2003 | Phillips |
| 6,595,905 | B2 | 7/2003 | McBride |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,604,008 | B2 | 8/2003 | Chudley et al. |
| 6,605,020 | B1 | 8/2003 | Huang |
| 6,605,024 | B2 | 8/2003 | Stearns |
| 6,607,472 | B2 | 8/2003 | Toole |
| 6,609,478 | B2 | 8/2003 | Del Valle |
| 6,610,063 | B2 | 8/2003 | Kumar et al. |
| 6,612,170 | B2 | 9/2003 | Brown |
| 6,612,969 | B2 | 9/2003 | Eschenbach |
| 6,612,971 | B1 | 9/2003 | Morris |
| 6,619,681 | B2 | 9/2003 | Gutierrez |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,908 | B2 | 10/2003 | Hamady |
| 6,629,909 | B1 | 10/2003 | Stearns et al. |
| 6,629,910 | B1 | 10/2003 | Krull |
| 6,632,160 | B2 | 10/2003 | LaFond et al. |
| 6,632,161 | B1 | 10/2003 | Nir |
| 6,634,996 | B2 | 10/2003 | Jacobsen |
| 6,634,997 | B2 | 10/2003 | Breibart et al. |
| 6,634,998 | B2 | 10/2003 | Siaperas |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,129 | B2 | 11/2003 | Eschenbach |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |

(56) References Cited

U.S. PATENT DOCUMENTS

| | | | |
|---|---|---|---|
| 6,652,419 | B1 | 11/2003 | Rota |
| 6,652,424 | B2 | 11/2003 | Dalebout |
| 6,652,425 | B1 | 11/2003 | Martin et al. |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,093 | B2 | 12/2003 | Chen |
| 6,660,949 | B2 | 12/2003 | Kamino et al. |
| 6,661,136 | B1 | 12/2003 | Lee |
| 6,662,651 | B1 | 12/2003 | Roth |
| 6,663,127 | B2 | 12/2003 | Miller |
| 6,663,498 | B2 | 12/2003 | Stipan |
| 6,663,500 | B2 | 12/2003 | Huang |
| 6,666,796 | B1 | 12/2003 | MacCready, Jr. |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,606 | B2 | 12/2003 | Krull |
| 6,669,607 | B2 | 12/2003 | Slawinski et al. |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,573 | B2 | 1/2004 | Abelbeck et al. |
| 6,676,577 | B2 | 1/2004 | Stearns |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,600 | B1 | 2/2004 | Ullman |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,689,023 | B2 | 2/2004 | Baumler |
| 6,689,025 | B2 | 2/2004 | Emick |
| 6,691,839 | B1 | 2/2004 | El-Kassouf |
| 6,692,415 | B1 | 2/2004 | Winston |
| 6,692,417 | B2 | 2/2004 | Burrell |
| 6,695,620 | B1 | 2/2004 | Huang |
| 6,695,694 | B2 | 2/2004 | Ishikawa et al. |
| 6,698,110 | B1 | 3/2004 | Robbins |
| 6,699,146 | B1 | 3/2004 | Winter et al. |
| 6,699,159 | B2 | 3/2004 | Rouse |
| 6,699,161 | B1 | 3/2004 | Speas |
| 6,699,162 | B2 | 3/2004 | Chen |
| 6,702,719 | B1 | 3/2004 | Brown et al. |
| 6,702,723 | B2 | 3/2004 | Landfair |
| 6,702,726 | B2 | 3/2004 | Lin |
| 6,705,974 | B1 | 3/2004 | Tardif |
| 6,705,976 | B1 | 3/2004 | Piane, Jr. |
| 6,705,977 | B1 | 3/2004 | Ziak |
| 6,708,427 | B2 | 3/2004 | Sussmann et al. |
| 6,711,789 | B2 | 3/2004 | Ping |
| 6,712,737 | B1 | 3/2004 | Nusbaum |
| 6,712,740 | B2 | 3/2004 | Simonson |
| 6,716,142 | B2 | 4/2004 | Kuo |
| 6,716,144 | B1 | 4/2004 | Shifferaw |
| 6,719,669 | B1 | 4/2004 | Wang |
| 6,719,672 | B1 | 4/2004 | Ellis et al. |
| 6,719,674 | B2 | 4/2004 | Krull |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,736,765 | B2 | 5/2004 | Wallace et al. |
| 6,736,766 | B1 | 5/2004 | Gallant |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,370 | B1 | 6/2004 | Fleming et al. |
| 6,746,371 | B1 | 6/2004 | Brown et al. |
| 6,746,380 | B2 | 6/2004 | Lien et al. |
| 6,746,381 | B2 | 6/2004 | Krull |
| 6,747,427 | B1 | 6/2004 | Carson |
| 6,749,537 | B1 | 6/2004 | Hickman |
| 6,749,540 | B1 | 6/2004 | Pasero et al. |
| 6,749,542 | B2 | 6/2004 | Wu |
| 6,749,547 | B2 | 6/2004 | Krull |
| 6,752,745 | B1 | 6/2004 | Davis |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,761,672 | B1 | 7/2004 | Williams |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,770,014 | B2 | 8/2004 | Amore |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,793,607 | B2 | 9/2004 | Neil |
| 6,793,609 | B1 | 9/2004 | Fan |
| 6,796,159 | B2 | 9/2004 | Kelm et al. |
| 6,796,925 | B2 | 9/2004 | Martinez et al. |
| 6,796,927 | B2 | 9/2004 | Toyama |
| 6,802,800 | B1 | 10/2004 | Hobson |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,827,822 | B2 | 12/2004 | Tao et al. |
| 6,830,540 | B2 | 12/2004 | Watterson |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,846,270 | B1 | 1/2005 | Etnyre |
| 6,846,272 | B2 | 1/2005 | Rosenow et al. |
| 6,849,032 | B2 | 2/2005 | Chu |
| 6,852,068 | B2 | 2/2005 | Ogawa |
| 6,855,093 | B2 | 2/2005 | Anderson et al. |
| 6,855,097 | B2 | 2/2005 | Krull |
| 6,857,993 | B2 | 2/2005 | Yeh |
| 6,860,131 | B2 | 3/2005 | Armstrong et al. |
| 6,860,836 | B1 | 3/2005 | Wu |
| 6,860,839 | B1 | 3/2005 | Dice |
| 6,860,841 | B1 | 3/2005 | Mortorano |
| 6,872,168 | B2 | 3/2005 | Wang et al. |

(56) References Cited

U.S. PATENT DOCUMENTS

| | | | |
|---|---|---|---|
| 6,872,173 | B2 | 3/2005 | Krull |
| 6,872,175 | B2 | 3/2005 | Lin |
| 6,875,157 | B1 | 4/2005 | Wang |
| 6,875,160 | B2 | 4/2005 | Watterson et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,886,645 | B2 | 5/2005 | Bise et al. |
| 6,887,185 | B1 | 5/2005 | Kuo |
| 6,887,190 | B1 | 5/2005 | Azari |
| 6,893,381 | B2 | 5/2005 | Slawinski |
| 6,893,383 | B1 | 5/2005 | Chang et al. |
| 6,896,342 | B1 | 5/2005 | Cheng |
| 6,896,645 | B1 | 5/2005 | Krull |
| 6,899,657 | B2 | 5/2005 | Chuang |
| 6,899,659 | B2 | 5/2005 | Anderson et al. |
| 6,899,661 | B1 | 5/2005 | Krull |
| 6,902,513 | B1 | 6/2005 | McClure |
| 6,902,515 | B2 | 6/2005 | Howell et al. |
| 6,902,516 | B2 | 6/2005 | Krull |
| 6,905,446 | B2 | 6/2005 | Greenland |
| 6,908,416 | B2 | 6/2005 | Mercado et al. |
| 6,908,417 | B2 | 6/2005 | Jackson |
| 6,910,992 | B2 | 6/2005 | Arguilez |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,918,861 | B2 | 7/2005 | Liao et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,923,748 | B1 | 8/2005 | Mauz |
| 6,923,749 | B1 | 8/2005 | Smith |
| 6,926,644 | B2 | 8/2005 | Chen |
| 6,926,646 | B1 | 8/2005 | Nguyen |
| 6,926,649 | B2 | 8/2005 | Slawinski |
| 6,929,589 | B1 | 8/2005 | Bruggemann et al. |
| 6,932,745 | B1 | 8/2005 | Ellis |
| 6,939,271 | B1 | 9/2005 | Whan-Tong et al. |
| 6,941,620 | B1 | 9/2005 | Hinds |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,960,156 | B2 | 11/2005 | Smith |
| 6,964,632 | B1 | 11/2005 | Ko |
| 6,966,872 | B2 | 11/2005 | Eschenbach |
| 6,971,974 | B2 | 12/2005 | Bowman |
| 6,971,975 | B2 | 12/2005 | Croft |
| 6,971,978 | B2 | 12/2005 | Hyder |
| 6,974,404 | B1 | 12/2005 | Watterson et al. |
| 6,974,405 | B2 | 12/2005 | Krull |
| 6,976,698 | B2 | 12/2005 | Kuiken |
| 6,976,941 | B2 | 12/2005 | Britt |
| 6,976,943 | B1 | 12/2005 | Hsiung |
| 6,979,283 | B2 | 12/2005 | Pan |
| 6,991,588 | B1 | 1/2006 | Adams |
| 6,994,306 | B1 | 2/2006 | Sweere et al. |
| 6,994,657 | B1 | 2/2006 | Eschenbach |
| 6,994,683 | B1 | 2/2006 | Starr |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,022,048 | B1 | 4/2006 | Fernandez |
| 7,022,049 | B2 | 4/2006 | Ryan et al. |
| 7,022,051 | B2 | 4/2006 | Ota |
| 7,029,425 | B2 | 4/2006 | Krull |
| 7,032,870 | B2 | 4/2006 | Sweere et al. |
| 7,033,176 | B2 | 4/2006 | Feldman |
| 7,033,306 | B2 | 4/2006 | Graber |
| 7,037,246 | B2 | 5/2006 | Kim |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,066 | B1 | 5/2006 | Miller |
| 7,044,891 | B1 | 5/2006 | Rivera |
| 7,044,897 | B2 | 5/2006 | Myers et al. |
| 7,048,638 | B2 | 5/2006 | Novotny |
| 7,048,677 | B2 | 5/2006 | Mackert |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,060,011 | B1 | 6/2006 | Krull |
| 7,060,012 | B2 | 6/2006 | Howell et al. |
| 7,066,867 | B2 | 6/2006 | Krull |
| 7,070,545 | B2 | 7/2006 | Lull et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,083,536 | B2 | 8/2006 | Lu et al. |
| 7,083,549 | B1 | 8/2006 | Fan |
| 7,083,554 | B1 | 8/2006 | Lo Presti |
| 7,086,994 | B2 | 8/2006 | Turak et al. |
| 7,086,999 | B2 | 8/2006 | Jeneve et al. |
| 7,087,000 | B1 | 8/2006 | Walker |
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,163 | B2 | 9/2006 | Krull |
| 7,113,166 | B1 | 9/2006 | Rosenberg et al. |
| 7,115,073 | B2 | 10/2006 | Nizamuddin |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,125,371 | B2 | 10/2006 | Henderson |
| 7,125,373 | B1 | 10/2006 | Garza |
| 7,128,696 | B1 | 10/2006 | Krull |

(56) References Cited

U.S. PATENT DOCUMENTS

| | | | |
|---|---|---|---|
| 7,128,697 | B1 | 10/2006 | Krull |
| 7,128,701 | B1 | 10/2006 | Ketcham |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,140,626 | B1 | 11/2006 | Keay |
| 7,141,008 | B2 | 11/2006 | Krull et al. |
| 7,150,168 | B1 | 12/2006 | Kuo |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,186,189 | B2 | 3/2007 | Huang |
| 7,192,388 | B2 | 3/2007 | Dalebout et al. |
| 7,192,389 | B2 | 3/2007 | Allison |
| 7,195,568 | B2 | 3/2007 | Huang |
| 7,197,029 | B1 | 3/2007 | Osterhout et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,170 | B2 | 5/2007 | Sumners |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,216 | B1 | 5/2007 | McBride |
| 7,225,694 | B2 | 6/2007 | Said |
| 7,226,402 | B1 | 6/2007 | Joya |
| 7,229,391 | B2 | 6/2007 | Francis |
| 7,232,404 | B2 | 6/2007 | Nelson |
| 7,235,942 | B2 | 6/2007 | Nagaoka et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,255,665 | B2 | 8/2007 | Ish, III |
| 7,255,666 | B2 | 8/2007 | Cardenas |
| 7,257,468 | B1 | 8/2007 | Costa et al. |
| 7,258,651 | B2 | 8/2007 | Clarke |
| 7,261,678 | B2 | 8/2007 | Crawford et al. |
| 7,264,554 | B2 | 9/2007 | Bentley |
| 7,264,578 | B1 | 9/2007 | Krull |
| 7,269,038 | B2 | 9/2007 | Shekhawat |
| 7,276,017 | B2 | 10/2007 | Lin |
| 7,278,934 | B2 | 10/2007 | McBride et al. |
| 7,278,955 | B2 | 10/2007 | Giannelli et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,906 | B2 | 1/2008 | Webber |
| 7,322,907 | B2 | 1/2008 | Bowser |
| 7,322,909 | B1 | 1/2008 | Loccarini |
| 7,331,911 | B2 | 2/2008 | Webber et al. |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,147 | B2 | 2/2008 | Jones |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,758 | B2 | 4/2008 | Polk, III |
| 7,359,121 | B2 | 4/2008 | French et al. |
| 7,361,123 | B1 | 4/2008 | Krull |
| 7,361,125 | B2 | 4/2008 | Webber et al. |
| 7,361,127 | B2 | 4/2008 | Tremayne |
| 7,364,538 | B2 | 4/2008 | Aucamp |
| 7,366,921 | B2 | 4/2008 | Ranganathan |
| 7,367,926 | B2 | 5/2008 | Clark |
| 7,367,927 | B2 | 5/2008 | Krull |
| 7,369,121 | B2 | 5/2008 | Lane |
| 7,370,498 | B1 | 5/2008 | Miao |
| 7,374,519 | B2 | 5/2008 | Naidus |
| 7,377,881 | B2 | 5/2008 | Moon |
| 7,377,886 | B2 | 5/2008 | Wu |
| 7,384,013 | B2 | 6/2008 | Yen |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,402,145 | B1 | 7/2008 | Woggon |
| 7,413,056 | B2 | 8/2008 | Gonzi et al. |
| 7,413,065 | B2 | 8/2008 | Gauthier |
| 7,413,532 | B1 | 8/2008 | Monsrud et al. |
| 7,413,533 | B2 | 8/2008 | Lin |
| 7,425,189 | B1 | 9/2008 | Eschenbach |
| 7,428,760 | B2 | 9/2008 | McCrimmon |
| 7,429,235 | B2 | 9/2008 | Lin |

(56) References Cited

U.S. PATENT DOCUMENTS

| | | | |
|---|---|---|---|
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,438,673 | B1 | 10/2008 | Jones |
| 7,448,823 | B2 | 11/2008 | Silva |
| 7,455,626 | B2 | 11/2008 | Trevino et al. |
| 7,455,628 | B1 | 11/2008 | Stearns |
| 7,455,633 | B2 | 11/2008 | Brown et al. |
| 7,462,141 | B1 | 12/2008 | Raboin et al. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,478,794 | B1 | 1/2009 | Gohlke et al. |
| 7,482,050 | B2 | 1/2009 | Olson |
| 7,485,077 | B2 | 2/2009 | Chen |
| 7,488,277 | B1 | 2/2009 | Knapp |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,497,784 | B2 | 3/2009 | Henry |
| 7,497,814 | B1 | 3/2009 | Krull |
| 7,503,883 | B2 | 3/2009 | Madden |
| 7,507,186 | B2 | 3/2009 | Stearns |
| 7,507,187 | B2 | 3/2009 | Dyer et al. |
| 7,507,189 | B2 | 3/2009 | Krull |
| 7,510,511 | B2 | 3/2009 | Von Detten |
| 7,517,303 | B2 | 4/2009 | Crawford et al. |
| 7,517,304 | B1 | 4/2009 | Swanson et al. |
| 7,520,840 | B2 | 4/2009 | Shifferaw |
| 7,520,845 | B2 | 4/2009 | Towley, III et al. |
| 7,524,272 | B2 | 4/2009 | Bruck et al. |
| 7,525,293 | B1 | 4/2009 | Notohamiprodjo et al. |
| 7,534,200 | B1 | 5/2009 | Martinez |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,540,828 | B2 | 6/2009 | Watterson et al. |
| 7,540,829 | B1 | 6/2009 | Lin |
| 7,544,153 | B2 | 6/2009 | Trevino et al. |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,267 | B1 | 6/2009 | Hauser |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,569,000 | B2 | 8/2009 | Wang |
| 7,569,004 | B2 | 8/2009 | Kolomeir |
| 7,569,005 | B2 | 8/2009 | Geeting |
| 7,571,517 | B2 | 8/2009 | Smith et al. |
| 7,575,537 | B2 | 8/2009 | Ellis |
| 7,575,538 | B1 | 8/2009 | Clark |
| 7,578,771 | B1 | 8/2009 | Towley, III et al. |
| 7,578,772 | B2 | 8/2009 | Lippitt |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,585,262 | B1 | 9/2009 | Vayntraub |
| 7,588,520 | B2 | 9/2009 | Nalley |
| 7,591,763 | B1 | 9/2009 | Fucci |
| 7,591,770 | B2 | 9/2009 | Stewart et al. |
| 7,591,773 | B2 | 9/2009 | Weir |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,594,881 | B2 | 9/2009 | Shifferaw |
| 7,601,101 | B2 | 10/2009 | Jackson et al. |
| 7,601,105 | B1 | 10/2009 | Gipson, III et al. |
| 7,602,301 | B1 | 10/2009 | Stirling et al. |
| 7,604,571 | B2 | 10/2009 | Wilkins |
| 7,604,572 | B2 | 10/2009 | Stanford |
| 7,604,573 | B2 | 10/2009 | Dalebout et al. |
| 7,604,576 | B2 | 10/2009 | Drechsler |
| 7,604,578 | B2 | 10/2009 | Liu |
| 7,608,015 | B2 | 10/2009 | Radow |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,611,445 | B2 | 11/2009 | Brown et al. |
| 7,611,450 | B2 | 11/2009 | Mancini |
| 7,614,639 | B2 | 11/2009 | Tholkes et al. |
| 7,614,981 | B2 | 11/2009 | Cao |
| 7,614,984 | B1 | 11/2009 | Krull |
| 7,618,346 | B2 | 11/2009 | Crawford et al. |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,628,743 | B1 | 12/2009 | Flentye et al. |
| 7,632,221 | B1 | 12/2009 | Kolander |
| 7,637,847 | B1 | 12/2009 | Hickman |
| 7,637,850 | B2 | 12/2009 | Lin |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,218 | B2 | 1/2010 | Potok et al. |
| 7,645,221 | B1 | 1/2010 | Curry |
| 7,647,196 | B2 | 1/2010 | Kahn et al. |
| 7,648,446 | B2 | 1/2010 | Chiles et al. |
| 7,651,442 | B2 | 1/2010 | Carlson |
| 7,651,450 | B2 | 1/2010 | Wehrell |
| 7,654,229 | B2 | 2/2010 | Smith |
| 7,654,940 | B2 | 2/2010 | Webber et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,670,263 | B2 | 3/2010 | Ellis |
| 7,670,269 | B2 | 3/2010 | Webber et al. |
| 7,670,270 | B2 | 3/2010 | Alessandri et al. |
| 7,674,205 | B2 | 3/2010 | Dalebout et al. |
| 7,674,206 | B2 | 3/2010 | Jones |
| 7,674,216 | B1 | 3/2010 | Bolling |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,690,556 | B1 | 4/2010 | Kahn et al. |
| 7,691,042 | B2 | 4/2010 | Pandozy |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,704,195 | B2 | 4/2010 | Alessandri et al. |
| 7,708,668 | B2 | 5/2010 | Rodgers, Jr. |
| 7,708,672 | B2 | 5/2010 | Gibson et al. |
| 7,713,172 | B2 | 5/2010 | Watterson et al. |

(56) References Cited

U.S. PATENT DOCUMENTS

| | | | |
|---|---|---|---|
| 7,713,177 | B2 | 5/2010 | Lo |
| 7,717,826 | B2 | 5/2010 | Cox et al. |
| 7,717,827 | B2 | 5/2010 | Veli-Pekka Kurunmäki et al. |
| 7,717,828 | B2 | 5/2010 | Simonson et al. |
| 7,717,830 | B1 | 5/2010 | Charniga et al. |
| 7,717,833 | B1 | 5/2010 | Nelson et al. |
| 7,722,503 | B1 | 5/2010 | Smith et al. |
| 7,722,509 | B2 | 5/2010 | Eder |
| 7,730,588 | B1 | 6/2010 | Bernier |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,740,563 | B2 | 6/2010 | Dalebout et al. |
| 7,740,568 | B2 | 6/2010 | Webb |
| 7,740,570 | B2 | 6/2010 | Winston |
| 7,745,716 | B1 | 6/2010 | Murphy |
| 7,749,137 | B2 | 7/2010 | Watt et al. |
| 7,749,140 | B1 | 7/2010 | Lindemeier et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,766,797 | B2 | 8/2010 | Dalebout |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,952 | B1 | 8/2010 | Curran et al. |
| 7,775,953 | B2 | 8/2010 | Wang |
| 7,780,578 | B2 | 8/2010 | Packham |
| 7,780,583 | B2 | 8/2010 | Brown |
| 7,780,585 | B1 | 8/2010 | Rivas |
| 7,789,800 | B1 | 9/2010 | Watterson et al. |
| 7,789,806 | B2 | 9/2010 | Yang |
| 7,794,363 | B2 | 9/2010 | Wang |
| 7,794,371 | B2 | 9/2010 | Webber et al. |
| 7,795,824 | B2 | 9/2010 | Shen et al. |
| 7,798,946 | B2 | 9/2010 | Dalebout et al. |
| 7,803,096 | B2 | 9/2010 | Mehta |
| 7,806,780 | B1 | 10/2010 | Plunkett |
| 7,806,805 | B2 | 10/2010 | Barufka et al. |
| 7,806,815 | B2 | 10/2010 | Fernandez |
| 7,811,202 | B2 | 10/2010 | Planke |
| 7,811,209 | B2 | 10/2010 | Crawford et al. |
| 7,811,213 | B2 | 10/2010 | Chen |
| 7,815,548 | B2 | 10/2010 | Barre et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,784 | B1 | 10/2010 | Caswell et al. |
| 7,819,785 | B2 | 10/2010 | Maiaro et al. |
| 7,828,703 | B1 | 11/2010 | Boesch |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,598 | B1 | 11/2010 | Boozel, Jr. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,841,971 | B2 | 11/2010 | Smith |
| 7,846,070 | B2 | 12/2010 | Oglesby et al. |
| 7,850,584 | B2 | 12/2010 | Uygan |
| 7,854,669 | B2 | 12/2010 | Marty et al. |
| 7,862,483 | B2 | 1/2011 | Hendrickson et al. |
| 7,862,486 | B1 | 1/2011 | Watson |
| 7,862,489 | B2 | 1/2011 | Savsek et al. |
| 7,871,355 | B2 | 1/2011 | Yeh |
| 7,871,357 | B2 | 1/2011 | Gibson et al. |
| 7,874,961 | B2 | 1/2011 | McKee et al. |
| 7,878,950 | B1 | 2/2011 | Bastian |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,896,782 | B2 | 3/2011 | Tamari |
| 7,900,324 | B2 | 3/2011 | Ginocchio |
| 7,901,324 | B2 | 3/2011 | Kodama |
| 7,901,325 | B2 | 3/2011 | Henderson |
| 7,901,335 | B2 | 3/2011 | Webber et al. |
| 7,908,981 | B2 | 3/2011 | Agee |
| 7,909,742 | B2 | 3/2011 | Ish, III et al. |
| 7,909,743 | B1 | 3/2011 | Webber |
| 7,909,745 | B2 | 3/2011 | Mills et al. |
| 7,914,420 | B2 | 3/2011 | Daly et al. |
| 7,914,421 | B2 | 3/2011 | Weier et al. |
| 7,919,950 | B2 | 4/2011 | Uno et al. |
| 7,922,635 | B2 | 4/2011 | Lull et al. |
| 7,927,253 | B2 | 4/2011 | Vincent |
| 7,931,563 | B2 | 4/2011 | Shaw et al. |
| 7,931,570 | B2 | 4/2011 | Hoffman |
| 7,935,026 | B2 | 5/2011 | Mcsorley |
| 7,935,032 | B1 | 5/2011 | Jackson |
| 7,938,751 | B2 | 5/2011 | Nicolas et al. |
| 7,938,755 | B1 | 5/2011 | Dyer et al. |
| 7,938,760 | B1 | 5/2011 | Webber et al. |
| 7,938,761 | B2 | 5/2011 | Simonson |
| 7,942,788 | B2 | 5/2011 | Wu |
| 7,942,793 | B2 | 5/2011 | Mills et al. |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer et al. |
| 7,963,892 | B2 | 6/2011 | Poblete Castro et al. |
| 7,967,734 | B1 | 6/2011 | Damian |
| 7,972,249 | B1 | 7/2011 | Napalan |
| 7,976,437 | B1 | 7/2011 | Von Detten |
| 7,976,443 | B2 | 7/2011 | Krull |
| 7,978,081 | B2 | 7/2011 | Shears et al. |
| 7,980,996 | B2 | 7/2011 | Hickman |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ashby |
| 7,988,600 | B2 | 8/2011 | Rodgers, Jr. |
| 7,988,605 | B1 | 8/2011 | Wyeroski |
| 7,993,251 | B1 | 8/2011 | Webber et al. |
| 7,998,036 | B2 | 8/2011 | Ish, III |
| 7,998,042 | B2 | 8/2011 | Bowser et al. |
| 8,001,472 | B2 | 8/2011 | Gilley et al. |
| 8,002,674 | B2 | 8/2011 | Piaget et al. |
| 8,002,678 | B1 | 8/2011 | Krull |
| 8,002,684 | B2 | 8/2011 | Laurent |
| 8,006,711 | B2 | 8/2011 | Pietrzak et al. |
| 8,007,409 | B2 | 8/2011 | Elllis |
| 8,007,413 | B1 | 8/2011 | Wu |
| 8,007,415 | B1 | 8/2011 | Lundquist |
| RE42,698 | E | 9/2011 | Kuo et al. |
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,025,613 | B1 | 9/2011 | Wang |
| 8,029,415 | B2 | 10/2011 | Ashby et al. |
| 8,029,425 | B2 | 10/2011 | Bronston et al. |
| 8,033,960 | B1 | 10/2011 | Dalebout et al. |

(56) References Cited

U.S. PATENT DOCUMENTS

| | | | |
|---|---|---|---|
| 8,033,965 | B1 | 10/2011 | Krull |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,367 | B2 | 11/2011 | Giannelli et al. |
| 8,057,368 | B1 | 11/2011 | Lyszczarz |
| 8,062,196 | B1 | 11/2011 | Khubani |
| 8,066,514 | B2 | 11/2011 | Clarke |
| 8,070,657 | B2 | 12/2011 | Loach |
| 8,072,902 | B2 | 12/2011 | Moon |
| 8,075,453 | B1 | 12/2011 | Wilkinson |
| 8,079,939 | B1 | 12/2011 | Wang |
| 8,082,029 | B2 | 12/2011 | Honda |
| 8,083,693 | B1 | 12/2011 | McKeon et al. |
| 8,092,351 | B1 | 1/2012 | Rodgers, Jr. |
| 8,096,926 | B1 | 1/2012 | Batca |
| 8,103,379 | B2 | 1/2012 | Biba et al. |
| 8,104,411 | B2 | 1/2012 | Fenton |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,113,994 | B2 | 2/2012 | Piaget et al. |
| 8,123,527 | B2 | 2/2012 | Holljes |
| 8,141,276 | B2 | 3/2012 | Ellis |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |
| 8,152,702 | B2 | 4/2012 | Pacheco |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,192,332 | B2 | 6/2012 | Baker et al. |
| 8,197,392 | B2 | 6/2012 | Silverman et al. |
| 8,200,323 | B2 | 6/2012 | DiBenedetto et al. |
| 8,206,274 | B2 | 6/2012 | Svenberg et al. |
| 8,212,445 | B2 | 7/2012 | Ritchey |
| 8,215,886 | B2 | 7/2012 | Campbell |
| 8,221,290 | B2 | 7/2012 | Vincent et al. |
| 8,240,430 | B2 | 8/2012 | Downey |
| 8,241,187 | B2 | 8/2012 | Moon et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,260,858 | B2 | 9/2012 | Belz et al. |
| 8,262,546 | B1 | 9/2012 | Lashinske |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,298,125 | B2 | 10/2012 | Colledge et al. |
| 8,306,635 | B2 | 11/2012 | Pryor |
| 8,308,620 | B2 | 11/2012 | Lyszczarz |
| 8,315,636 | B2 | 11/2012 | Moon et al. |
| 8,315,823 | B2 | 11/2012 | Berme et al. |
| 8,320,578 | B2 | 11/2012 | Kahn et al. |
| 8,323,157 | B2 | 12/2012 | Campanaro et al. |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,378,647 | B2 | 2/2013 | Yonezawa et al. |
| 8,394,005 | B2 | 3/2013 | Solow et al. |
| 8,395,366 | B2 | 3/2013 | Uno |
| 8,398,529 | B2 | 3/2013 | Ellis |
| 8,435,160 | B1 | 5/2013 | Clum |
| 8,444,537 | B1 | 5/2013 | Santoro |
| 8,446,275 | B2 | 5/2013 | Utter, II |
| 8,449,620 | B2 | 5/2013 | Hakansson et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,996 | B2 | 7/2013 | Bluman |
| 8,487,759 | B2 | 7/2013 | Hill |
| 8,500,608 | B1 | 8/2013 | Bonomi |
| 8,505,597 | B2 | 8/2013 | Sharperson |
| 8,506,459 | B2 | 8/2013 | Cassidy et al. |
| 8,512,210 | B2 | 8/2013 | Shauli |
| 8,512,212 | B2 | 8/2013 | Ish, III |
| 8,516,723 | B2 | 8/2013 | Ferrigan et al. |
| 8,517,899 | B2 | 8/2013 | Zhou |
| 8,523,743 | B1 | 9/2013 | Miles et al. |
| 8,523,789 | B2 | 9/2013 | Keiser |
| 8,529,415 | B2 | 9/2013 | Svenberg |
| 8,535,204 | B2 | 9/2013 | Stacey |
| 8,535,247 | B2 | 9/2013 | Williams |
| 8,540,560 | B2 | 9/2013 | Crowley et al. |
| 8,550,962 | B2 | 10/2013 | Piaget et al. |
| 8,550,964 | B2 | 10/2013 | Ish, III et al. |
| 8,562,489 | B2 | 10/2013 | Burton et al. |
| 8,562,496 | B2 | 10/2013 | Webber et al. |
| 8,568,279 | B2 | 10/2013 | Golesh |
| 8,572,764 | B2 | 11/2013 | Thellmann |
| 8,572,820 | B2 | 11/2013 | Richards |
| 8,573,572 | B2 | 11/2013 | Bowen et al. |
| 8,573,982 | B1 | 11/2013 | Chuang |
| 8,588,476 | B1 | 11/2013 | Spicola, Jr. |
| 8,590,120 | B2 | 11/2013 | Sakai |
| 8,591,386 | B2 | 11/2013 | Meyer |
| 8,602,951 | B2 | 12/2013 | Morris |
| 8,608,624 | B2 | 12/2013 | Shabodyash et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,631,544 | B1 | 1/2014 | Shotey et al. |
| 8,647,239 | B1 | 2/2014 | Sokolovas |
| 8,655,004 | B2 | 2/2014 | Prest et al. |
| 8,657,724 | B2 | 2/2014 | Yang |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,696,527 | B2 | 4/2014 | Wu |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,708,870 | B2 | 4/2014 | Nalley |
| 8,715,140 | B1 | 5/2014 | Gertz |
| 8,734,157 | B1 | 5/2014 | Hummel, III |
| 8,734,301 | B2 | 5/2014 | Remelius |
| 8,734,302 | B2 | 5/2014 | Hsieh |
| 8,734,304 | B2 | 5/2014 | Webber et al. |
| 8,734,308 | B1 | 5/2014 | Joslin |
| 8,740,753 | B2 | 6/2014 | Olson et al. |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,764,609 | B1 | 7/2014 | Elahmadie |
| 8,771,153 | B2 | 7/2014 | Dalebout et al. |
| 8,777,820 | B2 | 7/2014 | Lo |
| 8,783,326 | B1 | 7/2014 | Vaninger et al. |
| 8,784,274 | B1 | 7/2014 | Chuang |
| 8,784,286 | B2 | 7/2014 | Reyes |
| 8,790,222 | B2 | 7/2014 | Burger |

(56) References Cited

U.S. PATENT DOCUMENTS

| | | | |
|---|---|---|---|
| 8,801,581 | B2 | 8/2014 | Lai et al. |
| 8,815,189 | B2 | 8/2014 | Arnold et al. |
| 8,821,354 | B1 | 9/2014 | Tabahi |
| 8,821,359 | B1 | 9/2014 | Kassel |
| 8,821,870 | B2 | 9/2014 | Robinson et al. |
| 8,824,697 | B2 | 9/2014 | Christoph |
| 8,825,445 | B2 | 9/2014 | Hoffman et al. |
| 8,827,879 | B2 | 9/2014 | Nicholas |
| 8,845,497 | B2 | 9/2014 | Turner |
| 8,845,498 | B2 | 9/2014 | Webb |
| 8,845,499 | B1 | 9/2014 | Boatwright |
| 8,847,988 | B2 | 9/2014 | Geisner et al. |
| 8,851,565 | B2 | 10/2014 | Hontz et al. |
| 8,864,627 | B2 | 10/2014 | Bayerlein et al. |
| 8,870,720 | B1 | 10/2014 | Webber et al. |
| 8,876,131 | B1 | 11/2014 | Gomes |
| 8,876,661 | B2 | 11/2014 | Lu |
| 8,876,674 | B2 | 11/2014 | Webber et al. |
| 8,888,660 | B1 | 11/2014 | Oteman |
| 8,894,551 | B2 | 11/2014 | Kerdjoudj |
| 8,920,291 | B2 | 12/2014 | Chen et al. |
| 8,926,475 | B2 | 1/2015 | Lin et al. |
| 8,926,479 | B2 | 1/2015 | Chen et al. |
| 8,932,188 | B2 | 1/2015 | Svenberg |
| 8,956,290 | B2 | 2/2015 | Gilley et al. |
| 8,956,715 | B2 | 2/2015 | Kim |
| 8,968,155 | B2 | 3/2015 | Bird |
| 8,968,163 | B1 | 3/2015 | Vidmar |
| 8,979,709 | B2 | 3/2015 | Toback et al. |
| 8,986,165 | B2 | 3/2015 | Ashby |
| 9,005,085 | B2 | 4/2015 | Astilean |
| 9,010,222 | B2 | 4/2015 | Peirce |
| 9,011,291 | B2 | 4/2015 | Birrell |
| 9,011,301 | B2 | 4/2015 | Balandis et al. |
| 9,015,952 | B2 | 4/2015 | Magosaki |
| 9,017,230 | B1 | 4/2015 | Pitts |
| 9,022,906 | B1 | 5/2015 | Nelson |
| 9,022,907 | B2 | 5/2015 | Wang |
| 9,028,368 | B2 | 5/2015 | Ashby et al. |
| 9,028,381 | B2 | 5/2015 | Mestemaker |
| 9,038,218 | B1 | 5/2015 | Heil et al. |
| 9,038,549 | B1 | 5/2015 | Zebarjad |
| 9,039,578 | B2 | 5/2015 | Dalebout |
| 9,050,491 | B2 | 6/2015 | Gordon et al. |
| 9,050,497 | B2 | 6/2015 | Reyes |
| 9,050,498 | B2 | 6/2015 | Lu et al. |
| 9,072,930 | B2 | 7/2015 | Ashby et al. |
| 9,072,932 | B2 | 7/2015 | Piaget et al. |
| 9,079,068 | B2 | 7/2015 | Muehl |
| 9,089,732 | B2 | 7/2015 | Andon et al. |
| 9,095,740 | B2 | 8/2015 | Wu |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,125,620 | B2 | 9/2015 | Walke |
| 9,126,072 | B2 | 9/2015 | Watterson |
| 9,132,051 | B2 | 9/2015 | Heil |
| 9,135,347 | B2 | 9/2015 | Damman et al. |
| 9,138,612 | B2 | 9/2015 | Breaux |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,144,709 | B2 | 9/2015 | Reich |
| 9,162,102 | B1 | 10/2015 | Eder et al. |
| 9,162,104 | B1 | 10/2015 | Lee |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,211,431 | B2 | 12/2015 | Hornback et al. |
| 9,220,940 | B2 | 12/2015 | Al Kuwari |
| 9,221,545 | B2 | 12/2015 | Popescu et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,248,329 | B2 | 2/2016 | Heideman |
| 9,259,633 | B2 | 2/2016 | Meyers |
| 9,265,984 | B2 | 2/2016 | Huber |
| 9,272,186 | B2 | 3/2016 | Reich |
| 9,289,063 | B2 | 3/2016 | Baugh et al. |
| 9,289,644 | B2 | 3/2016 | Carson |
| 9,292,935 | B2 | 3/2016 | Koduri et al. |
| 9,295,302 | B1 | 3/2016 | Reed et al. |
| 9,308,409 | B2 | 4/2016 | Beaver et al. |
| 9,308,415 | B2 | 4/2016 | Crawford et al. |
| 9,308,417 | B2 | 4/2016 | Grundy |
| 9,311,802 | B1 | 4/2016 | Chin et al. |
| 9,314,658 | B2 | 4/2016 | Kaye |
| 9,314,659 | B2 | 4/2016 | Gvoich |
| 9,320,935 | B1 | 4/2016 | Paris |
| 9,320,938 | B1 | 4/2016 | Belmore |
| 9,320,940 | B2 | 4/2016 | Rainey |
| 9,327,159 | B1 | 5/2016 | Medina |
| 9,333,388 | B2 | 5/2016 | Lee et al. |
| 9,339,681 | B1 | 5/2016 | Nalley |
| 9,339,682 | B2 | 5/2016 | Braier et al. |
| 9,339,683 | B2 | 5/2016 | Dilli et al. |
| 9,339,692 | B2 | 5/2016 | Hashish |
| 9,352,181 | B2 | 5/2016 | O'Neil |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,703 | B1 | 6/2016 | Kuka |
| 9,364,706 | B2 | 6/2016 | Lo |
| 9,364,708 | B2 | 6/2016 | Luger et al. |
| 9,364,712 | B2 | 6/2016 | Wu |
| 9,364,714 | B2 | 6/2016 | Koduri et al. |
| 9,367,668 | B2 | 6/2016 | Flynt et al. |
| 9,370,687 | B2 | 6/2016 | Hao |
| 9,375,602 | B2 | 6/2016 | Krull |
| 9,378,336 | B2 | 6/2016 | Ohnemus et al. |
| 9,387,355 | B1 | 7/2016 | Joya |
| 9,387,357 | B2 | 7/2016 | Mueller |
| 9,387,387 | B2 | 7/2016 | Dalebout |
| 9,389,718 | B1 | 7/2016 | Letourneur |
| 9,393,453 | B2 | 7/2016 | Watterson |
| 9,403,048 | B2 | 8/2016 | Balandis et al. |
| 9,409,047 | B2 | 8/2016 | Kamenskikh |
| 9,415,257 | B2 | 8/2016 | Habing |
| 9,427,611 | B1 | 8/2016 | Balentine |
| 9,452,315 | B1 | 9/2016 | Murray et al. |
| 9,452,320 | B2 | 9/2016 | Yang |
| 9,455,784 | B2 | 9/2016 | Cune et al. |
| 9,457,220 | B2 | 10/2016 | Olson |
| 9,457,224 | B2 | 10/2016 | Giannelli et al. |
| 9,463,345 | B2 | 10/2016 | Simonetti |
| 9,463,349 | B1 | 10/2016 | Chang |
| 9,468,792 | B2 | 10/2016 | Simonetti |
| 9,474,666 | B1 | 10/2016 | Smith |
| 9,480,874 | B2 | 11/2016 | Cutler |
| 9,486,658 | B2 | 11/2016 | Alexander |
| 9,498,666 | B1 | 11/2016 | Boatwright |
| 9,498,668 | B2 | 11/2016 | Smith |
| 9,498,671 | B1 | 11/2016 | Softky |
| 9,505,241 | B2 | 11/2016 | Lyon |
| 9,506,528 | B2 | 11/2016 | Tucker et al. |
| 9,506,529 | B2 | 11/2016 | Tucker et al. |
| 9,526,937 | B2 | 12/2016 | Uygan |
| 9,539,458 | B1 | 1/2017 | Ross |
| 9,540,071 | B2 | 1/2017 | Jordan et al. |
| 9,540,174 | B2 | 1/2017 | Josserond et al. |
| 9,545,540 | B1 | 1/2017 | Moschel |
| 9,550,091 | B2 | 1/2017 | Emerson |
| 9,555,278 | B2 | 1/2017 | Kaye et al. |
| 9,555,280 | B2 | 1/2017 | Kaye et al. |

(56) References Cited

U.S. PATENT DOCUMENTS

| | | | |
|---|---|---|---|
| 9,560,917 | B2 | 2/2017 | Roslund, Jr. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,593,992 | B2 | 3/2017 | Wu |
| 9,604,092 | B2 | 3/2017 | Krull |
| 9,604,099 | B2 | 3/2017 | Taylor |
| 9,610,475 | B1 | 4/2017 | DeKnock et al. |
| 9,616,274 | B2 | 4/2017 | Wehrell |
| 9,616,284 | B1 | 4/2017 | Aganyan et al. |
| 9,616,292 | B2 | 4/2017 | Orfield |
| 9,623,285 | B1 | 4/2017 | Ruiz |
| 9,623,286 | B1 | 4/2017 | Chen |
| 9,630,048 | B2 | 4/2017 | Kaye et al. |
| 9,636,539 | B1 | 5/2017 | Brumit |
| 9,636,540 | B2 | 5/2017 | Mueller et al. |
| 9,643,042 | B2 | 5/2017 | Madden |
| 9,656,115 | B2 | 5/2017 | Young |
| 9,656,144 | B2 | 5/2017 | Jafarifesharaki |
| 9,656,591 | B1 | 5/2017 | Dumenigo |
| 9,669,261 | B2 | 6/2017 | Eder |
| 9,673,904 | B2 | 6/2017 | Palanisamy et al. |
| 9,675,836 | B2 | 6/2017 | Babon |
| 9,681,313 | B2 | 6/2017 | Malach |
| 9,682,267 | B2 | 6/2017 | Kaye et al. |
| 9,682,306 | B2 | 6/2017 | Lin et al. |
| 9,687,689 | B2 | 6/2017 | Lin |
| 9,694,234 | B2 | 7/2017 | Dalebout et al. |
| 9,700,752 | B1 | 7/2017 | Powers |
| 9,700,753 | B1 | 7/2017 | Boatwright |
| 9,700,780 | B2 | 7/2017 | Riley et al. |
| 9,707,435 | B1 | 7/2017 | Ferlito et al. |
| 9,707,441 | B2 | 7/2017 | Yang |
| 9,707,447 | B1 | 7/2017 | Lopez Babodilla |
| 9,720,912 | B2 | 8/2017 | Morimoto et al. |
| 9,724,553 | B2 | 8/2017 | Kaye et al. |
| 9,724,563 | B2 | 8/2017 | Schmidt |
| 9,731,158 | B1 | 8/2017 | Lo |
| 9,737,747 | B1 | 8/2017 | Walsh et al. |
| 9,750,454 | B2 | 9/2017 | Walke et al. |
| 9,757,605 | B2 | 9/2017 | Olson et al. |
| 9,757,611 | B1 | 9/2017 | Colburn |
| 9,764,184 | B2 | 9/2017 | Kueker et al. |
| 9,764,188 | B1 | 9/2017 | Aganyan et al. |
| 9,776,032 | B2 | 10/2017 | Moran et al. |
| 9,776,039 | B1 | 10/2017 | Xu |
| 9,782,625 | B1 | 10/2017 | Blum et al. |
| 9,795,819 | B2 | 10/2017 | Wehrell |
| 9,795,822 | B2 | 10/2017 | Smith et al. |
| 9,795,827 | B2 | 10/2017 | Wiener et al. |
| 9,795,855 | B2 | 10/2017 | Jafarifesharaki |
| 9,802,075 | B2 | 10/2017 | Gvoich |
| 9,808,673 | B2 | 11/2017 | Robinson |
| 9,814,920 | B1 | 11/2017 | Monterrey |
| 9,814,922 | B2 | 11/2017 | Moran et al. |
| 9,814,927 | B2 | 11/2017 | Forystek |
| 9,814,929 | B2 | 11/2017 | Moser |
| 9,814,930 | B2 | 11/2017 | Manzke et al. |
| 9,827,458 | B2 | 11/2017 | Dalton |
| 9,829,068 | B2 | 11/2017 | Marchetti |
| 9,833,654 | B1 | 12/2017 | Gant |
| 9,833,658 | B2 | 12/2017 | Wiener et al. |
| 9,841,077 | B2 | 12/2017 | Modrezejewski et al. |
| 9,849,330 | B2 | 12/2017 | Lagree |
| 9,868,006 | B1 | 1/2018 | Epler |
| 9,878,201 | B1 | 1/2018 | Moschel |
| 9,884,224 | B2 | 2/2018 | Spoeth et al. |
| 9,885,575 | B2 | 2/2018 | Collin |
| 9,889,334 | B2 | 2/2018 | Ashby et al. |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,907,396 | B1 | 3/2018 | Labrosse et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,921,726 | B1 | 3/2018 | Sculley et al. |
| 9,937,375 | B2 | 4/2018 | Zhu |
| 9,943,719 | B2 | 4/2018 | Smith et al. |
| 9,948,349 | B2 | 4/2018 | Malach |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,968,821 | B2 | 5/2018 | Finlayson et al. |
| 9,968,823 | B2 | 5/2018 | Cutler |
| 9,987,513 | B2 | 6/2018 | Yim et al. |
| 9,987,517 | B1 | 6/2018 | Kuo |
| 9,993,680 | B2 | 6/2018 | Gordon |
| 9,993,683 | B2 | 6/2018 | Moschel |
| 10,004,934 | B2 | 6/2018 | Pennington |
| 10,004,940 | B2 | 6/2018 | Badarneh |
| 10,010,745 | B1 | 7/2018 | Brumit |
| 10,016,646 | B2 | 7/2018 | Butler |
| 10,022,583 | B2 | 7/2018 | Wang |
| 10,022,590 | B2 | 7/2018 | Foley et al. |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0024998 | A1 | 9/2001 | Novak |
| 2001/0041647 | A1 | 11/2001 | Itoh |
| 2001/0049470 | A1 | 12/2001 | Mault et al. |
| 2001/0051564 | A1 | 12/2001 | Iund |
| 2001/0051566 | A1 | 12/2001 | Krull |
| 2002/0013200 | A1 | 1/2002 | Sechrest |
| 2002/0016235 | A1 | 2/2002 | Ashby et al. |
| 2002/0019298 | A1 | 2/2002 | Eschenbach |
| 2002/0022559 | A1 | 2/2002 | Krull |
| 2002/0024521 | A1 | 2/2002 | Goden |
| 2002/0025888 | A1 | 2/2002 | Germanton |
| 2002/0025891 | A1 | 2/2002 | Colosky et al. |
| 2002/0026130 | A1 | 2/2002 | West |
| 2002/0028733 | A1 | 3/2002 | Martens |
| 2002/0035017 | A1 | 3/2002 | Pertegaz-Esteban |
| 2002/0039952 | A1 | 4/2002 | Clem |
| 2002/0043909 | A1 | 4/2002 | Nielsen |
| 2002/0045519 | A1 | 4/2002 | Watterson |
| 2002/0049123 | A1 | 4/2002 | Krull |
| 2002/0052268 | A1 | 5/2002 | Morcillo-Quintero |
| 2002/0055418 | A1 | 5/2002 | Pyles et al. |
| 2002/0055419 | A1 | 5/2002 | Hinnebusch |
| 2002/0055420 | A1 | 5/2002 | Stearns et al. |
| 2002/0055422 | A1 | 5/2002 | Airmet |
| 2002/0055426 | A1 | 5/2002 | Krull |
| 2002/0066735 | A1 | 6/2002 | Hewlitt et al. |
| 2002/0072436 | A1 | 6/2002 | Liu |
| 2002/0077221 | A1 | 6/2002 | Dalebout et al. |
| 2002/0086779 | A1 | 7/2002 | Wilkinson |
| 2002/0091043 | A1 | 7/2002 | Rexach |
| 2002/0094914 | A1 | 7/2002 | Maresh et al. |
| 2002/0098957 | A1 | 7/2002 | Webber |
| 2002/0101880 | A1 | 8/2002 | Kim |
| 2002/0107058 | A1 | 8/2002 | Namba et al. |
| 2002/0115536 | A1 | 8/2002 | Hojo |
| 2002/0119870 | A1 | 8/2002 | Chen |
| 2002/0128127 | A1 | 9/2002 | Chen |
| 2002/0132703 | A1 | 9/2002 | Martinez |
| 2002/0132706 | A1 | 9/2002 | Sleamaker |
| 2002/0137605 | A1 | 9/2002 | Olsen |
| 2002/0142890 | A1 | 10/2002 | Ohrt |
| 2002/0147078 | A1 | 10/2002 | Wu |
| 2002/0151413 | A1 | 10/2002 | Dalebout |
| 2002/0160883 | A1 | 10/2002 | Dugan |
| 2002/0160891 | A1 | 10/2002 | Gallagher |
| 2002/0171070 | A1 | 11/2002 | Shim |
| 2002/0187879 | A1 | 12/2002 | Ball |
| 2002/0193213 | A1 | 12/2002 | Batca |
| 2002/0193214 | A1 | 12/2002 | Ish |
| 2002/0193215 | A1 | 12/2002 | Cheng |
| 2002/0198084 | A1 | 12/2002 | Stearns et al. |

(56) References Cited

U.S. PATENT DOCUMENTS

2003/0008731 A1 1/2003 Anderson et al.
2003/0017918 A1 1/2003 Webb et al.
2003/0022765 A1 1/2003 Wu
2003/0022770 A1 1/2003 Lee
2003/0032524 A1 2/2003 Lamar et al.
2003/0032528 A1 2/2003 Wu
2003/0032531 A1 2/2003 Simonson
2003/0032535 A1 2/2003 Wang
2003/0045406 A1 3/2003 Stone
2003/0060331 A1 3/2003 Polk
2003/0060344 A1 3/2003 David
2003/0060345 A1 3/2003 Piane
2003/0069108 A1 4/2003 Rubinstein
2003/0073545 A1 4/2003 Liu
2003/0078138 A1 4/2003 Toyama
2003/0087737 A1 5/2003 Studdard
2003/0089596 A1 5/2003 Tao et al.
2003/0092532 A1 5/2003 Giannelli et al.
2003/0092533 A1 5/2003 Hippensteel
2003/0092540 A1 5/2003 Gillen
2003/0092542 A1 5/2003 Bartholomew et al.
2003/0096675 A1 5/2003 Wang
2003/0096683 A1 5/2003 Fenelon
2003/0097878 A1 5/2003 Farringdon et al.
2003/0100406 A1 5/2003 Millington
2003/0100413 A1 5/2003 Huang
2003/0100415 A1 5/2003 Augustine et al.
2003/0104908 A1 6/2003 Tung
2003/0114276 A1 6/2003 Schiff
2003/0114281 A1 6/2003 Mackert
2003/0115955 A1 6/2003 Keiser
2003/0119635 A1 6/2003 Arbuckle
2003/0122384 A1 7/2003 Swanson et al.
2003/0125165 A1 7/2003 Trevino
2003/0128186 A1 7/2003 Laker
2003/0134714 A1 7/2003 Oishi et al.
2003/0134718 A1 7/2003 Kim
2003/0148853 A1 8/2003 Alessandri
2003/0148862 A1 8/2003 Chen
2003/0153434 A1 8/2003 Dalebout
2003/0153439 A1 8/2003 Krull
2003/0158016 A1 8/2003 Kolda
2003/0158019 A1 8/2003 Giannelli
2003/0158024 A1 8/2003 Saure
2003/0166434 A1 9/2003 Lopez-Santillana et al.
2003/0171189 A1 9/2003 Kaufman
2003/0171190 A1 9/2003 Rice
2003/0176261 A1 9/2003 Simonson et al.
2003/0176815 A1 9/2003 Baba et al.
2003/0181289 A1 9/2003 Oscar Moavro
2003/0181293 A1 9/2003 Baatz
2003/0183027 A1 10/2003 Koch
2003/0186792 A1 10/2003 Keeler
2003/0195089 A1 10/2003 Schroeder
2003/0199368 A1 10/2003 Krull
2003/0211916 A1 11/2003 Capuano
2003/0216227 A1 11/2003 Smith
2003/0216229 A1 11/2003 Bastyr
2003/0216230 A1 11/2003 Wang
2003/0222419 A1 12/2003 Geary
2003/0232703 A1 12/2003 Webber
2003/0232707 A1 12/2003 Dalebout et al.
2003/0236153 A1 12/2003 Pan et al.
2004/0005958 A1 1/2004 Kamen et al.
2004/0005961 A1 1/2004 Iund
2004/0005965 A1 1/2004 Panatta
2004/0009855 A1 1/2004 Webber
2004/0009856 A1 1/2004 Hammer
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0018920 A1 1/2004 Simonson
2004/0021046 A1 2/2004 Hutchison
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0025993 A1 2/2004 Russell
2004/0029645 A1 2/2004 Chen
2004/0033865 A1 2/2004 Wu
2004/0033866 A1 2/2004 Shapiro
2004/0043873 A1 3/2004 Wilkinson et al.
2004/0051392 A1 3/2004 Badarneh
2004/0053748 A1 3/2004 Lo et al.
2004/0053752 A1 3/2004 Yang
2004/0053756 A1 3/2004 Tremayne
2004/0063549 A1 4/2004 Kuo
2004/0067821 A1 4/2004 Kehrbaum
2004/0067833 A1 4/2004 Talish
2004/0072659 A1 4/2004 Alessandri
2004/0072661 A1 4/2004 Krull
2004/0072662 A1 4/2004 Landfair
2004/0077468 A1 4/2004 Myles
2004/0082444 A1 4/2004 Golesh
2004/0087420 A1 5/2004 Montesquieux
2004/0092367 A1 5/2004 Corbalis
2004/0097331 A1 5/2004 Zillig
2004/0097337 A1 5/2004 Chuang
2004/0097353 A1 5/2004 Mencis
2004/0100484 A1 5/2004 Barrett
2004/0103432 A1 5/2004 Barrett
2004/0114768 A1 6/2004 Luo
2004/0116258 A1 6/2004 Hyder
2004/0127335 A1 7/2004 Watterson
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0138032 A1 7/2004 Van Straaten
2004/0142799 A1 7/2004 Yeo
2004/0142800 A1 7/2004 Gerschefske
2004/0142801 A1 7/2004 Lin
2004/0144626 A1 7/2004 Saeki
2004/0152566 A1 8/2004 Yeh
2004/0155622 A1 8/2004 Mayhew et al.
2004/0157709 A1 8/2004 Olson
2004/0160336 A1 8/2004 Hoch
2004/0162189 A1 8/2004 Hickman
2004/0162191 A1 8/2004 Ercanbrack
2004/0162194 A1 8/2004 Habing
2004/0162196 A1 8/2004 Degroot
2004/0162198 A1 8/2004 Towley
2004/0163574 A1 8/2004 Schoenbach
2004/0166996 A1 8/2004 Kolda
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0185988 A1 9/2004 Hsiung
2004/0192514 A1 9/2004 Piaget et al.
2004/0198555 A1 10/2004 Anderson
2004/0198559 A1 10/2004 Grossi
2004/0198569 A1 10/2004 Sanford-Schwentke
2004/0198571 A1 10/2004 Howell et al.
2004/0204294 A2 10/2004 Wilkinson
2004/0208943 A1 10/2004 Miketin
2004/0214693 A1 10/2004 Piaget et al.
2004/0220025 A1 11/2004 Krull
2004/0224740 A1 11/2004 Ball et al.
2004/0224825 A1 11/2004 Giannelli et al.
2004/0224827 A1 11/2004 Ashley
2004/0242378 A1 12/2004 Pan
2004/0242379 A1 12/2004 Juva
2004/0242380 A1 12/2004 Kuivala
2004/0242388 A1 12/2004 Kusminsky

(56) References Cited

U.S. PATENT DOCUMENTS

2004/0248699 A1 12/2004 Colley
2004/0248713 A1 12/2004 Campanaro
2004/0254020 A1 12/2004 Dragusin
2004/0256524 A1 12/2004 Beck et al.
2004/0259689 A1 12/2004 Wilkins et al.
2004/0260191 A1 12/2004 Stubbs
2004/0266587 A1 12/2004 Miller
2004/0266591 A1 12/2004 Alessandri et al.
2004/0266961 A1 12/2004 Solan
2005/0003931 A1 1/2005 Mills et al.
2005/0003933 A1 1/2005 Kau
2005/0003938 A1 1/2005 Henderson
2005/0008992 A1 1/2005 Westergaard et al.
2005/0009668 A1 1/2005 Savettiere
2005/0009672 A1 1/2005 Yeh
2005/0013658 A1 1/2005 Muders et al.
2005/0014616 A1 1/2005 Tiahrt
2005/0023292 A1 2/2005 Market et al.
2005/0032610 A1 2/2005 Nelson
2005/0032611 A1 2/2005 Webber
2005/0037898 A1 2/2005 Chang
2005/0037904 A1 2/2005 Chang
2005/0043145 A1 2/2005 Anderson et al.
2005/0043146 A1 2/2005 Lo et al.
2005/0043155 A1 2/2005 Yannitte
2005/0044984 A1 3/2005 Jones
2005/0049117 A1 3/2005 Rodgers
2005/0049121 A1 3/2005 Dalebout
2005/0049123 A1 3/2005 Dalebout et al.
2005/0054492 A1 3/2005 Neff
2005/0061587 A1 3/2005 Tsai
2005/0064994 A1 3/2005 Matsumoto
2005/0065003 A1 3/2005 Klotzki
2005/0075213 A1 4/2005 Arick
2005/0079961 A1 4/2005 Dalebout
2005/0085348 A1 4/2005 Kiefer
2005/0085352 A1 4/2005 Baxter
2005/0090770 A1 4/2005 Chen
2005/0096187 A1 5/2005 Hsu
2005/0096189 A1 5/2005 Chen
2005/0096196 A1 5/2005 Webber
2005/0096197 A1 5/2005 Webber
2005/0096198 A1 5/2005 Webber
2005/0101458 A1 5/2005 Huang
2005/0101463 A1 5/2005 Chen
2005/0107220 A1 5/2005 Wang
2005/0113158 A1 5/2005 Sterchi et al.
2005/0113223 A1 5/2005 Dovner et al.
2005/0124471 A1 6/2005 Wilkinson
2005/0129253 A1 6/2005 Chen
2005/0129903 A1 6/2005 Carr
2005/0130807 A1 6/2005 Cutler
2005/0130814 A1 6/2005 Nitta et al.
2005/0131319 A1 6/2005 Der Meer
2005/0132838 A1 6/2005 Lin
2005/0143226 A1 6/2005 Heidecke
2005/0143228 A1 6/2005 Lee
2005/0143230 A1 6/2005 Dalebout
2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0148445 A1 7/2005 Carle
2005/0159273 A1 7/2005 Chen
2005/0159278 A1 7/2005 Mcvay
2005/0164837 A1 7/2005 Anderson
2005/0164838 A1 7/2005 Watterson
2005/0164839 A1 7/2005 Watterson
2005/0164853 A1 7/2005 Naidus
2005/0170935 A1 8/2005 Manser
2005/0170936 A1 8/2005 Quinn
2005/0170937 A1 8/2005 van Straaten
2005/0172311 A1 8/2005 Hjelt et al.
2005/0176560 A1 8/2005 Chen
2005/0178210 A1 8/2005 Lanham
2005/0181347 A1 8/2005 Barnes et al.
2005/0181911 A1 8/2005 Porth
2005/0181916 A1 8/2005 Frost et al.
2005/0187075 A1 8/2005 Bellamy
2005/0187082 A1 8/2005 Bowser
2005/0192162 A1 9/2005 Pan
2005/0192163 A1 9/2005 Pan et al.
2005/0196737 A1 9/2005 Mann
2005/0202934 A1 9/2005 Olrik et al.
2005/0209050 A1 9/2005 Bartels
2005/0209051 A1 9/2005 Santomassimo et al.
2005/0209052 A1 9/2005 Ashby
2005/0209060 A1 9/2005 Lull
2005/0209062 A1 9/2005 Anderson et al.
2005/0215397 A1 9/2005 Watterson
2005/0221962 A1 10/2005 Warner et al.
2005/0227820 A1 10/2005 Dyer et al.
2005/0227826 A1 10/2005 Oga
2005/0227831 A1 10/2005 Mills
2005/0227832 A1 10/2005 Wu
2005/0229367 A1 10/2005 Thompson
2005/0233861 A1 10/2005 Hickman
2005/0233871 A1 10/2005 Anders
2005/0233873 A1 10/2005 Chen
2005/0239600 A1 10/2005 Liang
2005/0239607 A1 10/2005 Chang
2005/0239612 A1 10/2005 Keiser
2005/0245365 A1 11/2005 Rolli
2005/0245370 A1 11/2005 Boland
2005/0248713 A1 11/2005 Hirosue et al.
2005/0250619 A1 11/2005 Daikeler et al.
2005/0250622 A1 11/2005 Chang
2005/0266961 A1 12/2005 Shum et al.
2005/0272562 A1 12/2005 Alessandri et al.
2005/0272564 A1 12/2005 Pyles et al.
2005/0272575 A1 12/2005 Melegati
2005/0272577 A1 12/2005 Olson
2005/0277520 A1 12/2005 Van Waes
2005/0277525 A1 12/2005 Liu
2005/0281963 A1 12/2005 Cook
2005/0283051 A1 12/2005 Chen
2005/0283911 A1 12/2005 Roussy
2005/0288155 A1 12/2005 Yang
2006/0003869 A1 1/2006 Huang et al.
2006/0003872 A1 1/2006 Chiles et al.
2006/0003876 A1 1/2006 Duhamel
2006/0003877 A1 1/2006 Harmon
2006/0004265 A1 1/2006 Pulkkinen et al.
2006/0009332 A1 1/2006 Jones
2006/0019804 A1 1/2006 Young
2006/0019806 A1 1/2006 Mikulski
2006/0021155 A1 2/2006 Lang et al.
2006/0025287 A1 2/2006 Chermack
2006/0030462 A1 2/2006 Ish, III
2006/0030465 A1 2/2006 Johnson
2006/0033392 A1 2/2006 Ritchey
2006/0035755 A1 2/2006 Dalebout
2006/0035757 A1 2/2006 Flick et al.
2006/0035758 A1 2/2006 Rogozinski
2006/0035764 A1 2/2006 Webber
2006/0035768 A1 2/2006 Kowallis
2006/0035772 A1 2/2006 Golesh et al.
2006/0040797 A1 2/2006 Chang
2006/0040798 A1 2/2006 Weier et al.
2006/0040810 A1 2/2006 Chu
2006/0046905 A1 3/2006 Doody, Jr.
2006/0047447 A1 3/2006 Brady et al.
2006/0052220 A1 3/2006 Jackson et al.
2006/0052222 A1 3/2006 Cardenas
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0068978 A1 3/2006 Moon
2006/0075544 A1 4/2006 Kriesel
2006/0079800 A1 4/2006 Martikka et al.
2006/0084422 A1 4/2006 Huang et al.

(56) References Cited

U.S. PATENT DOCUMENTS

2006/0084556 A1 4/2006 Payne
2006/0100069 A1 5/2006 Dibble et al.
2006/0100070 A1 5/2006 Abdo
2006/0100546 A1 5/2006 Silk
2006/0105889 A1 5/2006 Webb
2006/0116253 A1 6/2006 Nizam
2006/0116254 A1 6/2006 Webber
2006/0122035 A1 6/2006 Felix
2006/0122038 A1 6/2006 Chou Lin
2006/0122044 A1 6/2006 Ho
2006/0123814 A1 6/2006 Choi et al.
2006/0128534 A1 6/2006 Roque
2006/0128540 A1 6/2006 Engle
2006/0132070 A1 6/2006 Heydt et al.
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0160677 A1 7/2006 Piane, Jr.
2006/0160681 A1 7/2006 McBride et al.
2006/0166791 A1 7/2006 Liao
2006/0166798 A1 7/2006 Nelson
2006/0166799 A1 7/2006 Boland et al.
2006/0172862 A1 8/2006 Badarneh et al.
2006/0189439 A1 8/2006 Baudhuin
2006/0189440 A1 8/2006 Gravagne
2006/0189458 A1 8/2006 Walkerdine
2006/0189460 A1 8/2006 Katterjohn
2006/0189462 A1 8/2006 Pearson et al.
2006/0194679 A1 8/2006 Hatcher
2006/0199706 A1 9/2006 Wehrell
2006/0205568 A1 9/2006 Huang
2006/0205569 A1 9/2006 Watterson
2006/0205571 A1 9/2006 Krull
2006/0217236 A1 9/2006 Watterson
2006/0217240 A1 9/2006 White
2006/0217242 A1 9/2006 Karpachev
2006/0217245 A1 9/2006 Golesh et al.
2006/0223680 A1 10/2006 Chang
2006/0229163 A1 10/2006 Waters
2006/0232147 A1 10/2006 Cheng
2006/0234832 A1 10/2006 Toyama et al.
2006/0240947 A1 10/2006 Qu
2006/0240951 A1 10/2006 Wang
2006/0240956 A1 10/2006 Piane, Jr.
2006/0240959 A1 10/2006 Huang
2006/0244187 A1 11/2006 Downey
2006/0247107 A1 11/2006 Carter
2006/0247109 A1 11/2006 Powell
2006/0248965 A1 11/2006 Wyatt
2006/0251638 A1 11/2006 Guenzler-Pukall
2006/0252602 A1 11/2006 Brown
2006/0252608 A1 11/2006 Kang et al.
2006/0252612 A1 11/2006 Sofun
2006/0258513 A1 11/2006 Routley
2006/0258515 A1 11/2006 Kang et al.
2006/0258519 A1 11/2006 Ardito, III et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0281608 A1 12/2006 Tumminello
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2006/0293156 A1 12/2006 Trees
2007/0004561 A1 1/2007 Yoo
2007/0004562 A1 1/2007 Pan et al.
2007/0004569 A1 1/2007 Cao
2007/0006489 A1 1/2007 Case, Jr. et al.
2007/0010383 A1 1/2007 Pertegaz-Esteban
2007/0013655 A1 1/2007 Rosenberg et al.
2007/0015635 A1 1/2007 Donner
2007/0015636 A1 1/2007 Molter
2007/0015644 A1 1/2007 Aucamp
2007/0017025 A1 1/2007 Myer
2007/0018465 A1 1/2007 Vassilakos
2007/0021280 A1 1/2007 Tyree
2007/0027002 A1 2/2007 Clark et al.
2007/0027003 A1 2/2007 Clark
2007/0032353 A1 2/2007 Wilkins et al.
2007/0037667 A1 2/2007 Gordon
2007/0037676 A1 2/2007 Denisco
2007/0038137 A1 2/2007 Arand et al.
2007/0042868 A1 2/2007 Fisher
2007/0042878 A1 2/2007 Lundquist
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0057001 A1 3/2007 Wang
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0087918 A1 4/2007 Towley, III et al.
2007/0087920 A1 4/2007 Dachraoui et al.
2007/0093369 A1 4/2007 Bocchicchio
2007/0099780 A1 5/2007 Bowser
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135272 A1 6/2007 Stuckey
2007/0135276 A1 6/2007 Alessandri
2007/0135279 A1 6/2007 Purdy et al.
2007/0137331 A1 6/2007 Kachouh
2007/0141871 A1 6/2007 Scherer et al.
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0149363 A1 6/2007 Wang
2007/0151489 A1 7/2007 Byrne
2007/0155277 A1 7/2007 Amitai et al.
2007/0155495 A1 7/2007 Goo
2007/0155600 A1 7/2007 Cunningham et al.
2007/0161466 A1 7/2007 Oglesby et al.
2007/0161468 A1 7/2007 Yanagisawa
2007/0161470 A1 7/2007 Berryman
2007/0161472 A1 7/2007 Drechsler
2007/0161480 A1 7/2007 Trancart
2007/0167292 A1 7/2007 Kuo
2007/0167299 A1 7/2007 Simonson et al.
2007/0167300 A1 7/2007 Krull
2007/0173384 A1 7/2007 Sechrest et al.
2007/0176035 A1 8/2007 Campbell
2007/0179023 A1 8/2007 Dyer
2007/0179030 A1 8/2007 Slawinski
2007/0184944 A1 8/2007 Huang
2007/0184953 A1 8/2007 Luberski et al.
2007/0190508 A1 8/2007 Dalton
2007/0191141 A1 8/2007 Weber
2007/0191190 A1 8/2007 Kuo
2007/0191197 A1 8/2007 Vittone
2007/0197274 A1 8/2007 Dugan
2007/0197345 A1 8/2007 Wallace et al.
2007/0197346 A1 8/2007 Seliber
2007/0197920 A1 8/2007 Adams
2007/0201727 A1 8/2007 Birrell et al.

(56) References Cited

U.S. PATENT DOCUMENTS

2007/0202992 A1 8/2007 Grasshoff
2007/0203001 A1 8/2007 Krull
2007/0204430 A1 9/2007 Chase
2007/0207902 A1 9/2007 Tiahrt
2007/0213185 A1 9/2007 Habing
2007/0214630 A1 9/2007 Kim
2007/0219062 A1 9/2007 Rodgers
2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225136 A1 9/2007 Roman
2007/0225622 A1 9/2007 Huang et al.
2007/0232455 A1 10/2007 Hanoun
2007/0232461 A1 10/2007 Jenkins et al.
2007/0232462 A1 10/2007 Webber
2007/0243975 A1 10/2007 Gearon
2007/0245612 A1 10/2007 Tresenfeld
2007/0247320 A1 10/2007 Morahan
2007/0249467 A1 10/2007 Hong et al.
2007/0254785 A1 11/2007 Lin
2007/0259759 A1 11/2007 Sumners et al.
2007/0259763 A1 11/2007 McKeown et al.
2007/0260184 A1 11/2007 Justis et al.
2007/0260255 A1 11/2007 Haddock et al.
2007/0270284 A1 11/2007 Lin
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0281836 A1 12/2007 Gearon
2007/0284495 A1 12/2007 Charles
2007/0287600 A1 12/2007 Prenatt
2007/0287601 A1 12/2007 Burck et al.
2007/0287606 A1 12/2007 Mac Millan
2007/0287611 A1 12/2007 Januszek
2007/0293377 A1 12/2007 Webber
2007/0293378 A1 12/2007 Webber
2007/0296313 A1 12/2007 Wang
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0001866 A1 1/2008 Martin
2008/0004162 A1 1/2008 Chen
2008/0015089 A1 1/2008 Hurwitz
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0020911 A1 1/2008 Castello Neto
2008/0020912 A1 1/2008 Dalebout et al.
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0032873 A1 2/2008 Towley
2008/0039301 A1 2/2008 Halbridge
2008/0039302 A1 2/2008 Grant
2008/0046246 A1 2/2008 Hakki
2008/0051260 A1 2/2008 Simonson et al.
2008/0057889 A1 3/2008 Jan
2008/0058169 A1 3/2008 Fox
2008/0058170 A1 3/2008 Giannascoli et al.
2008/0058172 A1 3/2008 Tyree
2008/0058176 A1 3/2008 Webber et al.
2008/0058177 A1 3/2008 Webber
2008/0064576 A1 3/2008 Tyree
2008/0067302 A1 3/2008 Olivera
2008/0070755 A1 3/2008 Mckee
2008/0070756 A1 3/2008 Chu
2008/0070761 A1 3/2008 Lin
2008/0070765 A1 3/2008 Brown et al.
2008/0070766 A1 3/2008 Brown et al.
2008/0076637 A1 3/2008 Gilley et al.
2008/0076972 A1 3/2008 Dorogusker et al.
2008/0077619 A1 3/2008 Gilley et al.
2008/0085819 A1 4/2008 Yang et al.
2008/0085820 A1 4/2008 Majkrzak
2008/0085821 A1 4/2008 Webb
2008/0086318 A1 4/2008 Gilley et al.
2008/0090703 A1 4/2008 Rosenberg
2008/0096726 A1 4/2008 Riley et al.
2008/0096735 A1 4/2008 Grider
2008/0096745 A1 4/2008 Perry
2008/0103024 A1 5/2008 Habing
2008/0103034 A1 5/2008 Mihara et al.
2008/0108483 A1 5/2008 Fife
2008/0108917 A1 5/2008 Joutras et al.
2008/0119333 A1 5/2008 Bowser
2008/0132386 A1 6/2008 Helie
2008/0132389 A1 6/2008 Webber et al.
2008/0132391 A1 6/2008 Edeker
2008/0139370 A1 6/2008 Charnitski
2008/0146418 A1 6/2008 Summers
2008/0153670 A1 6/2008 Mckirdy
2008/0153676 A1 6/2008 Krietzman
2008/0153677 A1 6/2008 Webber et al.
2008/0153682 A1 6/2008 Chen et al.
2008/0155077 A1 6/2008 James
2008/0161168 A1 7/2008 Hsiao
2008/0161170 A1 7/2008 Lumpee
2008/0171640 A1 7/2008 Chang
2008/0171922 A1 7/2008 Teller
2008/0176717 A1 7/2008 Wang
2008/0176718 A1 7/2008 Wang
2008/0176722 A1 7/2008 Steffee
2008/0182724 A1 7/2008 Guthrie
2008/0182731 A1 7/2008 Vittone
2008/0182732 A1 7/2008 Webber et al.
2008/0187689 A1 8/2008 Dierkens et al.
2008/0188362 A1 8/2008 Chen
2008/0190745 A1 8/2008 Taniguchi et al.
2008/0191864 A1 8/2008 Wolfson
2008/0200287 A1 8/2008 Marty et al.
2008/0200310 A1 8/2008 Tagliabue
2008/0200314 A1 8/2008 Dalebout et al.
2008/0200853 A1 8/2008 Tielve
2008/0204225 A1 8/2008 Kitchen
2008/0207407 A1 8/2008 Yeh
2008/0207415 A1 8/2008 Tsai
2008/0214358 A1 9/2008 Ogg et al.
2008/0214365 A1 9/2008 Webber et al.
2008/0214367 A1 9/2008 Webber et al.
2008/0214971 A1 9/2008 Talish
2008/0216717 A1 9/2008 Jones
2008/0220941 A1 9/2008 Shaw
2008/0227607 A1 9/2008 Nizam
2008/0229875 A1 9/2008 Ray
2008/0234110 A1 9/2008 Webber et al.
2008/0234111 A1 9/2008 Packham
2008/0242511 A1 10/2008 Munoz et al.
2008/0242512 A1 10/2008 Kim
2008/0242520 A1 10/2008 Hubbard
2008/0244870 A1 10/2008 Chase
2008/0245944 A1 10/2008 Chase
2008/0248926 A1 10/2008 Cole et al.
2008/0248929 A1 10/2008 Webber et al.
2008/0248935 A1 10/2008 Solow
2008/0250729 A1 10/2008 Kriesel
2008/0255794 A1 10/2008 Levine
2008/0261785 A1 10/2008 Albanese
2008/0269017 A1 10/2008 Ungari
2008/0279896 A1 11/2008 Heinen et al.
2008/0280731 A1 11/2008 Dalebout et al.
2008/0280732 A1 11/2008 Jones
2008/0280733 A1 11/2008 Dickie et al.
2008/0280734 A1 11/2008 Dickie et al.

(56) References Cited

U.S. PATENT DOCUMENTS

2008/0280735 A1 11/2008 Dickie et al.
2008/0287262 A1 11/2008 Chou
2008/0287270 A1 11/2008 Carter
2008/0300110 A1 12/2008 Smith et al.
2008/0300114 A1 12/2008 Dalebout
2008/0300115 A1 12/2008 Erlandson
2008/0300116 A1 12/2008 Eder
2008/0300118 A1 12/2008 Wehrell
2008/0300914 A1 12/2008 Karkanias et al.
2008/0305936 A1 12/2008 Cao
2008/0312047 A1 12/2008 Feng
2008/0312052 A1 12/2008 Krietzman
2008/0318737 A1 12/2008 Chu
2008/0318738 A1 12/2008 Chen
2008/0318743 A1 12/2008 Bizzell
2008/0318744 A1 12/2008 Barra
2009/0005224 A1 1/2009 Davis et al.
2009/0018000 A1 1/2009 Brown
2009/0023553 A1 1/2009 Shim
2009/0023556 A1 1/2009 Daly
2009/0023562 A1 1/2009 Lamarque
2009/0027925 A1 1/2009 Kanouda et al.
2009/0029831 A1 1/2009 Weier
2009/0029834 A1 1/2009 Isom
2009/0036276 A1 2/2009 Loach
2009/0036277 A1 2/2009 Ish, III et al.
2009/0042696 A1 2/2009 Wang
2009/0042698 A1 2/2009 Wang
2009/0047645 A1 2/2009 Dibenedetto et al.
2009/0048044 A1 2/2009 Oleson et al.
2009/0048073 A1 2/2009 Roimicher
2009/0048074 A1 2/2009 Kamins
2009/0048079 A1 2/2009 Nalley
2009/0048493 A1 2/2009 James et al.
2009/0053682 A1 2/2009 Stern
2009/0054214 A1 2/2009 Kadar
2009/0054751 A1 2/2009 Babashan et al.
2009/0062072 A1 3/2009 Packham
2009/0069159 A1 3/2009 Wang
2009/0075781 A1 3/2009 Schwarzberg et al.
2009/0075784 A1 3/2009 Hoggan
2009/0075793 A1 3/2009 Trainor
2009/0080808 A1 3/2009 Hagen
2009/0082176 A1 3/2009 Watterson et al.
2009/0088301 A1 4/2009 Alling
2009/0093319 A1 4/2009 Omidi
2009/0093347 A1 4/2009 Wang
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0118098 A1 5/2009 Yeh
2009/0118103 A1 5/2009 Ellis
2009/0118105 A1 5/2009 Schiff
2009/0119032 A1 5/2009 Meyer
2009/0120208 A1 5/2009 Meyer
2009/0120210 A1 5/2009 Phillips et al.
2009/0124463 A1 5/2009 Lin
2009/0124464 A1 5/2009 Kastelic
2009/0124465 A1 5/2009 Wang
2009/0124466 A1 5/2009 Zhang
2009/0124470 A1 5/2009 Yu
2009/0128516 A1 5/2009 Rimon et al.
2009/0131230 A1 5/2009 Cole
2009/0131231 A1 5/2009 Smith
2009/0137367 A1 5/2009 Hendrickson et al.
2009/0137370 A1 5/2009 Kushnir
2009/0143201 A1 6/2009 Uygan
2009/0144639 A1 6/2009 Nims et al.
2009/0149302 A1 6/2009 Thuma
2009/0156363 A1 6/2009 Guidi et al.
2009/0156364 A1 6/2009 Simeoni
2009/0158871 A1 6/2009 Chuo
2009/0163326 A1 6/2009 Wang
2009/0163327 A1 6/2009 Huang et al.
2009/0163331 A1 6/2009 Lacher
2009/0163334 A1 6/2009 Gibson et al.
2009/0170663 A1 7/2009 Cox et al.
2009/0170667 A1 7/2009 Irving et al.
2009/0170668 A1 7/2009 Giannelli et al.
2009/0170669 A1 7/2009 Giannelli et al.
2009/0170672 A1 7/2009 Mcmullen
2009/0170675 A1 7/2009 Giannelli et al.
2009/0176625 A1 7/2009 Giannelli et al.
2009/0176628 A1 7/2009 Radding et al.
2009/0180646 A1 7/2009 Vulfson et al.
2009/0181829 A1 7/2009 Wu
2009/0181830 A1 7/2009 Wu
2009/0181831 A1 7/2009 Kuo
2009/0181833 A1 7/2009 Cassidy
2009/0186748 A1 7/2009 Golesh et al.
2009/0186749 A1 7/2009 Zhou
2009/0193796 A1 8/2009 Wei et al.
2009/0196417 A1 8/2009 Beaver et al.
2009/0197739 A1 8/2009 Hashimoto
2009/0197740 A1 8/2009 Julskjaer et al.
2009/0197745 A1 8/2009 Olson
2009/0203501 A1 8/2009 Rodgers, Jr.
2009/0209393 A1 8/2009 Crater et al.
2009/0215594 A1 8/2009 Panaiotov
2009/0221405 A1 9/2009 Wang
2009/0221407 A1 9/2009 Hauk
2009/0227424 A1 9/2009 Hirata et al.
2009/0227428 A1 9/2009 Tamari
2009/0227432 A1 9/2009 Pacheco
2009/0232420 A1 9/2009 Eisenberg et al.
2009/0240858 A1 9/2009 Takebayashi
2009/0246746 A1 10/2009 Roerdink et al.
2009/0247376 A1 10/2009 Merrithew et al.
2009/0253554 A1 10/2009 Mcintosh
2009/0258710 A1 10/2009 Quatrochi et al.
2009/0258763 A1 10/2009 Richter
2009/0264258 A1 10/2009 Lo
2009/0264260 A1 10/2009 Piaget et al.
2009/0269728 A1 10/2009 Verstegen et al.
2009/0270234 A1 10/2009 Alessandri et al.
2009/0280964 A1 11/2009 Lin
2009/0286653 A1 11/2009 Wiber
2009/0293319 A1 12/2009 Avni
2009/0305852 A1 12/2009 Svenberg
2009/0312158 A1 12/2009 Trevino et al.
2010/0003573 A1 1/2010 Jeanne et al.
2010/0004104 A1 1/2010 Gustafson
2010/0005624 A1 1/2010 Swearingen
2010/0009810 A1 1/2010 Trzecieski
2010/0015585 A1 1/2010 Baker
2010/0016127 A1 1/2010 Farnsworth et al.
2010/0016129 A1 1/2010 Chou
2010/0019593 A1 1/2010 Ritchey
2010/0022354 A1 1/2010 Fisher
2010/0024590 A1 2/2010 O'neill
2010/0031803 A1 2/2010 Lozada et al.
2010/0032533 A1 2/2010 Chen et al.
2010/0034665 A1 2/2010 Zhong et al.
2010/0035726 A1 2/2010 Fisher et al.
2010/0041516 A1 2/2010 Kodama
2010/0041526 A1 2/2010 Bowser et al.
2010/0048358 A1 2/2010 Tchao et al.
2010/0048368 A1 2/2010 Donofrio
2010/0056345 A1 3/2010 Liu
2010/0062904 A1 3/2010 Crawford et al.
2010/0062914 A1 3/2010 Splane
2010/0063426 A1 3/2010 Planke
2010/0064255 A1 3/2010 Rottler et al.
2010/0069202 A1 3/2010 Olsen
2010/0075812 A1 3/2010 Piaget et al.
2010/0079291 A1 4/2010 Kroll et al.
2010/0081548 A1 4/2010 Labedz
2010/0087298 A1 4/2010 Zaccherini

(56) References Cited

U.S. PATENT DOCUMENTS

2010/0093492 A1 4/2010 Watterson et al.
2010/0093493 A1 4/2010 Eldridge
2010/0099541 A1 4/2010 Patel
2010/0105527 A1 4/2010 Johnson
2010/0105530 A1 4/2010 Kaisha
2010/0113223 A1 5/2010 Chiles et al.
2010/0125026 A1 5/2010 Zavadsky et al.
2010/0130337 A1 5/2010 Stewart
2010/0137105 A1 6/2010 McLaughlin
2010/0137114 A1 6/2010 Keiser
2010/0144500 A1 6/2010 Canali
2010/0144501 A1 6/2010 Berhanu
2010/0156625 A1 6/2010 Ruha
2010/0156760 A1 6/2010 Cheswick
2010/0164579 A1 7/2010 Acatrinei
2010/0167883 A1 7/2010 Grind
2010/0173276 A1 7/2010 Vasin
2010/0173755 A1 7/2010 P Erez De Lazarraga
2010/0173759 A1 7/2010 Lalaoua
2010/0175634 A1 7/2010 Chang et al.
2010/0178981 A1 7/2010 Holcomb
2010/0179032 A1 7/2010 Perry
2010/0179035 A1 7/2010 Carnahan
2010/0184568 A1 7/2010 Schippers
2010/0184570 A1 7/2010 Cheng
2010/0190615 A1 7/2010 Baker et al.
2010/0192715 A1 8/2010 Vauchel et al.
2010/0197462 A1 8/2010 Piane, Jr. et al.
2010/0197465 A1 8/2010 Stevenson
2010/0210418 A1 8/2010 Park
2010/0216599 A1 8/2010 Watterson
2010/0216600 A1 8/2010 Noffsinger
2010/0216607 A1 8/2010 Mueller
2010/0216610 A1 8/2010 Gedeon-Janvier
2010/0222179 A1 9/2010 Temple et al.
2010/0222182 A1 9/2010 Park
2010/0227740 A1 9/2010 Liu
2010/0233664 A1 9/2010 Wroclawsky
2010/0234184 A1 9/2010 Le Page
2010/0234185 A1 9/2010 Watt et al.
2010/0234193 A1 9/2010 Friedman
2010/0235667 A1 9/2010 Mucignat et al.
2010/0240458 A1 9/2010 Gaiba et al.
2010/0240493 A1 9/2010 Wang
2010/0248899 A1 9/2010 Bedell et al.
2010/0248900 A1 9/2010 Ashby
2010/0248917 A1 9/2010 Reyes
2010/0255959 A1 10/2010 Dalebout et al.
2010/0255965 A1 10/2010 Chen
2010/0267524 A1 10/2010 Stewart et al.
2010/0279822 A1 11/2010 Ford
2010/0285933 A1 11/2010 Nalley
2010/0285935 A1 11/2010 Barnett
2010/0289466 A1 11/2010 Telefus
2010/0289772 A1 11/2010 Miller
2010/0292050 A1 11/2010 DiBenedetto et al.
2010/0292056 A1 11/2010 Birch
2010/0292600 A1 11/2010 Dibenedetto et al.
2010/0298104 A1 11/2010 Turner
2010/0298106 A1 11/2010 Bowser
2010/0302250 A1 12/2010 Hoebel
2010/0304931 A1 12/2010 Stumpf
2010/0304932 A1 12/2010 Kolman et al.
2010/0304934 A1 12/2010 Woodson
2010/0304938 A1 12/2010 Olson
2010/0304939 A1 12/2010 Svenberg
2010/0304940 A1 12/2010 Svenberg
2010/0311552 A1 12/2010 Sumners
2010/0317488 A1 12/2010 Cartaya
2010/0317496 A1 12/2010 Abranchess
2010/0320956 A1 12/2010 Lumsden et al.
2010/0323852 A1 12/2010 Locsin
2010/0327603 A1 12/2010 Suaan
2010/0331151 A1 12/2010 Signorile et al.
2010/0331153 A1 12/2010 Johnson
2011/0000024 A1 1/2011 Johnson et al.
2011/0003664 A1 1/2011 Richard
2011/0009249 A1 1/2011 Campanaro et al.
2011/0021319 A1 1/2011 Nissila et al.
2011/0021323 A1 1/2011 Wu
2011/0028282 A1 2/2011 Sbragia
2011/0028286 A1 2/2011 Nortje
2011/0034300 A1 2/2011 Hall
2011/0045956 A1 2/2011 Colledge
2011/0048141 A1 3/2011 Svenberg
2011/0054359 A1 3/2011 Knopfle et al.
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0075835 A1 3/2011 Hill
2011/0077055 A1 3/2011 Pakula et al.
2011/0077128 A1 3/2011 Hamada et al.
2011/0082006 A1 4/2011 Ishii
2011/0082011 A1 4/2011 Ellis
2011/0082013 A1 4/2011 Bastian
2011/0082015 A1 4/2011 Dreissigacker et al.
2011/0082017 A1 4/2011 Arlie
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0111925 A1 5/2011 Hobson
2011/0112771 A1 5/2011 French
2011/0118089 A1 5/2011 Ellis
2011/0118090 A1 5/2011 Ellis
2011/0119027 A1 5/2011 Zhu et al.
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143890 A1 6/2011 Reyes
2011/0143898 A1 6/2011 Trees
2011/0152032 A1 6/2011 Barnett
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0163206 A1 7/2011 Bandera
2011/0165995 A1 7/2011 Paulus
2011/0165996 A1 7/2011 Paulus
2011/0165997 A1 7/2011 Reich
2011/0172058 A1 7/2011 Deaconu
2011/0172060 A1 7/2011 Morales et al.
2011/0172068 A1 7/2011 Tyson, III
2011/0175744 A1 7/2011 Englert et al.
2011/0177921 A1 7/2011 Olson
2011/0181420 A1 7/2011 Mack et al.
2011/0185309 A1 7/2011 Challinor et al.
2011/0188269 A1 8/2011 Hosotani
2011/0188980 A1 8/2011 Pumroy
2011/0190096 A1 8/2011 Clarke
2011/0195819 A1 8/2011 Shaw
2011/0195825 A1 8/2011 Liester
2011/0197157 A1 8/2011 Hoffman et al.
2011/0199799 A1 8/2011 Hui et al.
2011/0201481 A1 8/2011 Lo
2011/0202236 A1 8/2011 Galasso et al.
2011/0205164 A1 8/2011 Hansen et al.
2011/0207584 A1 8/2011 Webber et al.
2011/0221672 A1 9/2011 Osterhout et al.
2011/0224058 A1 9/2011 Webber et al.
2011/0227268 A1 9/2011 Zheng
2011/0237396 A1 9/2011 Lu
2011/0237399 A1 9/2011 Toback
2011/0237405 A1 9/2011 Reyes
2011/0237407 A1 9/2011 Kale

(56) References Cited

U.S. PATENT DOCUMENTS

| | | | |
|---|---|---|---|
| 2011/0240403 | A1 | 10/2011 | Meillet |
| 2011/0247530 | A1 | 10/2011 | Coffman |
| 2011/0251021 | A1 | 10/2011 | Zavadsky et al. |
| 2011/0251023 | A1 | 10/2011 | Fedriga |
| 2011/0251033 | A1 | 10/2011 | Blancher |
| 2011/0252597 | A1 | 10/2011 | Burris et al. |
| 2011/0256988 | A1 | 10/2011 | Weier |
| 2011/0257797 | A1 | 10/2011 | Burris et al. |
| 2011/0263384 | A1 | 10/2011 | Drazan |
| 2011/0269604 | A1 | 11/2011 | Tseng |
| 2011/0275482 | A1 | 11/2011 | Brodess et al. |
| 2011/0275489 | A1 | 11/2011 | Apau |
| 2011/0275496 | A1 | 11/2011 | Chou |
| 2011/0275499 | A1 | 11/2011 | Eschenbach |
| 2011/0281249 | A1 | 11/2011 | Gammell et al. |
| 2011/0281691 | A1 | 11/2011 | Ellis |
| 2011/0283188 | A1 | 11/2011 | Farrenkopf et al. |
| 2011/0283231 | A1 | 11/2011 | Richstein et al. |
| 2011/0287905 | A1 | 11/2011 | Reyes |
| 2011/0306480 | A1 | 12/2011 | Beaulieu et al. |
| 2011/0308919 | A1 | 12/2011 | Hahn |
| 2011/0312473 | A1 | 12/2011 | Chu et al. |
| 2011/0312475 | A1 | 12/2011 | Towley, III |
| 2011/0319229 | A1 | 12/2011 | Corbalis et al. |
| 2011/0319230 | A1 | 12/2011 | Brendle |
| 2012/0004074 | A1 | 1/2012 | Schelzig |
| 2012/0004075 | A1 | 1/2012 | Kissel et al. |
| 2012/0004080 | A1 | 1/2012 | Webb |
| 2012/0010053 | A1 | 1/2012 | Bayerlein et al. |
| 2012/0015778 | A1 | 1/2012 | Lee et al. |
| 2012/0015779 | A1 | 1/2012 | Powch et al. |
| 2012/0015784 | A1 | 1/2012 | Reed |
| 2012/0015787 | A2 | 1/2012 | Strong Crawley |
| 2012/0020135 | A1 | 1/2012 | McCune |
| 2012/0021873 | A1 | 1/2012 | Brunner |
| 2012/0021875 | A1 | 1/2012 | Karl |
| 2012/0021876 | A1 | 1/2012 | Hsiung |
| 2012/0021877 | A1 | 1/2012 | Lundquist et al. |
| 2012/0029666 | A1 | 2/2012 | Crowley et al. |
| 2012/0032896 | A1 | 2/2012 | Vesely |
| 2012/0035024 | A1 | 2/2012 | Price |
| 2012/0046144 | A1 | 2/2012 | Lin et al. |
| 2012/0053024 | A1 | 3/2012 | Mendoza |
| 2012/0071301 | A1 | 3/2012 | Kaylor et al. |
| 2012/0083395 | A1 | 4/2012 | Carson |
| 2012/0083396 | A1 | 4/2012 | Aquino |
| 2012/0088633 | A1 | 4/2012 | Crafton |
| 2012/0088634 | A1 | 4/2012 | Heidecke |
| 2012/0088638 | A1 | 4/2012 | Lull |
| 2012/0088640 | A1 | 4/2012 | Wissink |
| 2012/0094809 | A1 | 4/2012 | Nishimura |
| 2012/0115682 | A1 | 5/2012 | Homsi |
| 2012/0115689 | A1 | 5/2012 | Dalebout et al. |
| 2012/0115691 | A1 | 5/2012 | Munroe |
| 2012/0115695 | A1 | 5/2012 | Watterson et al. |
| 2012/0116684 | A1 | 5/2012 | Ingrassia et al. |
| 2012/0129653 | A1 | 5/2012 | Shalev |
| 2012/0132877 | A1 | 5/2012 | Wang |
| 2012/0133192 | A1 | 5/2012 | Simpson |
| 2012/0142503 | A1 | 6/2012 | Sevadjian |
| 2012/0158238 | A1 | 6/2012 | Daley |
| 2012/0165162 | A1 | 6/2012 | Lu |
| 2012/0169603 | A1 | 7/2012 | Peterson et al. |
| 2012/0174833 | A1 | 7/2012 | Early |
| 2012/0178590 | A1 | 7/2012 | Lu |
| 2012/0178591 | A1 | 7/2012 | Remelius |
| 2012/0178596 | A1 | 7/2012 | Vittone |
| 2012/0183939 | A1 | 7/2012 | Aragones et al. |
| 2012/0183940 | A1 | 7/2012 | Aragones et al. |
| 2012/0187012 | A1 | 7/2012 | TeVault et al. |
| 2012/0190502 | A1 | 7/2012 | Paulus et al. |
| 2012/0212505 | A1 | 8/2012 | Burroughs et al. |
| 2012/0216524 | A1 | 8/2012 | Browne |
| 2012/0218184 | A1 | 8/2012 | Wissmar |
| 2012/0220434 | A1 | 8/2012 | Lien |
| 2012/0225758 | A1 | 9/2012 | Shaw |
| 2012/0230504 | A1 | 9/2012 | Kuroda |
| 2012/0238411 | A1 | 9/2012 | McBride et al. |
| 2012/0238418 | A1 | 9/2012 | Reyes |
| 2012/0242774 | A1 | 9/2012 | Toshiba |
| 2012/0248263 | A1 | 10/2012 | Grotenhuis |
| 2012/0252580 | A1 | 10/2012 | Dugan |
| 2012/0252642 | A1 | 10/2012 | Chen |
| 2012/0253234 | A1 | 10/2012 | Yang et al. |
| 2012/0253485 | A1 | 10/2012 | Weast et al. |
| 2012/0253489 | A1 | 10/2012 | Dugan |
| 2012/0263892 | A1 | 10/2012 | Rodgers |
| 2012/0264575 | A1 | 10/2012 | Towley, III |
| 2012/0270705 | A1 | 10/2012 | Lo |
| 2012/0271143 | A1 | 10/2012 | Aragones et al. |
| 2012/0277040 | A1 | 11/2012 | Vincent et al. |
| 2012/0277068 | A1 | 11/2012 | Zhou et al. |
| 2012/0277070 | A1 | 11/2012 | Sienna |
| 2012/0277891 | A1 | 11/2012 | Aragones et al. |
| 2012/0283071 | A1 | 11/2012 | Nalley |
| 2012/0283074 | A1 | 11/2012 | Hutchins |
| 2012/0289386 | A1 | 11/2012 | Yu |
| 2012/0293141 | A1 | 11/2012 | Zhang et al. |
| 2012/0295774 | A1 | 11/2012 | Dalebout et al. |
| 2012/0296455 | A1 | 11/2012 | Ohnemus et al. |
| 2012/0298017 | A1 | 11/2012 | Chen |
| 2012/0300515 | A1 | 11/2012 | Carletti et al. |
| 2012/0302408 | A1 | 11/2012 | Burger |
| 2012/0319604 | A1 | 12/2012 | Walters |
| 2012/0322625 | A1 | 12/2012 | Park |
| 2012/0322629 | A1 | 12/2012 | Webb |
| 2012/0326873 | A1 | 12/2012 | Utter, II |
| 2012/0329615 | A1 | 12/2012 | Jeong |
| 2013/0002533 | A1 | 1/2013 | Burroughs et al. |
| 2013/0004010 | A1 | 1/2013 | Royer |
| 2013/0009993 | A1 | 1/2013 | Horseman |
| 2013/0017929 | A1 | 1/2013 | Hendrickson et al. |
| 2013/0023933 | A1 | 1/2013 | Haas |
| 2013/0034671 | A1 | 2/2013 | George |
| 2013/0035219 | A1 | 2/2013 | Williams |
| 2013/0035220 | A1 | 2/2013 | Adams |
| 2013/0035612 | A1 | 2/2013 | Mason et al. |
| 2013/0040783 | A1 | 2/2013 | Duda et al. |
| 2013/0041590 | A1 | 2/2013 | Burich et al. |
| 2013/0041617 | A1 | 2/2013 | Pease et al. |
| 2013/0044521 | A1 | 2/2013 | Zhao et al. |
| 2013/0050973 | A1 | 2/2013 | Rohrbach |
| 2013/0053220 | A1 | 2/2013 | Monaco |
| 2013/0053222 | A1 | 2/2013 | Lo |
| 2013/0053990 | A1 | 2/2013 | Ackland |
| 2013/0090212 | A1 | 4/2013 | Wang |
| 2013/0092647 | A1 | 4/2013 | Chen |
| 2013/0095959 | A1 | 4/2013 | Marty |
| 2013/0095978 | A1 | 4/2013 | Sauter |
| 2013/0102443 | A1 | 4/2013 | Lundquist et al. |
| 2013/0110264 | A1 | 5/2013 | Weast et al. |
| 2013/0116093 | A1 | 5/2013 | Kehoe |
| 2013/0116095 | A1 | 5/2013 | Hsieh |
| 2013/0116605 | A1 | 5/2013 | Dephouse |
| 2013/0123073 | A1 | 5/2013 | Olson et al. |
| 2013/0123083 | A1 | 5/2013 | Sip |
| 2013/0130868 | A1 | 5/2013 | Hou |
| 2013/0130869 | A1 | 5/2013 | Hou |
| 2013/0139736 | A1 | 6/2013 | Flaherty |
| 2013/0141235 | A1 | 6/2013 | Utter, II |
| 2013/0143721 | A1 | 6/2013 | Dalebout |
| 2013/0147411 | A1 | 6/2013 | Pang et al. |
| 2013/0150214 | A1 | 6/2013 | Wu |
| 2013/0154441 | A1 | 6/2013 | Redmond |
| 2013/0165297 | A1 | 6/2013 | Daly |
| 2013/0172152 | A1 | 7/2013 | Watterson |
| 2013/0178338 | A1 | 7/2013 | Ross |
| 2013/0178346 | A1 | 7/2013 | Lin |
| 2013/0182781 | A1 | 7/2013 | Matsutani |
| 2013/0185003 | A1 | 7/2013 | Carbeck et al. |
| 2013/0190136 | A1 | 7/2013 | Watterson |
| 2013/0190143 | A1 | 7/2013 | Greenhill et al. |
| 2013/0190657 | A1 | 7/2013 | Flaction et al. |
| 2013/0193655 | A1 | 8/2013 | Kaye et al. |

(56) References Cited

U.S. PATENT DOCUMENTS

| | | | |
|---|---|---|---|
| 2013/0196821 | A1 | 8/2013 | Watterson et al. |
| 2013/0196826 | A1 | 8/2013 | Colledge |
| 2013/0196827 | A1 | 8/2013 | Chang |
| 2013/0203561 | A1 | 8/2013 | Lee et al. |
| 2013/0211858 | A1 | 8/2013 | Ohnemus et al. |
| 2013/0225373 | A1 | 8/2013 | Poat |
| 2013/0225377 | A1 | 8/2013 | Lee et al. |
| 2013/0228063 | A1 | 9/2013 | Turner |
| 2013/0228422 | A1 | 9/2013 | Mathieu |
| 2013/0231219 | A1 | 9/2013 | Huang |
| 2013/0231224 | A1 | 9/2013 | Svenberg |
| 2013/0231226 | A1 | 9/2013 | Bonutti |
| 2013/0237383 | A1 | 9/2013 | Chen |
| 2013/0245966 | A1 | 9/2013 | Burroughs et al. |
| 2013/0263418 | A1 | 10/2013 | Johnson, Jr. |
| 2013/0267386 | A1 | 10/2013 | Her |
| 2013/0267392 | A1 | 10/2013 | Miranda |
| 2013/0274040 | A1 | 10/2013 | Coza et al. |
| 2013/0274064 | A1 | 10/2013 | Liang |
| 2013/0274067 | A1 | 10/2013 | Watterson et al. |
| 2013/0274069 | A1 | 10/2013 | Watterson et al. |
| 2013/0274071 | A1 | 10/2013 | Wang |
| 2013/0274074 | A1 | 10/2013 | Ghandour |
| 2013/0274075 | A1 | 10/2013 | Habing et al. |
| 2013/0280682 | A1 | 10/2013 | Levine et al. |
| 2013/0296144 | A1 | 11/2013 | Gvoich |
| 2013/0310230 | A1 | 11/2013 | Norris |
| 2013/0324368 | A1 | 12/2013 | Aragones et al. |
| 2013/0325394 | A1 | 12/2013 | Yuen et al. |
| 2013/0337974 | A1 | 12/2013 | Yanev et al. |
| 2013/0337980 | A1 | 12/2013 | Himmelrick et al. |
| 2013/0337981 | A1 | 12/2013 | Habing |
| 2013/0338802 | A1 | 12/2013 | Winsper et al. |
| 2013/0346043 | A1 | 12/2013 | Mewes et al. |
| 2014/0005009 | A1 | 1/2014 | Giannelli |
| 2014/0005811 | A1 | 1/2014 | Mikan et al. |
| 2014/0011645 | A1 | 1/2014 | Johnson et al. |
| 2014/0026788 | A1 | 1/2014 | Kallio, III et al. |
| 2014/0031181 | A1 | 1/2014 | Agostini |
| 2014/0031703 | A1 | 1/2014 | Rayner et al. |
| 2014/0039840 | A1 | 2/2014 | Yuen et al. |
| 2014/0052280 | A1 | 2/2014 | Yuen et al. |
| 2014/0056461 | A1 | 2/2014 | Afshar |
| 2014/0073488 | A1 | 3/2014 | Wu |
| 2014/0077494 | A1 | 3/2014 | Sutkowski |
| 2014/0080678 | A1 | 3/2014 | Wu |
| 2014/0085077 | A1 | 3/2014 | Luna et al. |
| 2014/0100464 | A1 | 4/2014 | Kaleal et al. |
| 2014/0102340 | A1 | 4/2014 | Kooistra |
| 2014/0106943 | A1 | 4/2014 | Simonetti |
| 2014/0106948 | A1 | 4/2014 | Agostini |
| 2014/0106949 | A1 | 4/2014 | Mestemaker |
| 2014/0113776 | A1 | 4/2014 | Jaguan |
| 2014/0113779 | A1 | 4/2014 | Loach |
| 2014/0121066 | A1 | 5/2014 | Huang et al. |
| 2014/0121071 | A1 | 5/2014 | Strom et al. |
| 2014/0121072 | A1 | 5/2014 | Ercanbrack |
| 2014/0135593 | A1 | 5/2014 | Jayalth et al. |
| 2014/0139450 | A1 | 5/2014 | Levesque et al. |
| 2014/0156228 | A1 | 6/2014 | Molettiere et al. |
| 2014/0162854 | A1 | 6/2014 | Watterson |
| 2014/0162856 | A1 | 6/2014 | Kramer |
| 2014/0171266 | A1 | 6/2014 | Hawkins, III et al. |
| 2014/0187383 | A1 | 7/2014 | Martin |
| 2014/0195103 | A1 | 7/2014 | Nassef |
| 2014/0200122 | A1 | 7/2014 | Hallmark |
| 2014/0221160 | A1 | 8/2014 | Hardy et al. |
| 2014/0221175 | A1 | 8/2014 | Liu |
| 2014/0221881 | A1 | 8/2014 | Schlauder et al. |
| 2014/0222173 | A1 | 8/2014 | Giedwoyn et al. |
| 2014/0228175 | A1 | 8/2014 | Lemos et al. |
| 2014/0228181 | A1 | 8/2014 | Powell |
| 2014/0235937 | A1 | 8/2014 | Plath |
| 2014/0265690 | A1 | 9/2014 | Henderson |
| 2014/0270375 | A1 | 9/2014 | Canavan et al. |
| 2014/0274564 | A1 | 9/2014 | Greenbaum |
| 2014/0274579 | A1 | 9/2014 | Olson |
| 2014/0274596 | A1 | 9/2014 | Krull |
| 2014/0274600 | A1 | 9/2014 | Dalebout et al. |
| 2014/0287886 | A1 | 9/2014 | Patti |
| 2014/0309087 | A1 | 10/2014 | Uygan |
| 2014/0309092 | A1 | 10/2014 | De Michele |
| 2014/0338120 | A1 | 11/2014 | Baugh et al. |
| 2014/0358473 | A1 | 12/2014 | Goel et al. |
| 2014/0360413 | A1 | 12/2014 | Schenk |
| 2015/0001048 | A1 | 1/2015 | Koppes et al. |
| 2015/0003621 | A1 | 1/2015 | Trammell |
| 2015/0004579 | A1 | 1/2015 | Shelton |
| 2015/0016623 | A1 | 1/2015 | Trammell |
| 2015/0038300 | A1 | 2/2015 | Forhan et al. |
| 2015/0044648 | A1 | 2/2015 | White et al. |
| 2015/0048807 | A1 | 2/2015 | Fan et al. |
| 2015/0051051 | A1 | 2/2015 | Liu et al. |
| 2015/0059257 | A1 | 3/2015 | Beaver |
| 2015/0065301 | A1 | 3/2015 | Oteman |
| 2015/0069738 | A1 | 3/2015 | Knight |
| 2015/0072842 | A1 | 3/2015 | Segal |
| 2015/0105220 | A1 | 4/2015 | Hong |
| 2015/0111708 | A1 | 4/2015 | Smith |
| 2015/0126348 | A1 | 5/2015 | Kaye et al. |
| 2015/0148204 | A1 | 5/2015 | Sleppy |
| 2015/0165259 | A1 | 6/2015 | Huppee et al. |
| 2015/0165270 | A1 | 6/2015 | Allos |
| 2015/0181314 | A1 | 6/2015 | Swanson |
| 2015/0182782 | A1 | 7/2015 | Cutler |
| 2015/0192929 | A1 | 7/2015 | Rihn et al. |
| 2015/0199494 | A1 | 7/2015 | Koduri et al. |
| 2015/0201722 | A1 | 7/2015 | Brouard |
| 2015/0202487 | A1 | 7/2015 | Wu |
| 2015/0209610 | A1 | 7/2015 | Dalebout et al. |
| 2015/0209617 | A1 | 7/2015 | Hsiao |
| 2015/0238801 | A1 | 8/2015 | Meredith |
| 2015/0246751 | A1 | 9/2015 | Spivack et al. |
| 2015/0250304 | A1 | 9/2015 | Dalebout |
| 2015/0251048 | A1 | 9/2015 | Dalebout |
| 2015/0253210 | A1 | 9/2015 | Ashby et al. |
| 2015/0265903 | A1 | 9/2015 | Kolen et al. |
| 2015/0273267 | A1 | 10/2015 | Manzke |
| 2015/0283420 | A1 | 10/2015 | Chang |
| 2015/0283421 | A1 | 10/2015 | Gaylord |
| 2015/0295397 | A1 | 10/2015 | Lin et al. |
| 2015/0297932 | A1 | 10/2015 | Wehrell |
| 2015/0297936 | A1 | 10/2015 | Madden |
| 2015/0314184 | A1 | 11/2015 | Moya Saez |
| 2015/0335941 | A1 | 11/2015 | Lo |
| 2015/0346994 | A1 | 12/2015 | Chanyontpatanakul |
| 2015/0352396 | A1 | 12/2015 | Dalebout |
| 2015/0352401 | A1 | 12/2015 | Johnson |
| 2015/0352402 | A1 | 12/2015 | Arnold et al. |
| 2015/0360073 | A1 | 12/2015 | Moran et al. |
| 2015/0367158 | A1 | 12/2015 | Pretz et al. |
| 2015/0367176 | A1 | 12/2015 | Bejestan et al. |
| 2015/0369326 | A1 | 12/2015 | Modrezejewski et al. |
| 2015/0375028 | A1 | 12/2015 | Oteman et al. |
| 2016/0001123 | A1 | 1/2016 | Parrish, Jr. |
| 2016/0008650 | A1 | 1/2016 | Jue et al. |
| 2016/0016035 | A1 | 1/2016 | Hao |
| 2016/0023043 | A1 | 1/2016 | Grundy |
| 2016/0027325 | A1 | 1/2016 | Malhotra |
| 2016/0038785 | A1 | 2/2016 | Netter |
| 2016/0047446 | A1 | 2/2016 | Hung |
| 2016/0051857 | A1 | 2/2016 | Rasner |
| 2016/0059064 | A1 | 3/2016 | Smith et al. |
| 2016/0061300 | A1 | 3/2016 | Aoto et al. |
| 2016/0066818 | A1 | 3/2016 | Cowley et al. |
| 2016/0074691 | A1 | 3/2016 | Pearce et al. |
| 2016/0074701 | A1 | 3/2016 | Wiener |
| 2016/0074705 | A1 | 3/2016 | Wiener |
| 2016/0089559 | A1 | 3/2016 | Smith et al. |
| 2016/0089560 | A1 | 3/2016 | Smith et al. |
| 2016/0089575 | A1 | 3/2016 | Smith et al. |
| 2016/0096064 | A1 | 4/2016 | Gatti |
| 2016/0101311 | A1 | 4/2016 | Workman |
| 2016/0107019 | A1 | 4/2016 | Shah |

(56) References Cited

U.S. PATENT DOCUMENTS

| | | | |
|---|---|---|---|
| 2016/0114205 | A1 | 4/2016 | Giunchi |
| 2016/0114211 | A1 | 4/2016 | Schmidt |
| 2016/0121156 | A1 | 5/2016 | Bach |
| 2016/0166872 | A1 | 6/2016 | Cervone et al. |
| 2016/0175643 | A1 | 6/2016 | Kueker et al. |
| 2016/0184625 | A1 | 6/2016 | Chang |
| 2016/0199683 | A1 | 7/2016 | Shamlin |
| 2016/0206248 | A1 | 7/2016 | Sartor et al. |
| 2016/0211841 | A1 | 7/2016 | Harrison |
| 2016/0219968 | A1 | 8/2016 | Martin |
| 2016/0250514 | A1 | 9/2016 | Gvoich |
| 2016/0256728 | A1 | 9/2016 | Tang |
| 2016/0263426 | A1 | 9/2016 | Mueller et al. |
| 2016/0278487 | A1 | 9/2016 | Postolek |
| 2016/0287930 | A1 | 10/2016 | Moser |
| 2016/0303414 | A1 | 10/2016 | Werner |
| 2016/0303421 | A1 | 10/2016 | Tyger et al. |
| 2016/0317861 | A1 | 11/2016 | Dalebout |
| 2016/0319850 | A1 | 11/2016 | Kamen et al. |
| 2016/0321075 | A1 | 11/2016 | Catherwood et al. |
| 2016/0346586 | A1 | 12/2016 | Pullins et al. |
| 2016/0346598 | A1 | 12/2016 | Manzke et al. |
| 2016/0346617 | A1 | 12/2016 | Sprugo |
| 2016/0367851 | A1 | 12/2016 | Astilean et al. |
| 2017/0014661 | A1 | 1/2017 | Lin |
| 2017/0021218 | A1 | 1/2017 | Peritz |
| 2017/0050069 | A1 | 2/2017 | Ky |
| 2017/0050074 | A1 | 2/2017 | Olson |
| 2017/0056711 | A1 | 3/2017 | Dalebout et al. |
| 2017/0056712 | A1 | 3/2017 | Johnson |
| 2017/0056715 | A1 | 3/2017 | Dalebout et al. |
| 2017/0056716 | A1 | 3/2017 | Cutler |
| 2017/0056726 | A1 | 3/2017 | Dalebout et al. |
| 2017/0065852 | A1 | 3/2017 | Cygan et al. |
| 2017/0068782 | A1 | 3/2017 | Pillai et al. |
| 2017/0106227 | A1 | 4/2017 | Lalaoua |
| 2017/0106240 | A1 | 4/2017 | Chuang |
| 2017/0113093 | A1 | 4/2017 | Bellavista et al. |
| 2017/0120102 | A1 | 5/2017 | Chen |
| 2017/0128784 | A1 | 5/2017 | Molins et al. |
| 2017/0136280 | A1 | 5/2017 | Lee |
| 2017/0136288 | A1 | 5/2017 | Huang |
| 2017/0136289 | A1 | 5/2017 | Frank |
| 2017/0136291 | A1 | 5/2017 | Huang |
| 2017/0136339 | A1 | 5/2017 | Habiche |
| 2017/0165523 | A1 | 6/2017 | Chou |
| 2017/0165552 | A1 | 6/2017 | Martin |
| 2017/0173394 | A1 | 6/2017 | Rider |
| 2017/0189745 | A1 | 7/2017 | Hamilton et al. |
| 2017/0197103 | A1 | 7/2017 | Rau et al. |
| 2017/0197106 | A1 | 7/2017 | Dalebout et al. |
| 2017/0216660 | A1 | 8/2017 | Lernihan |
| 2017/0239509 | A1 | 8/2017 | Wang |
| 2017/0252599 | A1 | 9/2017 | Wang |
| 2017/0266481 | A1 | 9/2017 | Dalebout |
| 2017/0266483 | A1 | 9/2017 | Dalebout et al. |
| 2017/0266532 | A1 | 9/2017 | Watterson |
| 2017/0266533 | A1 | 9/2017 | Dalebout |
| 2017/0266534 | A1 | 9/2017 | Watterson |
| 2017/0266535 | A1 | 9/2017 | Watterson |
| 2017/0274237 | A1 | 9/2017 | Chang |
| 2017/0274242 | A1 | 9/2017 | Corbalis |
| 2017/0312580 | A1 | 11/2017 | Chang |
| 2017/0319906 | A1 | 11/2017 | Chang et al. |
| 2017/0340917 | A1 | 11/2017 | Chang |
| 2017/0361145 | A1 | 12/2017 | Olson et al. |
| 2017/0367480 | A1 | 12/2017 | Dickerson et al. |
| 2017/0368442 | A1 | 12/2017 | Baudhuin |
| 2018/0001135 | A1 | 1/2018 | Powell |
| 2018/0036572 | A1 | 2/2018 | Hsu |
| 2018/0036585 | A1 | 2/2018 | Powell |
| 2018/0056111 | A1 | 3/2018 | Chiang et al. |
| 2018/0085622 | A1 | 3/2018 | Ivan |
| 2018/0092603 | A1 | 4/2018 | Duan et al. |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0104533 | A1 | 4/2018 | Powell et al. |
| 2018/0111018 | A1 | 4/2018 | Lee |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0140886 | A1 | 5/2018 | Hetrick et al. |
| 2018/0147440 | A1 | 5/2018 | Lin |

FOREIGN PATENT DOCUMENTS

| | | |
|---|---|---|
| WO | 20000030717 | 6/2000 |
| WO | 2009014330 | 1/2009 |
| WO | 2011094649 | 8/2011 |

OTHER PUBLICATIONS

Machine English translation of Abstract of KR 10-0829744. dated May 16, 2008.

International Search Report and Written Opinion issued for PCT/US2016/048692 dated Dec. 1, 2016.

International Search Report and Written Opinion issued for PCT/US2017/023002 dated Jun. 28, 2017.

U.S. Appl. No. 15/245,953, Jul. 26, 2018, Non-final Rejection.

U.S. Appl. No. 15/245,473, Sep. 22, 2017, Non-final Rejection.

U.S. Appl. No. 15/245,473, May 11, 2018, Non-final Rejection.

U.S. Appl. No. 15/245,953, Jan. 3, 2018, Non-final Rejection.

U.S. Appl. No. 15/245,453, Aug. 31, 2018, Non-final Rejection.

U.S. Appl. No. 15/461,246, Jun. 21, 2018, Non-final Rejection.

Octane Fitness; "Consumer Adapter Kit for Cross Circuit Pro-Safety and Assembly Instructions"; Instruction Manual; 2011; 4 pages; located at: https://www.octanefitness.com/home/wp-content/uploads/sites/2/2014/01/106082-001-REV-A-INSTRUCTIONS-CONSUMER-ADAPTER-FOR-CCPRO-2.22.11.pdf.

Octane Fitness; Cross Circuit Pro Kit—XT One Assembly & Set-Up Instructions; Instruction Manual; 2016; 20 pages; located at: https://www.octanefitness.com/wp-content/uploads/2016/11/110786-001-REV-C-INSTRUCTIONS-CROSS-CIRCUIT-PRO-XT-ONE-UnR.pdf.

Octane Fitness; Product Programs and Features; Instruction Manual; 2017; 56 pages; located at: https://www.octanefitness.com/home/wp-content/uploads/sites/2/2017/04/110751-001-REV-E-PROGRAMS-FEATURES-COMM-ENG.pdf.

Octane Fitness; Octane Fitness Cross Circuit; Webpage; accessed on Nov. 30, 2018; located at: https://www.octanefitness.com/commercial/cross-circuit/.

COORDINATED WEIGHT SELECTION

RELATED APPLICATIONS

This application claims priority to U.S. Patent Application Ser. No. 62/310,503 titled "Coordinated Weight Selection" and filed on Mar. 18, 2016, which application is herein incorporated by reference for all that it discloses.

BACKGROUND

While numerous exercise activities exist that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. These exercises usually include low or moderate resistance to the movement of the individual. For example, aerobic exercise includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. One type of exercise device that provides resistance to user's muscle contraction is a dumbbell. A dumbbell often includes a handle and weights at either end of the handle. In some cases, the weights are permanently affixed to the handle. Other types of dumbbells are adjustable where the weights can be removed and/or added to allow the user to adjust the amount of weight on the dumbbell.

One type of dumbbell is disclosed in U.S. Pat. No. 7,172,536 issued to Wei Ming Liu. In this reference, an adjustable dumbbell includes a number of weights each having a slot to receive end portions of a bar, and a number of latch rods slidably engaged in the weights and each having an inner end engageable into the slots of the weights and engageable with the bar, to anchor and latch a selected number of the weights to the bar, and to allow the selected weights to be moved in concert with the bar. The weights each have a spring member to bias and force the inner end of the latch rod to engage with and to latch the weights to the bar. The weights each include a panel having an orifice to slidably receive the latch rod, and to anchor the latch rod to the panel when the catch of the knob is rotated relative to the panel. Other types of dumbbells are described in U.S. Pat. No. 6,500,101 issued to James Chen, U.S. Patent Publication No. 2004/0005968 issued to Douglas A. Crawford, et al., U.S. Patent Publication No. 2012/0115689 issued to William Dalebout, et al., and WIPO International Publication No. WO/1994/017862 issued to Carl K. Towley. Each of these documents are herein incorporated by reference for all that they contain.

SUMMARY

In one embodiment, a free weight assembly includes a cradle, at least one free weight removable from the cradle, an aerobic exercise element that is movable with respect to the cradle during the performance of an exercise, an input in communication with a processor that determines a time to instruct a user to remove the free weight, and an indicator that activates when the time to remove the free weight arrives.

The indicator may be incorporated into the free weight.

The indicator may be incorporated into the cradle.

The assembly may include an adjustable dumbbell connected to the free weight where the indicator is incorporated into the adjustable dumbbell.

The adjustable dumbbell may select a weight amount for the user to lift before the time arrives.

The indicator may also indicate a weight amount to lift.

The indicator may include a light that illuminates when the time arrives.

The indicator may include a speaker that broadcasts audio commands to remove the free weight when the time arrives.

The free weight assembly may be incorporated into a treadmill.

The indicator may be coordinated with an exercise program.

The exercise program may include an anaerobic portion and an aerobic portion.

The assembly may include a second indicator that instructs the user to perform a specific exercise with the at least one free weight.

The indicator may include a display.

The assembly may include a transmitter in communication with the input.

The transmitter may be in communication with an activity tracker.

In one embodiment, a free weight assembly includes a cradle, at least one free weight removable from the cradle, an aerobic exercise element that is movable with respect to the cradle during the performance of an exercise, an input in communication with a processor that determines a time to instruct a user to remove the free weight, an adjustable dumbbell connected to the free weight, an indicator that activates when the time to remove the free weight arrives, and a transmitter in communication with the input and an activity tracker.

The adjustable dumbbell may select a weight amount for the user to lift before the time arrives.

The indicator may include a light that illuminates when the time arrives.

The free weight assembly may be incorporated into a treadmill.

In one embodiment, an exercise apparatus includes a treadmill, a free weight assembly incorporated into the treadmill. The free weight assembly includes a cradle, at least one free weight removable from the cradle, an input in communication with a processor that determines a time to instruct a user to remove the free weight, an adjustable dumbbell connected to the free weight, the adjustable dumbbell selects a weight amount for the user to lift before the time arrives, a light that illuminates when the time to remove the free weight arrives, and a transmitter in communication with the input and an activity tracker.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
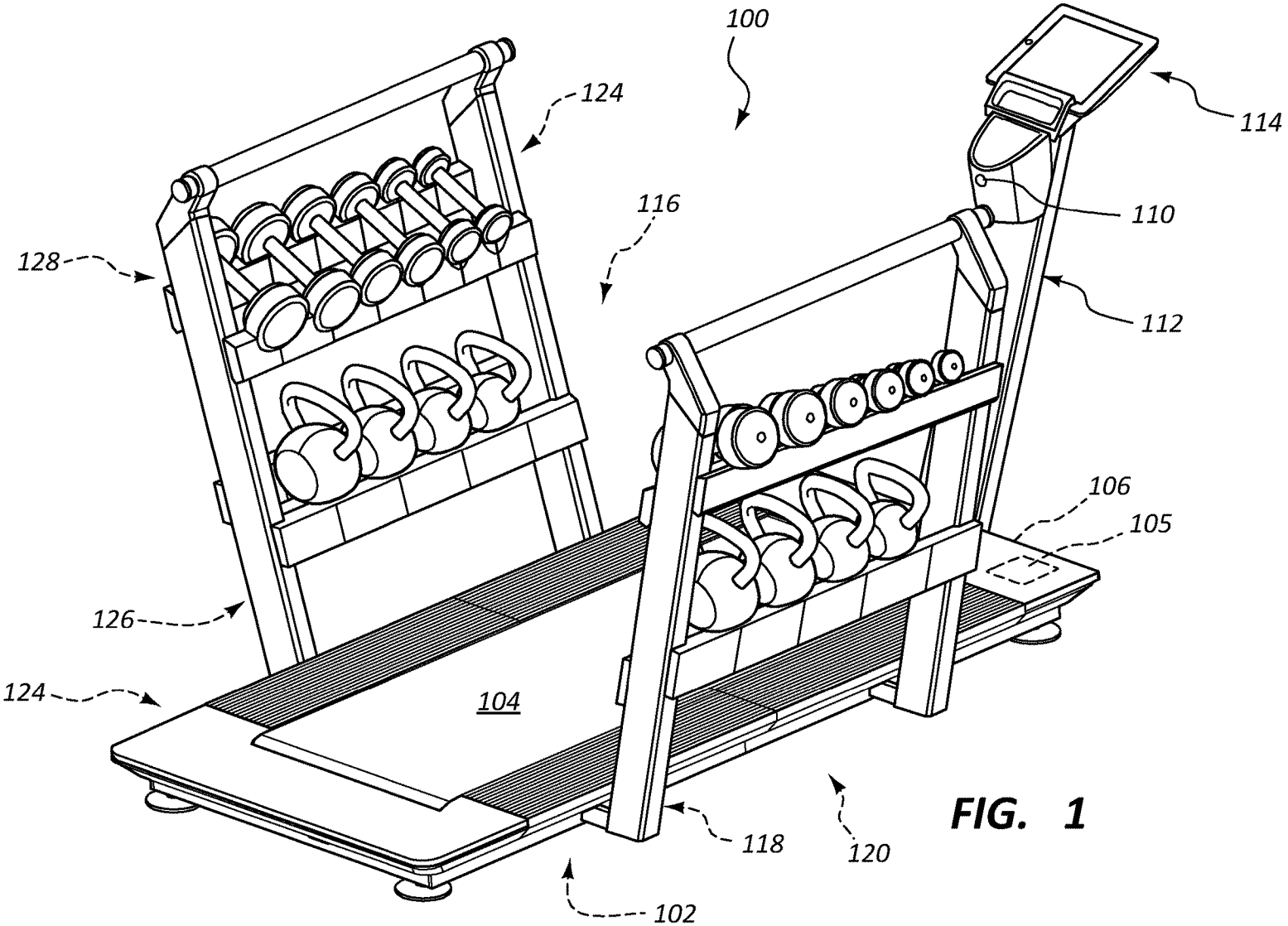
FIG. 1 illustrates a perspective view of an example of a treadmill in accordance with the present disclosure.

FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 105 is in mechanical communication with either the first pulley or the second pulley. A cover 106 is superjacent the motor 105. A repetition counter 110 is also incorporated into the treadmill. The treadmill 100 includes an upright portion 112 that supports a console 114. In this example, the repetition counter 110 is incorporated into the upright portion 112.

Also incorporated into the treadmill 100 is a free weight cradle 120. In this example, a first portion 118 of the free weight cradle 120 is connected to a first side 116 of the deck 102, and a second portion 122 of the free weight cradle 120 is connected to a second side 124 of the deck 102. The free weight cradle 120 may include multiple tiers. In this example, each of the portions of the free weight cradle include a first tier 126 and a second tier 128. In some cases, each of the tiers includes a cross member that includes features the prevent the free weights from slipping off of the rack. For example, the feature may include a lip, a recess, another type of feature, or combinations thereof.

Figure 2:
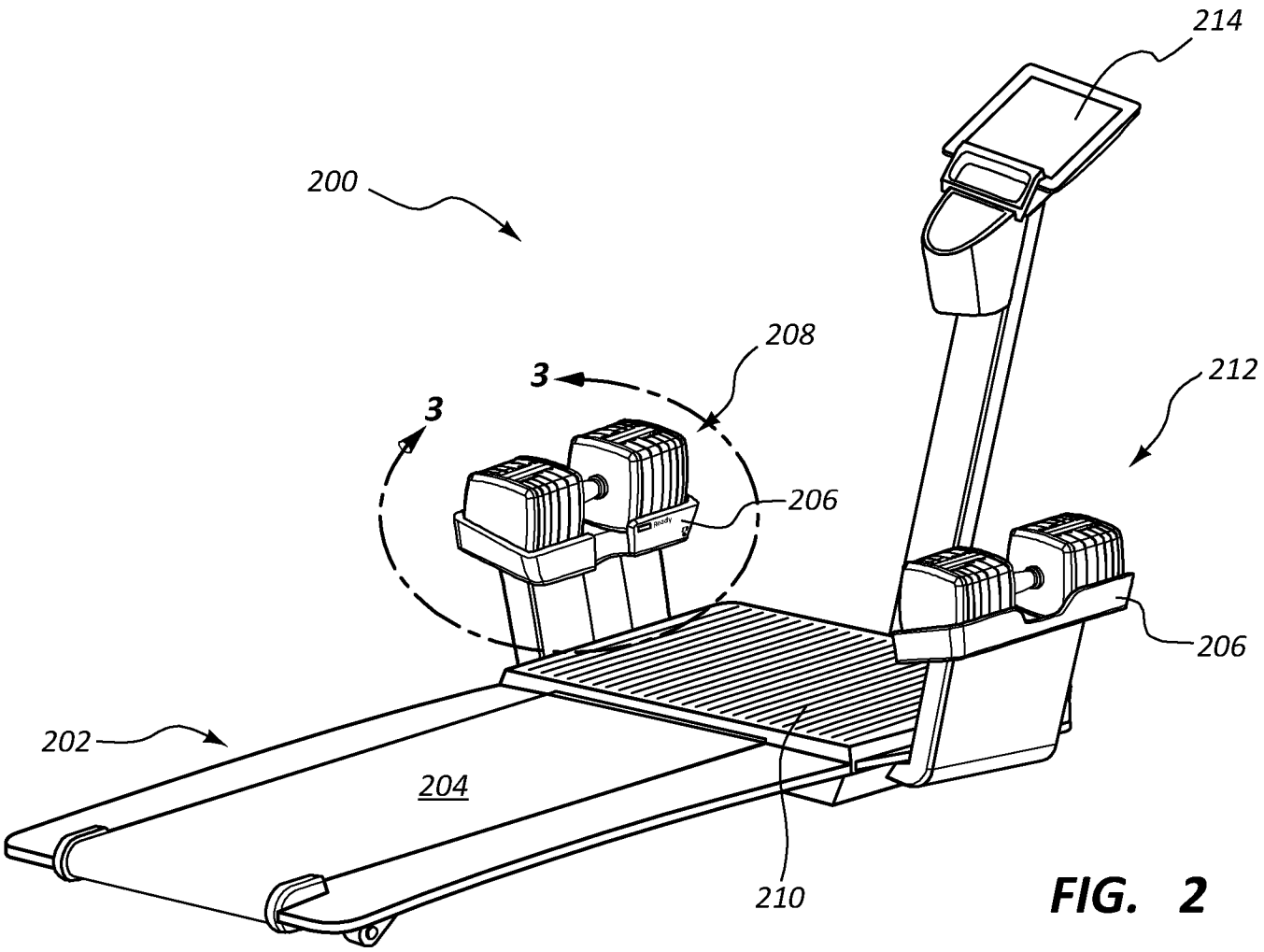
FIG. 2 illustrates a perspective view of an example of a treadmill in accordance with the present disclosure.

FIG. 2 depicts an example of a treadmill 200. In this example, the treadmill 200 includes a deck 202, and with a tread belt 204 that surrounds a first pulley and second pulley incorporated into the deck 202. A free weight cradle 206 is also incorporated into the treadmill 200. In this example, the free weight cradle 206 includes just a single tier and supports an adjustable dumbbell 208.

A weight scale 210 is incorporated into the deck 202 at a front end 212 of the treadmill 200. In this example, the weight scale 210 is positioned over the motor that drives the first pulley and therefore drives the tread belt 204. As a user stands on the weight scale 210, the weight of the user can be presented in the console 214, in a display incorporated into the weight scale 210, to a mobile device or other computing device in communication with the weight scale, or combinations thereof. Additionally, when the user lifts the free weights off of the cradle 206, the weight scale measures the combined weight of the user and the free weights. In some cases, the fluctuation of the weight scale's measurements that occur as the user performs an anaerobic exercise with the free weights is used by the repetition counter to determine how many lifts the user has performed.

Figure 3:
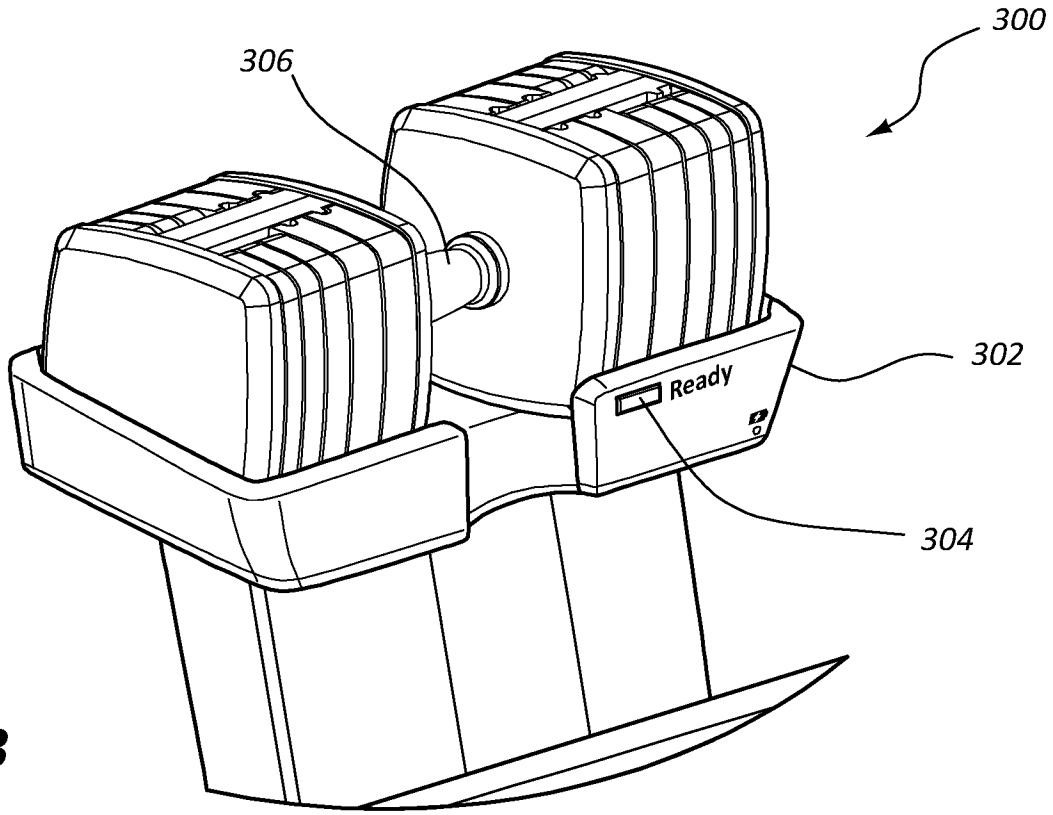
FIG. 3 illustrates a perspective view of an example of an adjustable dumbbell and a cradle in accordance with the present disclosure.

FIG. 3 depicts an adjustable dumbbell 300. In this example, the adjustable dumbbell is positioned in a cradle 302. The cradle 302 includes an indicator 304 that communicates to the user that it is time to pick up the adjustable dumbbell 300. In this example, the indicator 304 includes a light. In this example, the light can illuminate when the proper amount of weight has been mechanically connected to the handle 306 of the adjustable dumbbell. For example, the free weights positioned in the cradle and/or free weight cradle may include a fixed dumbbell, a kettle weight, a bar bell, another type of weight, or combinations thereof. The indicator 304 may indicate to the user when it is time to pick up the free weight. In some cases, multiple indicators are incorporated into a cradle and are associated with a different weight amount. For example, the cradle may include a position for a 10 pound free weight, a 15 pound free weight, and 20 pound free weight. A first indicator may correspond to the 10 pound weight, a second indicator may correspond to the 15 pound weight, and a third indicator may correspond with the 20 pound weight. When it is time for the user to use the 10 pound weight, the light of the first indicator may illuminate. Likewise, when it is time for the user to use the 20 pound weight, the light of the third indicator may illuminate.

In other examples, the free weight is another type of weight other than an adjustable dumbbell. The cradle may be any appropriate type of cradle. In some examples, the cradle includes a recess that is sized to the dimensions of the free weight intended to be located into that spot in the cradle. In other examples, the cradle may include a shelf that can accommodate free weights of varying size and dimensions.

Figure 4:
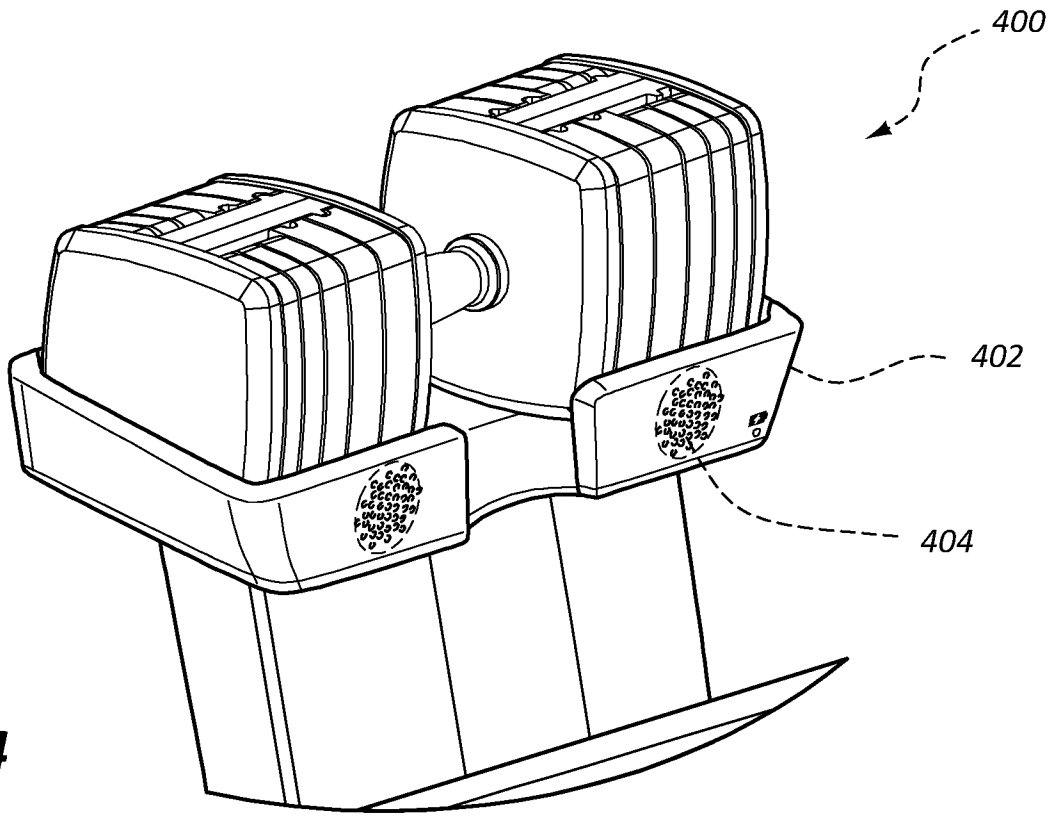
FIG. 4 illustrates a perspective view of an example of an adjustable dumbbell and a cradle in accordance with the present disclosure.

FIG. 4 depicts an adjustable dumbbell 400. In this example, the adjustable dumbbell is positioned in a cradle 402. The cradle 402 includes an indicator 404 that communicates to the user that it is time to pick up the adjustable dumbbell 400. In this example, the indicator 404 includes a speaker.

Figure 5:
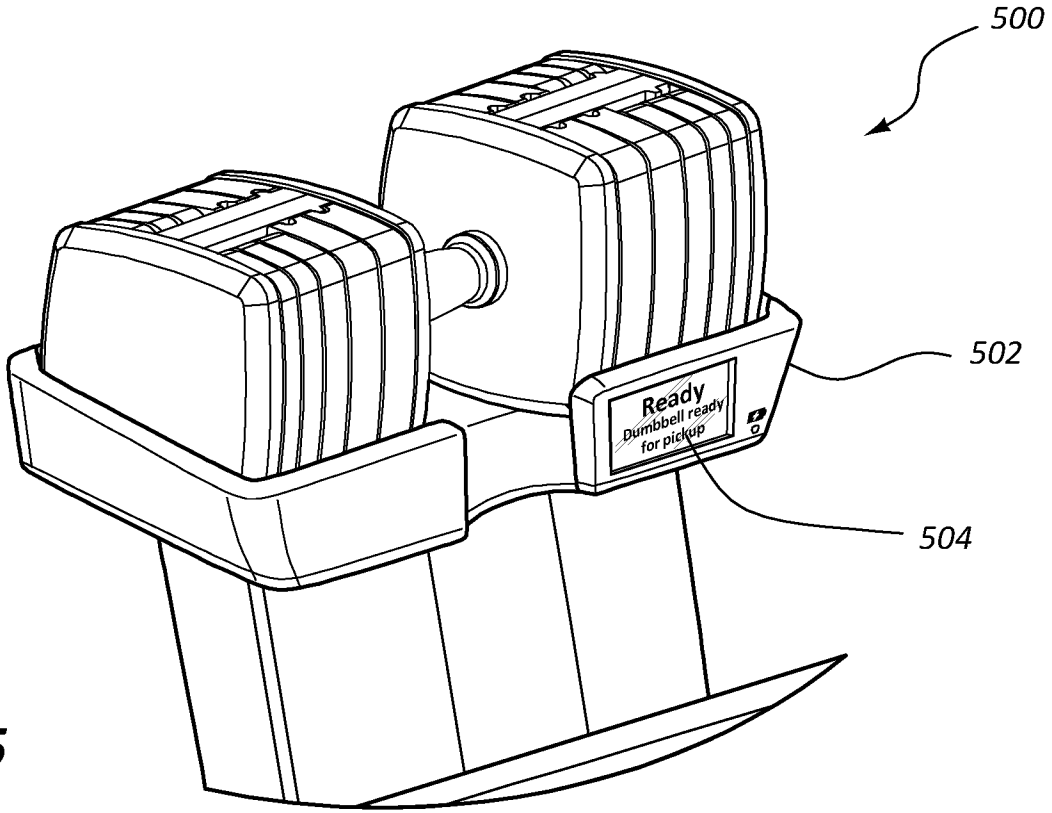
FIG. 5 illustrates a perspective view of an example of an adjustable dumbbell and a cradle in accordance with the present disclosure.

FIG. 5 depicts an adjustable dumbbell 500. In this example, the adjustable dumbbell is positioned in a cradle 502. The cradle 502 includes an indicator 504 that communicates to the user when the time to pick up the adjustable dumbbell 500 has arrived. In this example, the indicator 504 includes a display. In this example, the display indicates that it is time for the user to use the adjustable dumbbell 500 by presenting written words the display's screen. In other examples, the display may indicate to the user that it is time to use the weights by presenting an image related to lifting the weights. In yet another example, the display may indicate which amount of weight to lift, the type of lift to perform, the number of repetitions to do with each lift, safety precautions about each lift, other information, or combinations thereof.

The indicator may be connected to any appropriate portion of the free weight assembly. For example, the indicator can be connected to the adjustable dumbbell, a weight plate, another kind of free weight, the cradle, a cradle stand, other portion of the free weight assembly, or combinations thereof.

Figure 6:
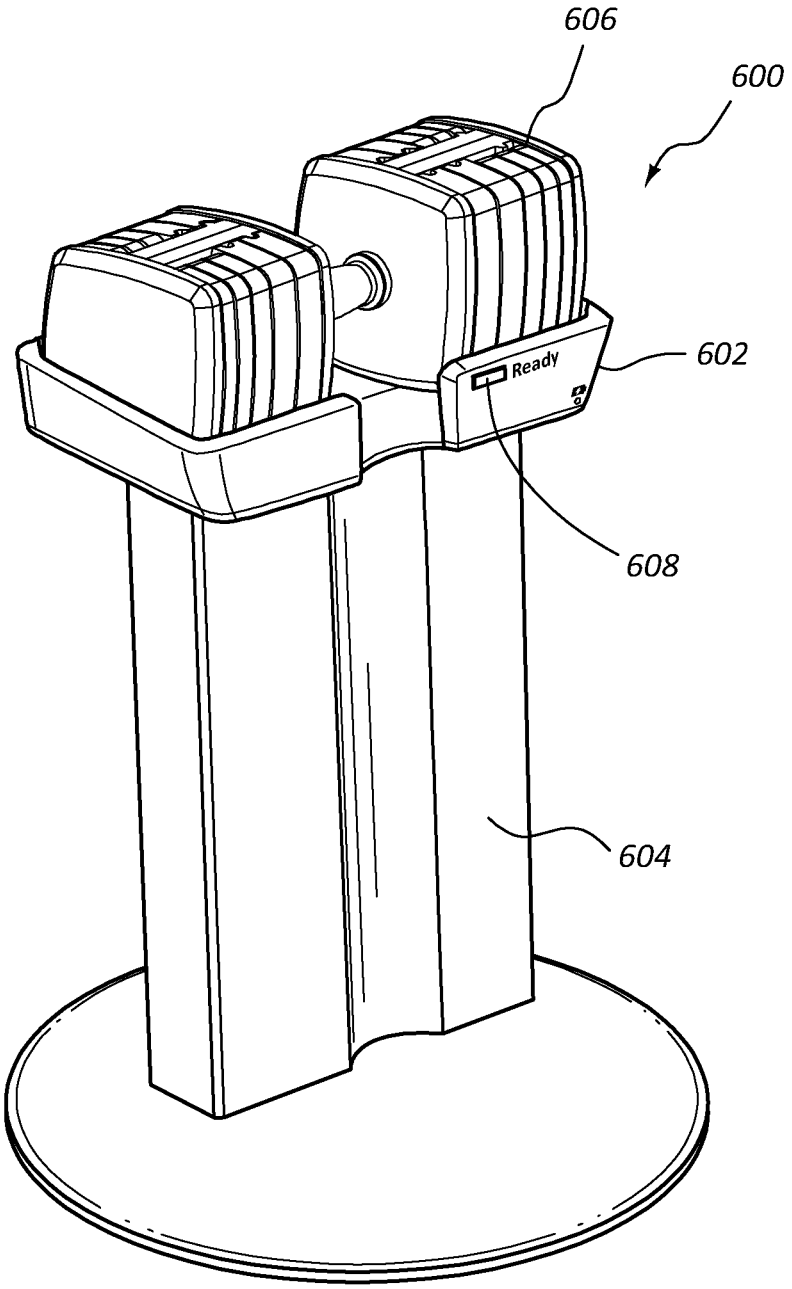
FIG. 6 illustrates a perspective view of an example of an adjustable dumbbell and a cradle in accordance with the present disclosure.

FIG. 6 depicts an example of a free weight assembly 600. In this example, a cradle 602 is supported on a stand 604. An adjustable dumbbell 606 is positioned in the cradle 602. An indicator 608 that indicates when the time has arrived to lift the adjustable dumbbell 606 out of the cradle 602 is incorporated into the cradle 602. In other examples, the indicator 608 is incorporated into the stand 604.

Figure 7:
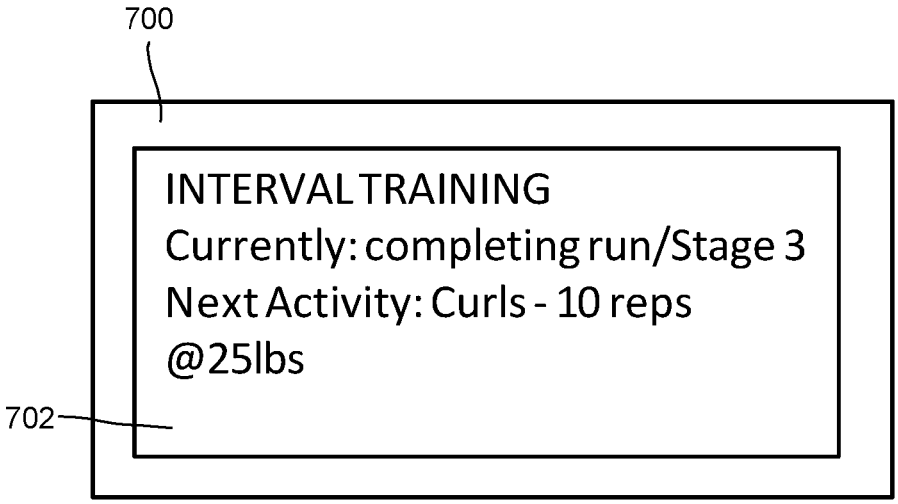
FIG. 7 depicts an example of a display incorporated into a free weight assembly.

FIG. 7 depicts an example of a display 700 incorporated into a free weight assembly. In this example, the display 700 includes a screen 702 that depicts exercise instructions to the user. The instructions provide details about the exercise activity that the user is instructed to currently be executing. In this example, the current activity is a running activity. The instructions also include the activity that the user will be instructed to execute after completing the current activity. In this example, the upcoming activity is a lifting activity.

GENERAL DESCRIPTION

In general, the invention disclosed herein may provide a user with a free weight assembly that can instruct the user on when to perform a lift with the free weights of the assembly. In some examples, the invention provides the user with a weight amount indication of what the user is to lift. An example of this aspect of the invention may include when a cradle of the assembly holds multiple free weights with varying amounts of mass. Different indicators incorporated into the assembly can indicate to the user when to pick up the different free weights by activating just those indicators that are associated with the intended free weights.

The free weight assembly may be part of an exercise machine that includes both aerobic and anaerobic components. For example, the exercise machine may include, in addition to the free weights, an aerobic exercise element that is movable with respect to the free weight's cradle during the performance of an exercise. In some cases, the aerobic exercise element is a tread belt, a pedal, a pull cable, another type of aerobic exercise element, or combinations thereof. In these situations, the free weight cradle may be incorporated into a treadmill, an elliptical trainer, a stepper machine, a stationary bicycle, a rowing machine, another type of exercise machine with an aerobic exercise component, or combinations thereof. In some cases, a display instructing the user to perform activities with the exercise machine may instruct the user to use the aerobic exercise element for anaerobic activities. For example, interval training with pedals or a tread belt is considered to be an anaerobic activity and the program can instruct the user to use the aerobic exercise element for both types of activities.

In some cases, a free weight assembly is incorporated into a treadmill or another type of exercise device. In examples where the free weight assembly is incorporated into a treadmill, the free weight cradle may have a first portion incorporated into a first side of the treadmill and a second portion of the cradle may be incorporated into a second side of the treadmill. Each portion of the free weight cradle may position the free weights within a convenient reach of each of the user's hands when the user is standing on the treadmill's deck. Thus, the free weights may be accessible to the user as the user is on the exercise deck.

The treadmill may include a running deck that has a first pulley and a second pulley. A tread belt may surround the first pulley and the second pulley. A motor can be attached to either the first or the second pulley so that as the motor rotates its shaft, the connected pulley also rotates. The rotation of the connected pulley, then drives movement of the tread belt. In those examples where the treadmill includes just a single motor, the movement of the tread belt drives movement of the other pulley that is not connected to the motor.

For purposes of this disclosure, the term "free weight" refers broadly to free weights that are intended to be used to execute an anaerobic exercise. In some cases, the free weights may be intended to be held in a single hand. Frees weights intended for the user's first hand are positioned in the first portion of the free weight cradle, and free weights intended for the user's second hand are positioned in the second portion of the free weight cradle. These free weights may include dumbbells, kettle balls, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate an upright portion of the treadmill that has a console. The console can provide information about the user's workout such as the time, distance, and speed at which the user executed the aerobic portions of the workout.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight cradle includes an adjustable dumbbell, the treadmill may cause the adjustable dumbbell to select the amount of weight prescribed by the programmed workout. In other instances, the treadmill may allow the user to manually select the amount of weight to connect to the dumbbell's handle even if the programmed workout is providing the user with instructions to lift a predetermined amount.

The predetermined amount of weight recommended in the programmed workout may be based on information about the user. This information may be derived from a history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

In some cases, the programmed workout's instructions are presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the free weight slowly, or the programmed workout may instruct the user to perform the same type of lift a different way, such as instructing the user to lift up and lower the free weight at the same rate. In other examples, a speaker may be used to audibly instruct the user about the programmed workout.

Information relating to both the anaerobic portions of the workout and the aerobic portions of the workout can be presented to the user. For instance, the repetition count may be presented in the display, the calories burned during the workout may be presented in the display, the user's heart rate, or other physiological parameters may be presented in the display, and so forth.

In some case, the treadmill is in communication with a remote device, and the information recorded about the workout is sent to the remote device. In one instance, the information is sent to the user's mobile device and the user follows the workout with his or her mobile device.

The display that depicts exercise instructions to the user may include any appropriate type of instructions for any type of activity associated with a work out. For example, the instructions may include for an aerobic activity, an anaerobic activity, a stretching activity, a warm up activity, a cool down activity, another type of activity, or combinations thereof. The instructions provide details about the exercise activity that the user is instructed to currently be executing, an activity that the user will be instructed to execute after completing the current activity, other activities that the will be executed in the future during the workout, activities that have already been executed during the workout, and combinations thereof. In some examples, the display tracks the user's success in accomplishing the exercise, at least one of the user's physiological parameters during the execution of the activity, or combinations thereof. In some examples, the display presents both aerobic and anaerobic activities at the same time.

The instruction system for instructing the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores the user information, workout history, external resources, databases, or combinations thereof. The remote device may be a mobile device, a cloud based device, a computing device, another type of device, or combinations thereof. In some examples, the system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

In some cases, the user can select a programmed workout from a library of programs that are included in the memory resources, which may be physically located in the free weight assembly, an exercise device associated with the free weight assembly, or a remote device. In other examples, the user selects a goal, like a weight strength goal, a fat loss goal, a muscle gain goal, a health goal, a fitness goal, another type of goal, or combinations thereof, and the memory resources cause the processing resources to create a programmed outwork that is customized to the user's goals. The programmed workout can control the operating parameters of the free weight assembly, such as causing the indicator to activate when it is time for the user to lift a free weight. The programmed workout can also cause certain indicators to illuminate to assist the user in knowing which free weight to use. In those examples where the free weight assembly is incorporated into another exercise machine (e.g. treadmill, elliptical trainer, stationary bicycle, stepper machine, rowing machine, or another type of exercise machine), the programmed workout can control the parameters of that exercise machine as well. For example, the programmed workout can cause the processor to control the speed of a tread belt; the incline of the treadmill's deck; the side to side tilt of the treadmill's deck; a resistance level of an elliptical trainer, a stationary bicycle, or another type of exercise machine; entertainment on the exercise machine; a volume level; a climate control; a vibration level; a scene depicted in a display; another parameter of the exercise machine; or combinations thereof.

An aerobic exercise instructor incorporated into the exercise device may represent programmed instructions that, when executed, cause the processing resources to control the aerobic portion of the user's workout. The aerobic exercise may include, but is not limited to, walking, running, shuffling, skipping, biking, jumping, or otherwise moving with the tread belt in operation. The aerobic exercise instructor may control the speed and/or incline of the tread belt based on the user's heart rate or other physiological readings, the user's goals, a programmed workout, inputs from the user, or combinations thereof.

An anaerobic exercise instructor incorporated into the exercise device may represent programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, or combinations thereof.

A weight selector incorporated into the exercise device may represent programmed instructions that, when executed, cause the processing resources to select the amount of weight to lift. In one embodiment, the free weights include an adjustable dumbbell, and a selector is incorporated into the free weight assembly. In those examples where the free weights include an adjustable dumbbell, the selector may mechanically adjust the connections between the weight plates and dumbbell's handle so that the desired amount of weight is automatically attached to the dumbbell's handle. In this situation, the user does not have to make manual adjustments to the dumbbell. In other examples, the weight selector indicates to the user which of multiple free weights the user is to lift. In this example, the free weight assembly may include multiple free weights with varying amounts of mass. Each of the potential free weights that could be lifted by the user are associated with a single indicator. To communicate to the user which of the multiple free weights is to be lifted, the programmed workout can cause the indicator associated with the desired free weight to activate. In this case, the user can determine to lift the free weight that is associated with the activated indicator.

The processing resources may determine the time when the user is to perform the lift with the free weight. The processing resources may be in communication with an input of the free weight assembly. The processing resources may send a signal to the input to activate the indicator. The processing resources may send the signal to the input in response to determining that the user has completed a previously assigned portion of the workout. In another example, the signal is sent in response to a predetermined time lapse from when the user was previously assigned to perform an aerobic portion of the workout. In yet another example, the signal is sent to the input in response to a physiological condition. In one of these examples, the programmed workout may instruct the user to run for a certain amount of time within a certain heart rate zone. In this example, after a heart rate monitor communicates to the processing resources that the user's heart rate has been in the target zone for the predetermined amount of time, the signal is sent to activate the indicator.

In some circumstances the processing resources provide instructions to the free weight assembly that the indictors are to be activated under certain conditions. The processor may depend on other instruments to provide the information that the specified conditions are meet. In some cases, an activity tracker worn by the user that tracks the user's age, fitness level, amount of sleep, calorie input, calorie burn, activity level, workout histories, health conditions, and/or other types of information may send information directly to the free weight assembly's input. The information received by from the activity tracker may indicate whether specified conditions are meet and thereby cause the indicator to activate.

In some circumstances, the user can provide an input into the free weight assembly or the exercise device when he or she has completed the assigned lift. In that circumstance, the programmed workout can instruct the user to perform another activity or indicate that the workout is finished. In those circumstances where the workout is to continue, the programmed workout may instruct the user to perform another type of lift, to rest, to perform another set of repetitions of the same lift, to perform an aerobic exercise on the exercise machine, perform another activity, or combinations thereof.

In other cases, the exercise device and/or the exercise machine can determine when the user has finished the lift. In one example, the programmed workout can determine that the lift is finished when the user returns a free weight to the cradle. In another example, the programmed workout can determine when the user has finished the lifts through another type of sensor, such as an optical sensor, a weight scale associated with the exercise device or otherwise networked to the exercise device and/or networked to the free weight assembly. In another example, a magnetic counter may be incorporated into the exercise device and/or the free weight assembly. In this embodiment, a magnet may sense each time the free weights move through an area near the magnetic sensor, which can signal to the programmed workout that another lift has been performed.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

While the examples above have been described with the free weight assembly being incorporated into an exercise machine, such as a treadmill, the free weight assembly may be independent of another exercise device. In one example, the free weight assembly includes a stand, and a cradle incorporated into the stand where the free weights can be located. In this example, the free weights may be an adjustable dumbbell, and the cradle has a selection mechanism that connects and disconnects the weight plates from the dumbbell's handles. The programmed workout that indicates when the time has arrived for the user to pick up the free weights may also cause the selection mechanism to connect and/or disconnect certain weight plates so that the adjustable dumbbell is the correct weight for the intended lift. In other cases, the indicator activates indicating that the adjustable dumbbell is ready for the lift after the selection mechanism has connected and/or disconnected the appropriate weight plates.

Any appropriate type of indicator may be used to communicate to the user to remove the free weight. In some examples, the indicator includes a light that illuminates when the time has arrived for removing the weight. In some cases where the cradle holds multiple free weights of varying amounts, multiple lights may be incorporated into the cradle or into the free weights themselves. When the time has arrived to remove a specific free weight, the light associated with that specific free weigh illuminates indicating to the user to remove that free weight.

In yet another example, the indicator includes a speaker. In this example, the speaker can broadcast audio instructions for the user to remove the weight. In examples where the indicator includes a speaker, the indictor can provide the user with other types of information, like the number of repetitions, the lift type, safety recommendations, pacing information, other types of information associated with the lift or other aspects of the workout, or combinations thereof.

In another example, the indicator may include a display that can present written messages to the user about lifting the weight, the amount of weight to lift, pacing information, safety recommendations, the lift type, or other types of information relating to the lift or other portions of the workout.

In those examples where an adjustable dumbbell is used, the programmed workout may send instruction to the adjustable dumbbell that connects and/or disconnects weight plates to the dumbbell's handle. In one example, the cradle may include selectors that are incorporated into the troughs defined in the cradle. These selectors may be spaced within the cradle so that each of the selectors correspond to each weight plate of the dumbbell's weight set. As the dumbbells are received in the troughs, the selectors protrude into the cavities defined in the weight plates. The linear position of the selectors is adjustable and is controlled based on the programmed workout's instructions. The linear position of the selectors determines whether the weight associated with the selector is connected to the dumbbell or released from the dumbbell.

The selector may include a rod linearly movable to engage a selection mechanism in the adjustable dumbbell through the cavity. A linear actuator may cause the rod to be in a first linear position or a second linear position. In the first linear position, a distal end of the selector engages the connection features causing the connection features to disconnect the weight from the dumbbell's handle.

In the second linear position of the selector, the distal end moves away from the connection features. In this type of situation, the distal end may not inhibit the connection features from moving. The connection features may be spring loaded or otherwise urged into the interlocking position when no opposing force is applied to put the connection features into the release position. Thus, as the distal end moves out of the way, the connection features move back into the interlocking position.

When the adjustable dumbbells are docked in the cradle, the selector can disconnect the corresponding weights by moving the rod into the first linear position. For those weights that are to remain connected to the adjustable dumbbells, the rods can be positioned so that the rods do not cause the connection features to release the weights. Alternatively, the rods may move to release the weights and reconnect them.

What is claimed is:

1. A free weight assembly comprising:

a cradle;

an aerobic exercise element that is movable with respect to the cradle during a performance of a programmed workout;

a free weight removable from the cradle;

a processor configured to determine a time to instruct a user to remove the free weight and perform a set of repetitions of a type of lift with the free weight according to the programmed workout; and a display screen configured to indicate when the time arrives, according to the programmed workout, by presenting written words, and an image, related to the set on the display screen.

2. The free weight assembly of claim 1, wherein the free weight includes an adjustable dumbbell.

3. The free weight assembly of claim 2, wherein:

the processor is further configured to determine a weight amount for the user to manually select on the adjustable dumbbell for the set before the time arrives; and the display screen is further configured to indicate the weight amount when the time arrives.

4. The free weight assembly of claim 1, further comprising a speaker configured to broadcast audio commands to remove the free weight and perform the set when the time arrives according to the programmed workout.

5. The free weight assembly of claim 1, wherein:

the free weight assembly is incorporated into a treadmill; and the aerobic exercise element is a tread belt.

6. The free weight assembly of claim 1, wherein the programmed workout includes an anaerobic portion and an aerobic portion.

7. The free weight assembly of claim 6, wherein the display screen is further configured to present information relating to both the anaerobic portion and the aerobic portion of the programmed workout.

8. The free weight assembly of claim 7, wherein the information relating to both the anaerobic portion and the aerobic portion of the programmed workout includes calories burned during the programmed workout and a user heart rate during the programmed workout.

9. The free weight assembly of claim 1, wherein:

the free weight assembly is incorporated into an elliptical trainer; and the aerobic exercise element is a pedal.

10. The free weight assembly of claim 1, wherein the display screen is further configured to indicate a next type of lift to perform with the free weight after the set.

11. The free weight assembly of claim 1, wherein the display screen is further configured to indicate a number of repetitions to perform with the free weight during the set.

12. The free weight assembly of claim 1, wherein the display screen is further configured to indicate safety precautions to observe with the free weight during the set.

13. The free weight assembly of claim 1, wherein the display screen is further configured to indicate how to perform the set with the free weight.

14. The free weight assembly of claim 1, wherein the display screen is further configured to indicate pacing for performance of the set with the free weight.

15. The free weight assembly of claim 1, further comprising an electronic repetition counter configured to automatically determine how many lifts of the free weight the user has performed in order to determine when the user has finished with the set.

16. An exercise apparatus comprising:

a stationary bicycle including pedals;

a free weight assembly incorporated into the stationary bicycle, the free weight assembly including:

a cradle;

a free weight removable from the cradle;

a processor configured to determine a time to instruct a user to remove the free weight and perform a set of repetitions of a type of lift with the free weight according to a programmed workout;

a display screen configured to indicate when the time arrives, according to the programmed workout; and a speaker configured to broadcast audio commands to remove the free weight and perform the set when the time arrives according to the programmed workout.

17. The exercise apparatus of claim 16, wherein:

the programmed workout includes an anaerobic portion performed by lifting the free weight and an aerobic portion performed by pedaling the pedals; and performance of the anaerobic portion and the aerobic portion at least partially overlap during performance of the programmed workout on the exercise apparatus.

18. The exercise apparatus of claim 16, wherein:

the cradle includes a first portion incorporated into a first side of the stationary bicycle; and the cradle includes a second side incorporated into a second side of the stationary bicycle.

19. The exercise apparatus of claim 16, wherein the display screen is incorporated into a console of the stationary bicycle.

20. The exercise apparatus of claim 16, wherein the processor is configured to download the programmed workout from a remote server over a network.

* * * * *